US006123241A

United States Patent [19]

Walter et al.

[11] Patent Number: 6,123,241

[45] Date of Patent: Sep. 26, 2000

[54] INTERNAL COMBUSTION POWERED TOOL

[75] Inventors: Tony J. Walter, Cary; J. Oscar Aparicio, Jr., Aurora, both of Ill.

[73] Assignee: Applied Tool Development Corporation, Elgin, Ill.

[21] Appl. No.: 09/215,726

[22] Filed: Dec. 18, 1998

Related U.S. Application Data

[60] Continuation-in-part of application No. 08/920,160, Aug. 26, 1997, Pat. No. 5,873,508, which is a division of application No. 08/447,787, May 23, 1995, Pat. No. 5,752,643.

[51] Int. Cl.[7] ..... B25C 1/08

[52] U.S. Cl. ..... 227/8; 227/10; 227/130; 123/46 SC

[58] Field of Search ..... 227/8, 10, 130, 227/142; 123/46 SC

[56] References Cited

U.S. PATENT DOCUMENTS

| | | |
|---|---|---|
| 3,042,008 | 7/1962 | Liesse . |
| 3,150,488 | 9/1964 | Hanley . |
| 3,202,055 | 8/1965 | Butler et al. . |

(List continued on next page.)

FOREIGN PATENT DOCUMENTS

| | | |
|---|---|---|
| 25 52 106 | 5/1976 | Germany . |
| 52-3772 | 1/1977 | Japan . |
| 53-34179 | 3/1978 | Japan . |
| 53-115980 | 10/1978 | Japan . |
| 53-115981 | 10/1978 | Japan . |
| 1-280883 | 11/1990 | Japan . |
| 2-212757 | 11/1990 | Japan . |

OTHER PUBLICATIONS

SAE, Highway Vehicle Recommended Practice, Gasoline Fuel Injector, Issued Nov., 1989.

"Effects of Mixture Formation of Fuel Injection Systems in Gasoline Engine," Society of Automotive Engineers, Inc., Warrendal, Pennsylvania, USA (1989).

"Mixture Formation of Fuel Injection Systems in Gasoline Engines," Society of Automotive Engineers, Inc., Warrendale Pennsylvania, USA (1988).

"Gasoline Fuel Injector," Society of Automotive Engineers, Inc., Warrendale, Pennyslvania, USA (1989.11).

"High Speed Fuel Injection System for Two–Stroke D.I. Gasoline Engine," Society of Automotive Engineers, Inc., Warrendale, Pennsylvania, USA (1991).

"Daimler–Benz 2.3 Litre, 16–Valve High–Performance Engine," Society of Automotive Engineers, Inc., Warrendale, Pennsylvania, USA (1984).

"A New Series of Timing and Injection Rate Control Systems—AD–TICS and P–TICS," Society of Automotive Engineers, Inc., Warrendale Pennsylvania, USA (1988).

(List continued on next page.)

*Primary Examiner*—Scott A. Smith

*Attorney, Agent, or Firm*—Cook, Alex, McFarron, Manzo, Cummings & Mehler, Ltd.

[57] ABSTRACT

An internal combustion powered tool, such as a nail or fastener driver, and a control system, spark source, and rotary valve for use in an internal combustion powered tool are disclosed. The tool may include, for example, a cylinder and a piston reciprocally moveable within the cylinder. A combustion chamber is defined at one end of the cylinder, with the piston comprising a portion of one end of the combustion chamber. The tool may have a fastener driver associated with the piston, and a magazine for feeding fasteners into registration with the driver. A fuel flow passageway extends between a fuel source and the combustion chamber, and a metering valve controls the flow of fuel to the combustion chamber. A spark source within the combustion chamber is provided for igniting the fuel, and an intake and exhaust valve that includes a pair of diametrically opposed apertures is provided. At least one fan external to the combustion chamber induces an intake of fresh air into the combustion chamber through one of the apertures and an exhaust of combustion products from the combustion chamber through the other aperture. Additional and alternative details and features are described in the disclosure.

7 Claims, 34 Drawing Sheets

U.S. PATENT DOCUMENTS

| | | |
|---|---|---|
| 3,645,091 | 2/1972 | Ivanov et al. . |
| 3,858,781 | 1/1975 | Obergfell et al. . |
| 3,967,771 | 7/1976 | Smith . |
| 4,007,803 | 2/1977 | Airhart . |
| 4,060,188 | 11/1977 | Monson . |
| 4,073,362 | 2/1978 | Airhart . |
| 4,132,210 | 1/1979 | Long . |
| 4,260,092 | 4/1981 | Austin . |
| 4,279,341 | 7/1981 | Pleickhardt . |
| 4,286,496 | 9/1981 | Harris . |
| 4,331,277 | 5/1982 | Green . |
| 4,401,251 | 8/1983 | Nikolich . |
| 4,403,722 | 9/1983 | Nikolich . |
| 4,430,035 | 2/1984 | Rodseth . |
| 4,483,280 | 11/1984 | Nikolich . |
| 4,483,473 | 11/1984 | Wagdy . |
| 4,483,474 | 11/1984 | Nikolich . |
| 4,522,162 | 6/1985 | Nikolich . |
| 4,597,517 | 7/1986 | Wagdy . |
| 4,712,379 | 12/1987 | Adams et al. . |
| 4,721,240 | 1/1988 | Cotta . |
| 4,739,915 | 4/1988 | Cotta . |
| 4,773,581 | 9/1988 | Ohtsu et al. . |
| 4,913,331 | 4/1990 | Utsumi et al. . |
| 4,932,480 | 6/1990 | Golsch . |
| 4,942,996 | 7/1990 | Wolfberg et al. . |
| 4,975,008 | 12/1990 | Wagner . |
| 4,979,858 | 12/1990 | Van Allman et al. . |
| 5,069,340 | 12/1991 | Ernst et al. . |
| 5,090,606 | 2/1992 | Torii et al. . |
| 5,133,329 | 7/1992 | Rodseth et al. . |
| 5,191,209 | 3/1993 | Rodseth et al. . |
| 5,193,729 | 3/1993 | Dewey et al. . |
| 5,197,646 | 3/1993 | Nikolich . |
| 5,197,647 | 3/1993 | Howell . |
| 5,199,506 | 4/1993 | Dewey et al. . |
| 5,199,625 | 4/1993 | Dewey et al. . |
| 5,213,247 | 5/1993 | Gschwend et al. . |
| 5,261,587 | 11/1993 | Robinson . |
| 5,263,439 | 11/1993 | Doherty et al. . |
| 5,263,626 | 11/1993 | Howard et al. . |
| 5,302,068 | 4/1994 | Janusz et al. . |
| 5,320,268 | 6/1994 | Shkolnikov et al. . |
| 5,415,136 | 5/1995 | Doherty et al. . |
| 5,437,404 | 8/1995 | Shkolnikov . |
| 5,443,345 | 8/1995 | Gupta . |
| 5,452,835 | 9/1995 | Shkolnikov . |
| 5,484,094 | 1/1996 | Gupta . |
| 5,558,264 | 9/1996 | Weinstein . |
| 5,687,899 | 11/1997 | Dohi et al. ..... 227/130 |
| 5,713,313 | 2/1998 | Berry ..... 227/10 |
| 5,909,836 | 6/1999 | Shkolnikov et al. ..... 227/8 |
| 6,012,622 | 1/2000 | Weinger et al. ..... 227/10 |

OTHER PUBLICATIONS

"The United Technology Alpha Series Fuel Injector—High Performance at a Reduced Cost," Society of Automotive Engineers, Inc., Warrendale, Pennsylvania, USA (1985).

"Impact of Gasoline Characteristics on Fuel Economy," Society of Automotive Engineers, Inc., Warrendale, Pennsylvania, USA (1978).

"A Feedback Controlled Carburetion System Using Air Bleeds," Society of Automotive Engineers, Inc., Warrendale, Pennsylvania, USA (1977); and.

"Caterpillar's New Sleeve Metering Fuel Injection Systems," Society of Automotive Engineers, Inc., Warrendale, Pennsylvania, USA (1977).

10
11
12
12a
12b
13
14
16
18
20
22
24
26
28
30
32
34
36
38
40
40a
40b
40c
42
44
46
48
50
56
58
60
62
64
66
68
70
72
74
76
78
80
82
84
85
86
90

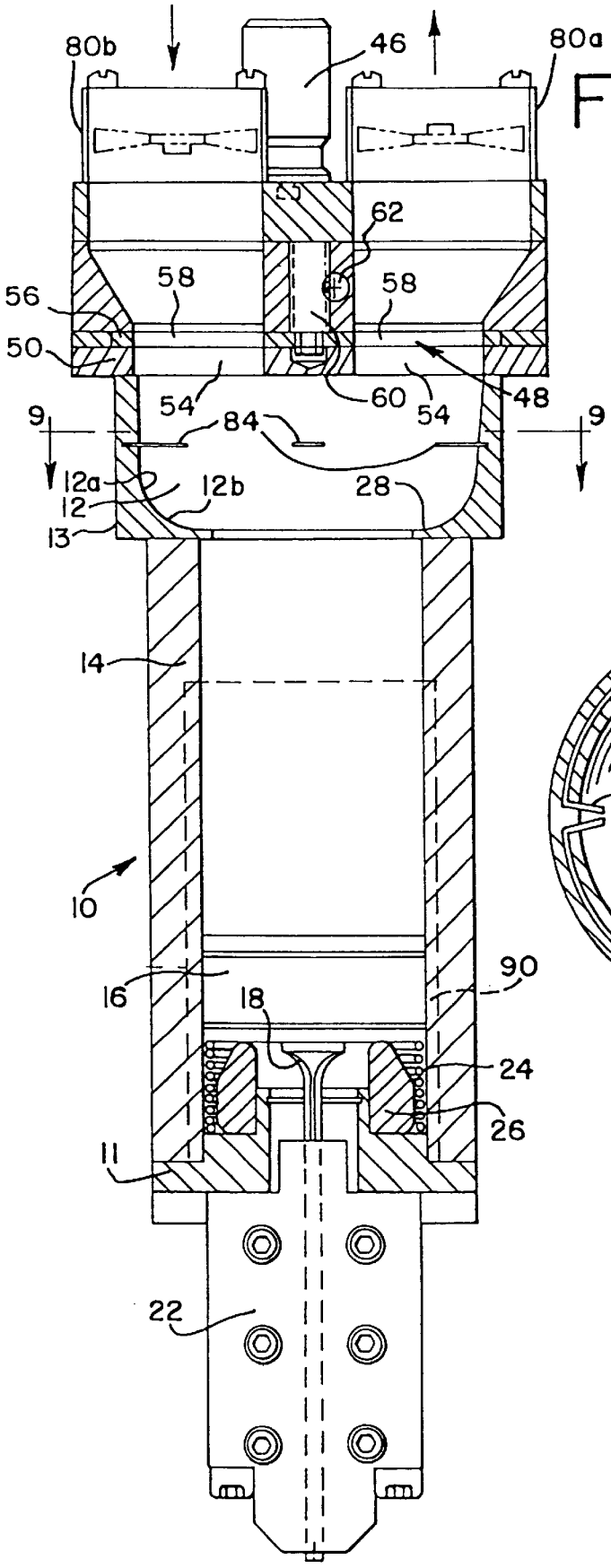
FIG. 2
FIG. 9
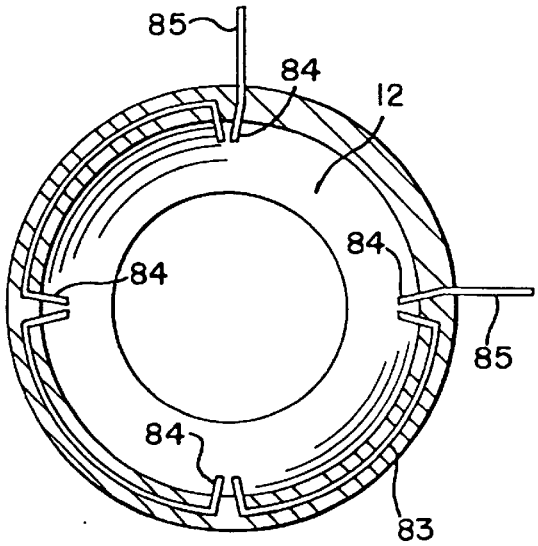

CAM UP

CAM DOWN

CPU INTERFACE CIRCUIT
298
CPU: 68HC11 SERIES E
PART NO. XC68HC711E9CFS2
300
8Mhz
XTAL
1M
10K
4.7K
MC34064P
SW1
5 Vdc
REGULATOR
LM7805
9V ALKALINE
BATTERY
C0 = 1000uf
C1 = C2 = 22pf
C3 = 0.1uf
C4 = 0.1uf
C5 = 10uf

POWER RELAY; DPDT
360

HARDWARE STATUS LED
370

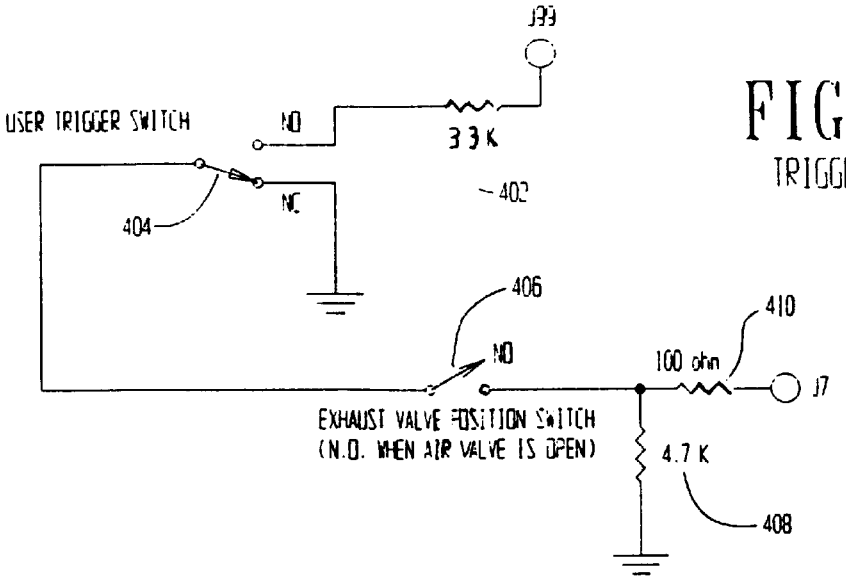
FIG. 29
TRIGGER SIGNAL
400
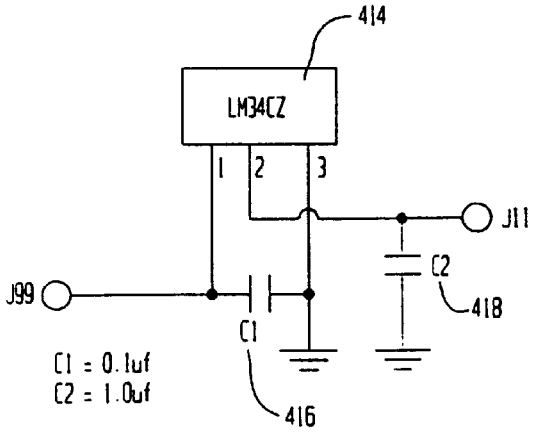
FIG. 30
TEMPERATURE SENSOR:
LM34CZ (-40°F TO +230°F)
412
FIG. 31
FUEL PRESSURE SENSOR:
MPX5999 (0 TO 150 PSI)
420
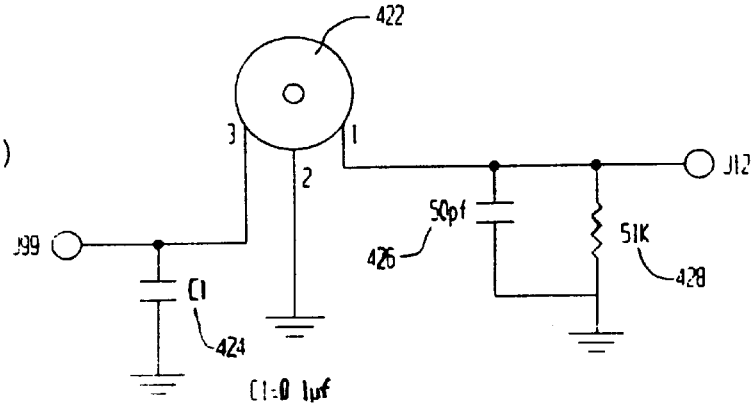

CPU BATTERY VOLTAGE
430

MAIN BATTERY VOLTAGE
436

FUEL SYSTEM
442

IGNITION SYSTEM
452

SCAVENGING SYSTEM
468

ECONOMY MODEL USER INTERFACE

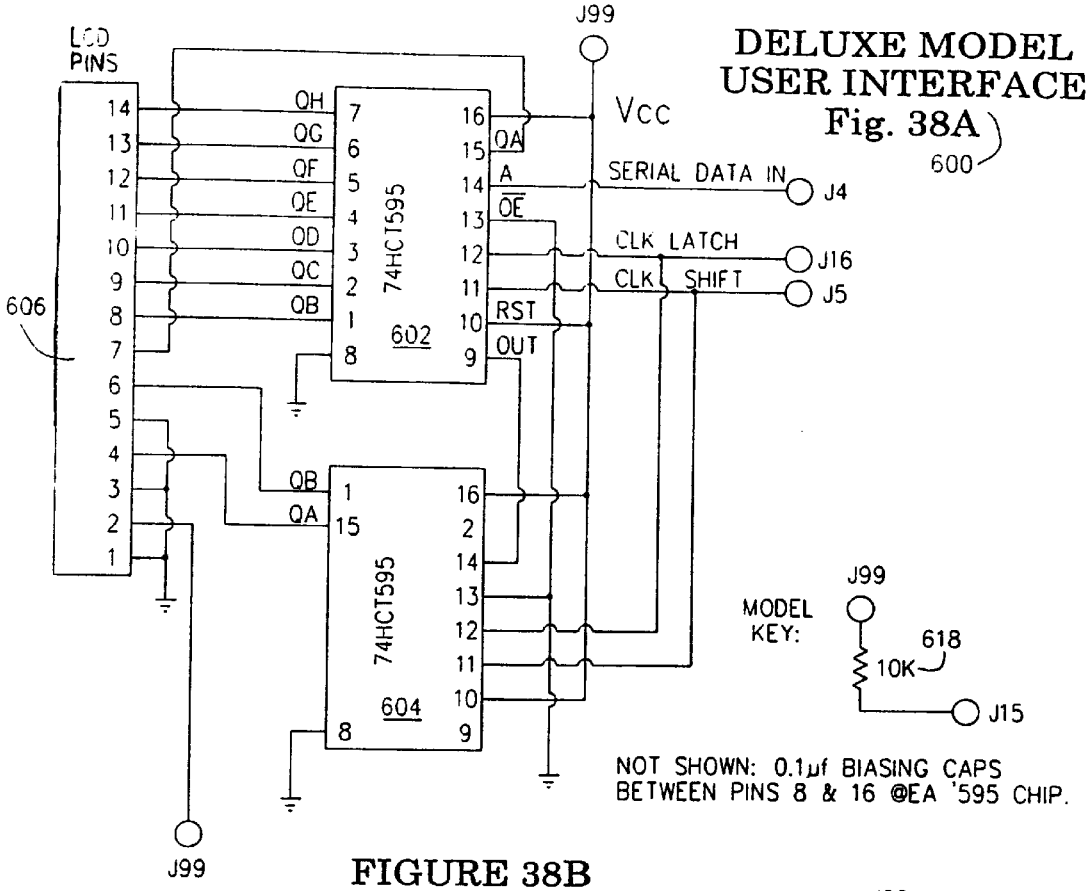
FIGURE 38B
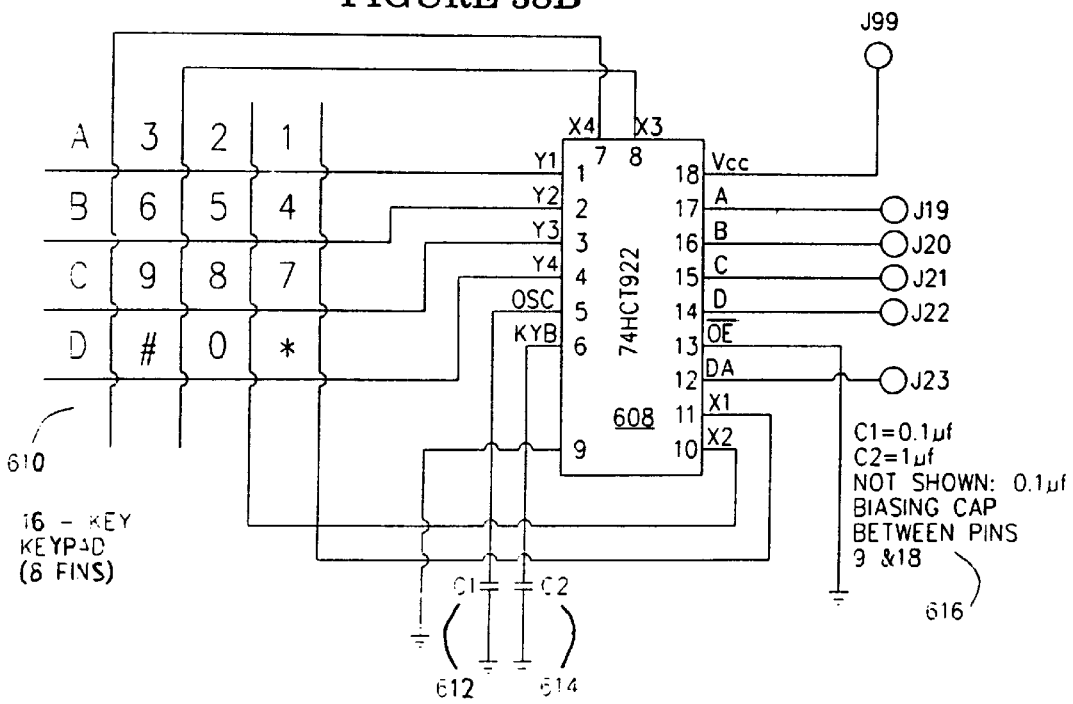

COMMUNICATIONS DOWNLOAD MODULE

COMMUNICATIONS MODULE'S POWER SUPPLY

C6 = 220μf
C7 = 0.1μf
C8 = 10μf

Fig. 40I

SLEEP MODE

-SET-UP MODE STATUS VALUE FOR NEXT RESET BUTTON EVENT TO "WAS SLEEPING"
-ASSERT ALL OUTPUTS OFF
-UPDATE SHOT LOG IN EEPROM (IF NEW SHOTS WERE MADE)
-RECORD ACTIVE FAULT CODES IN EEPROM
-WAIT FOR PRE-SET SHUT-DOWN DELAY
-TURN LCD AND LED'S OFF
-TURN POWER RELAY OFF
-ENTER CPU STOP MODE

INTERNAL COMBUSTION POWERED TOOL

CROSS REFERENCE TO RELATED APPLICATION

This application is a continuation-in-part of U.S. patent application Ser. No. 08/920,160, filed Aug. 26, 1997, now U.S. Pat. No. 5,873,508 which is a division of U.S. patent application Ser. No. 08/447,787, filed May 23, 1995, now U.S. Pat. No. 5,752,643, which issued on May 19, 1998.

TECHNICAL FIELD

The present invention relates generally to cordless, self-contained tools and, more particularly, to internal combustion powered tools, such as hand-held fastener driving tools and the like.

BACKGROUND OF THE INVENTION

Fastener driving tools, such as nail or staple drivers, are well known. For example, U.S. Pat. No. 4,403,722 to Nikolich and U.S. Pat. No. 5,090,606 to Torii et al. disclose internal combustion gas-powered fastener driving tools that are portable and self-contained.

Of course, one of the requirements for a fastener driving tool is that it must generate a force that is sufficient to drive a fastener, such as a nail or staple, into the work surface. In many, if not most, applications the fastener is being driven into a solid or hard surface, such as timber framing, concrete or the like. The driving force must therefore be substantial, whether it is developed by the combustion of fuel or by compressed air or by other means. Regardless of the means used to provide the force needed to drive a fastener into an object, it is desirable to provide the greatest amount of force from the resource used, i.e., maximize the efficiency of the fastener driving tool.

In internal combustion powered drivers, the driving force is dependent on proper combustion of the fuel within the tool. More particularly, a persistent issue in the development of an efficient gas-powered tool is reliable ignition of the fuel-air mixture for generation of sufficient power for driving nails or performing other high-power requirement tasks. The flammability limits of propane in air are about 2.2% to 9.5% by volume. When combusted, fuel-to-air ratios in the mid to low end of this range ("lean" mixtures) release the most energy, provide the greatest driving force, and use the fuel most efficiently. Lean mixtures, however, are often difficult to ignite. Fuel-to-air ratios in the mid to high range ("rich" mixtures) release relatively less energy, produce less driving force, and use more fuel per cycle. Rich mixtures, however, are typically more easily ignited than lean mixtures.

The hand tools disclosed in the Torii and Nikolich patents, for example, use a system of baffles or a fan within the combustion chamber to enhance mixing of the fuel-air mixture to provide more reliable and efficient ignition, particularly for lean mixtures. Although the tools shown in Torii and Nikolich may function generally satisfactorily, the internal construction of the tools is complicated, which adds to the manufacturing and assembly cost, as well as to the weight of the device, which is important for portability. Also, internal fans within the combustion chamber may suffer from repeated firing of the device and require more frequent maintenance or replacement.

In addition, combustion may be affected by the presence of gasses or uncombusted fuel that remains in the combustion chamber after firing. In such circumstances it is difficult to accurately control the fuel-to-air mixture in the subsequent combustion cycle, which is required for maximizing the efficiency of the tool. As a result, it is desirable to scavenge or remove as fully as possible the uncombusted fuel and residual gasses from each discharge so that combustion in the next cycle can be more accurately controlled.

It is also important that a fastener driving tool experience a minimum amount of down-time. Routine and proper maintenance of fastener driving tools can help minimize the need for repairs and extend the life of the tool. Evaluating the condition of the tool on a regular basis is essential if breakdowns are to be anticipated in advance and equally important in preventing avoidable damage to the tool.

There is also a continued need to improve the safety of fastener driving tools. Safe work methods cannot always be relied upon to prevent injury or death. Therefore, it is desirable that a fastener driving tool be equipped with safety features to prevent accidental discharge and/or detect whether the tool is being mishandled. Further, it is desirable that the tool include a security mechanism to prevent operation when handled by an unauthorized user, such as a child or thief.

Accordingly, it is a general object of the present invention to provide an fastener driving tool that overcomes one or more of the shortcomings described above.

BRIEF DESCRIPTION OF THE DRAWINGS

FIG. 2 is a front, elevational view in partial cross-section of the fastener driving tool of FIG. 1 in the "driven" condition;

FIG. 9 is a cross-sectional view of the combustion chamber of the tool taken along line 9—9 of FIG. 2 and showing a sparking device or spark source providing multiple spark gaps;

FIG. 29 is a circuit diagram of a trigger signal circuit for the microprocessor-controlled embodiment of the present invention;

FIG. 30 illustrates the terminal connections for a temperature sensor for the microprocessor-controlled embodiment of the present invention;

FIG. 31 illustrates the terminal connections for a fuel pressure sensor for the microprocessor-controlled embodiment of the present invention;

FIGS. 38A and 38B comprise a circuit diagram of an alternate embodiment of the user interface circuit for the microprocessor-controlled embodiment of the present invention;

FIGS. 40A through 40I comprise a detailed flow chart for the microprocessor-controlled embodiment of the present invention;

DETAILED DESCRIPTION OF THE PREFERRED EMBODIMENT

Figures 1, 7, 8:
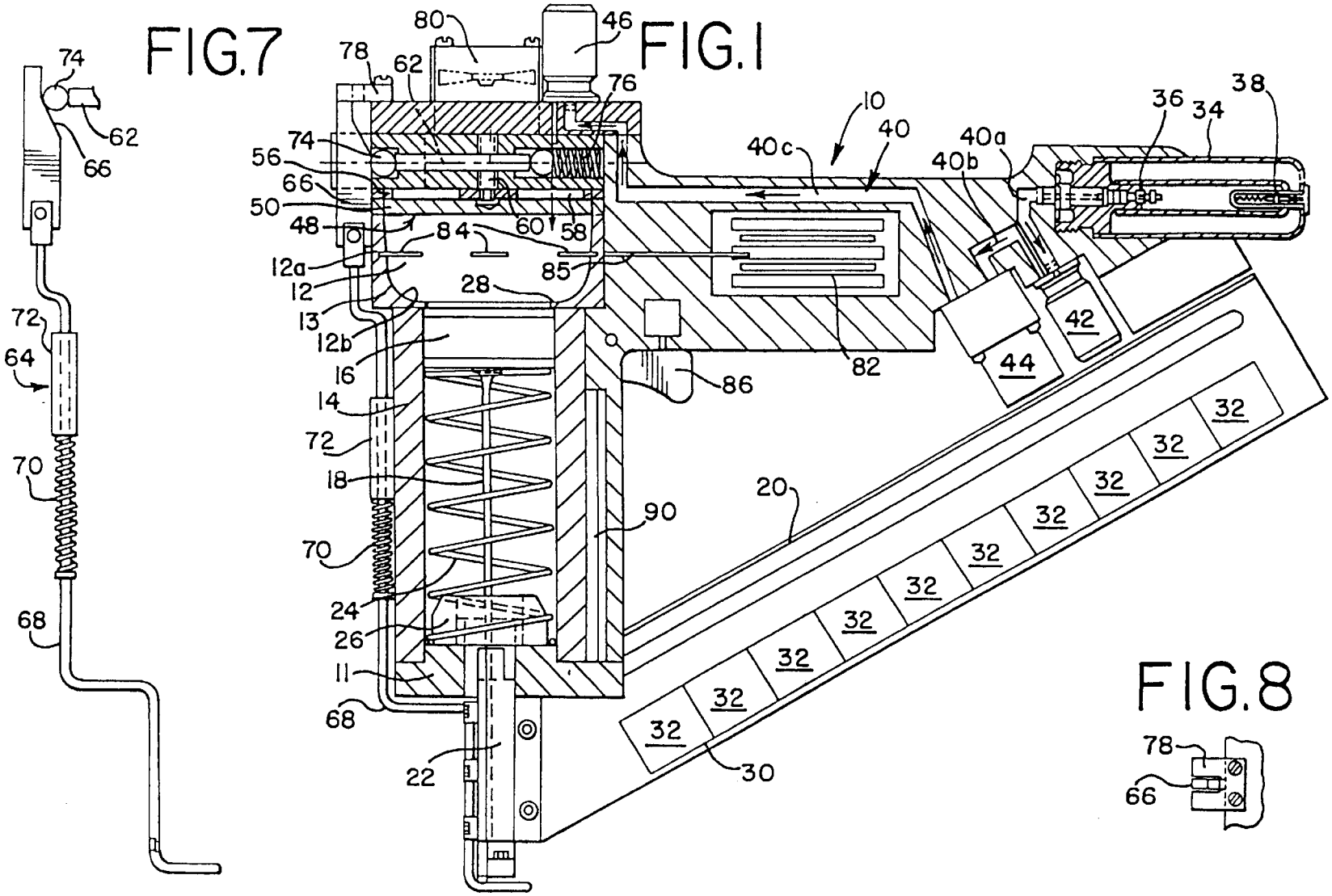
FIG. 1 is a side, elevational view in partial cross-section of an internal combustion gas-powered fastener driving tool according to a first embodiment of the present invention in the "standby" condition.
FIG. 7 is a view of the push rod and camming mechanism for actuating the rotary valve of the tool of FIG. 1.
FIG. 8 is a top view of the position detector associated with the push rod/camming mechanism shown in FIG. 7.
Figure 3:
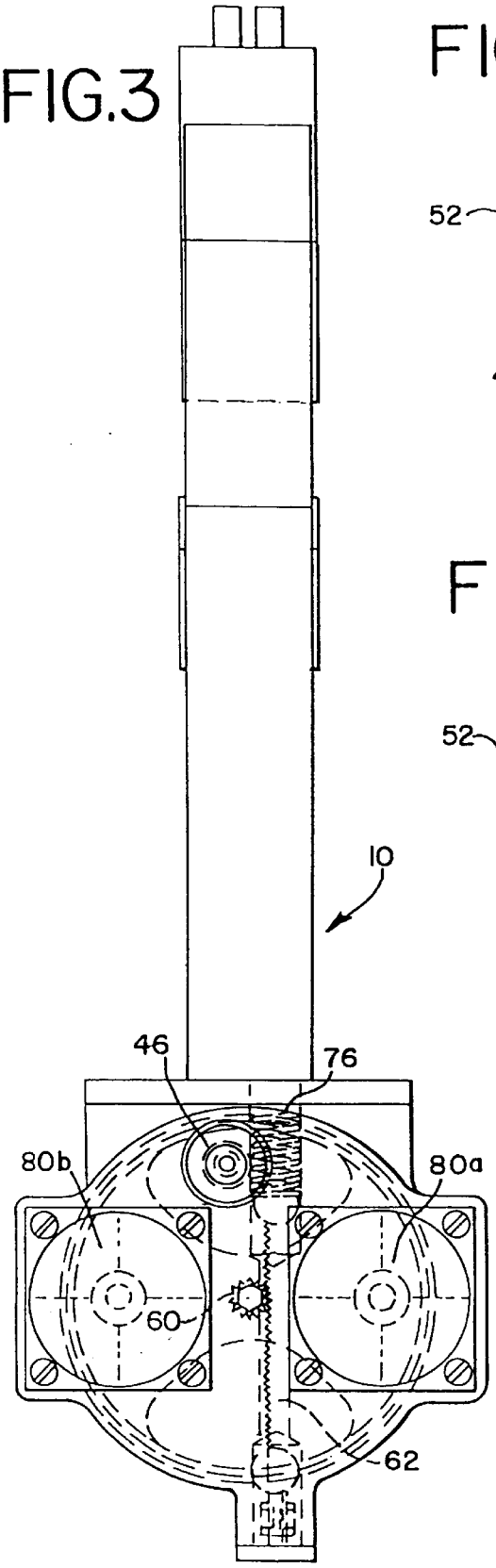
FIG. 3 is a top elevational view of the fastener driving tool of FIG. 1.

Referring to the drawings wherein like reference characters designate like parts throughout the several views, FIGS. 1, 2 and 3 show an internal combustion powered, self-contained tool in the form of a fastener driving tool, generally designated as 10, according to a first embodiment of the present invention. Although the present invention is described herein as embodied in a fastener driving tool, various aspects of the present invention may have application in other types of hand tools and gas-powered devices. To determine the scope of the present invention, reference should be made to the attached claims, and this description is intended for purposes of disclosure and illustration, and not for purposes of limitation.

The tool 10 includes a combustion chamber 12 which communicates with the bore of a cylinder 14, and a piston 16 which is reciprocally moveable within the bore. The cylinder 14 may be made of steel, aluminum, or any other suitable material of sufficient strength, hardness and heat resistance. The cylinder 14 is mounted between end cap 11 and head 13 (which contains the combustion chamber 12).

The head 13 also may be made of steel, aluminum or other material of sufficient strength and heat resistance. Preferably, for reasons described in more detail later, the head is made of a high strength dielectric material, such as plastic or ceramic, which permits a sparking device, such as a spark conductor to be molded directly into the wall of the combustion chamber. The combustion chamber 12 is preferably in the general shape of a bowl, with a bottom (formed by the top of the piston 16), side walls 12*a*, which may be cylindrical or slightly tapered, and a radiused transition 12*b* therebetween. The radiused transition 12*b* between the bottom and sidewalls 12*a* provides for better air flow in the combustion chamber 12 and promotes more complete scavenging of combustion products, as will be discussed in greater detail later.

The piston 16 is of standard construction, and also made of suitable high strength and heat resistant material. A pair of metal rings or resilient O-rings may be used to seal between the side of the piston and the surface of the cylinder bore. In the illustrated embodiment, the piston engages a driver blade 18 upon actuation of the tool so as to drive a fastener (not shown) which is fed into registration with the driver blade 18 by a magazine 20 at a guide plate 22 (best seen in FIG. 2). The fastener magazine and guide may be constructed in accordance with well known fastener driver magazines, such as that found in fastener drivers by Senco Products, Inc., model no. SFN40, for example, or shown in U.S. Pat. Nos. 4,721,240, incorporated by reference herein. The present invention is not directed to the magazine itself.

For uses other than fastener or staple driving, the piston 16 may be attached to or drive other devices, such as a gear drive to convert the linear motion of the piston into a rotary motion.

As shown in FIG. 1, the tool 10 is in the "standby" position, with the combustion chamber 12 sealed and the piston 16 and driver blade 18 in the top dead center position ready to engage a fastener and drive it into a workpiece (not shown). Associated with the piston 16 and driver blade 18 is a return spring 24, which returns the piston 16 and driver blade 18 to their standby positions after actuation of the tool 10. When fired, the piston 16 and driver blade 18 attain the position shown in FIG. 2. As seen in FIG. 2, a tapered rubber bumper 26 limits the downward movement of the piston 16 and also serves as a centering guide for the return spring 24. The upward return movement of the piston is limited by a lip 28 on the combustion chamber that overhangs the upper edge of the cylinder 14.

The tool 10 may include a rechargeable lead acid, nickel-cadmium, or other suitable battery pack 30 that powers the various control, metering, ignition, and scavenging subsystems of the tool. The battery pack 30 is operatively connected to the various subsystems and switches by a standard wiring harness (not shown). As shown, for example in FIG. 1, the battery pack 30 uses ten 1.2 volt batteries 32 to provide for a 12-volt system. However, different batteries or different numbers of batteries may be used to provide for other low voltage sources. Although the voltage selected may vary, it is preferably 12 volts or less, depending upon particular components used in the tool's subsystems. The fuel system for the tool 10 includes a fuel source, such as in the form of a detachable fuel canister 34. In the preferred embodiment, the fuel is liquified petroleum gas (propane) stored as a liquid at its vapor pressure. While propane ($C_3H_8$) has been used, other fuels having similar characteristics such as butane ($C_4H_{10}$) or commercially available MAPP gas could be used without departing from the present invention. An important characteristic for the fuel is that it is capable of being stored as a liquid and that it becomes a gas at atmospheric pressure and ordinary operating temperatures.

The fuel canister 34 is designed to meet Department of Transportation specifications for transportable LPG cylinders. The canister may be typically fabricated of steel and have about a 3-ounce capacity. The canister 34, as now contemplated, includes a standard tire-type valve 36 that opens as the canister 34 is screwed into its receptacle in the tool handle to admit fuel to the tool 10. The canister 34 also includes a combination relief and vent valve 38.

In the fuel canister 34, fuel is stored as a liquid at its vapor pressure. For propane at 70° F., this is 109.3 PSIG. Fuel from the canister 34 is introduced into the combustion chamber 12 of the tool 10 through a fuel flow passageway generally indicated by 40. The fuel expands into a gas as it leaves the canister 34 and travels along passageway portion 40*a* to a normally-closed latching solenoid valve 42. The latching solenoid valve 42 serves an important safety feature in that it precludes the flow of any fuel into the tool when the tool has not been fired for several minutes or when the power has been interrupted (such as by exhaustion of the batteries).

From the latching solenoid valve 42, the fuel travels through passageway portion 40*b* through a pressure regulator 44 which allows further expansion of the fuel to a desired metering pressure. The desired metering pressure may be set or selected on a one-time basis or may be variable, either manually or electronically, to adjust for operating conditions. For example, a metering pressure of 20 PSIG or less is preferred for propane fuel, with lower pressure being preferred for very low temperature operation.

Gaseous fuel travels along fuel flow passageway portion 40*c* to a metering solenoid valve 46 that delivers a precise amount of fuel to the combustion chamber 12 prior to ignition. In practice, the metering solenoid valve 46 may be a valve of the type manufactured by Angar Scientific, Inc. of Cedar Knolls, N.J., part no. AM2106 50 PSI 4494 6-V.

The open time for the metering valve is selected to provide the desired fuel-air ratio, which is preferably lean for high power uses such as driving nails and fasteners. The open time required may vary with the metering pressure, the valve orifice size, and the combustion chamber volume. For example, shorter time may be required to obtain the desired fuel-air ratio when a higher metering pressure and/or the larger valve orifice size and/or smaller combustion chamber volume is employed. In one test, conducted at normal room temperature, satisfactory combustion was achieved using propane fuel, the Angar Scientific metering valve 46 identified above, a metering fuel pressure of about 20 PSIG, and a combustion chamber having volume of between about 8 and 14 cubic inches, such as about 10 cubic inches, when the metering valve remained open for about 35 milliseconds. Because the valve 46 is held open for a fixed time interval, and the internal orifice of the valve 46 is fixed in size, a precise amount of fuel enters the combustion chamber each time it is actuated. A control circuit, described below, for the valve may also be responsive to the ambient temperature and/or atmospheric pressure to control the valve-open timing and therefore, the amount of fuel under varying conditions.

In keeping with one aspect of the present invention, an improved scavenging system is provided for an internal combustion tool. The scavenging system employs at least one fan 80 external to the combustion chamber 12 for removing combustion products from and for introducing fresh ambient air into the combustion chamber. Because the fan is external to the combustion chamber the air in the chamber is relatively quiescent, rather than turbulent as in, for example, the prior art Nikolich patent which uses a fan actually in the combustion chamber. Interposed between the fan and the combustion chamber is an intake and/or exhaust valve 48 which is normally open to circulate fresh air through the combustion chamber. When the valve is closed, the combustion chamber is sealed.

The intake and/or exhaust valve preferably comprises a rotary valve having two plates or disks 50 and 56 in face-to-face relationship. The plates include ports or apertures 54 that, when the valve is open, are aligned to permit scavenging of the combustion chamber by the fan.

Figure 5:
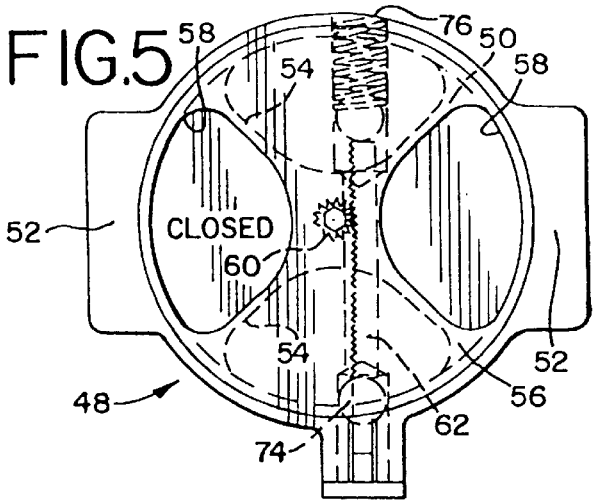
FIG. 5 is a top view of the rotary valve of FIG. 4 in which the valve is in its closed condition.
Figure 4:
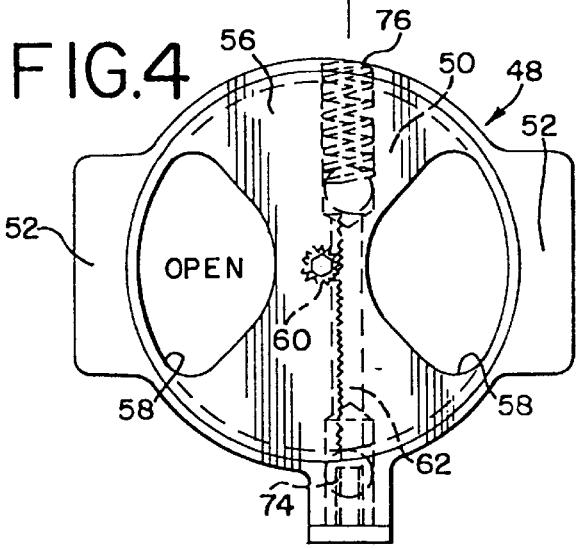
FIG. 4 is a top view of the rotary valve associated with the tool of FIG. 1 in which the valve is in its open condition.
Figure 6:
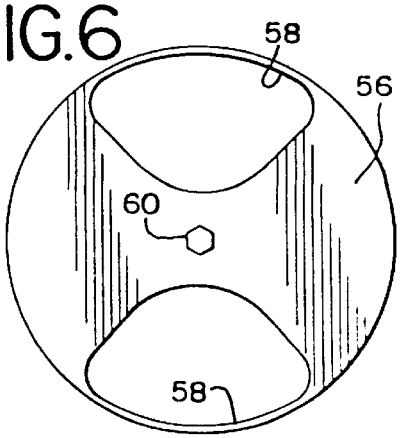
FIG. 6 is a plan view of one of the components of the rotary valve of the present invention.

Turning to FIGS. 4–6, there is seen a rotary exhaust valve, generally designated by 48, in accordance with the present invention. The rotary valve 48 includes a stationary plate or disk 50 having two ears 52 which permit the stationary plate 50 to be secured to the tool housing or head. The stationary plate 50 includes two substantially triangularly or pie-shaped apertures or ports 54 which are diametrically opposed. The apertures or ports are relatively large, each occupying approximately 20–25% of the surface of plate 50.

The rotary valve 48 includes a second plate or disk 56, best seen in FIG. 6, and shown in dotted lines in FIGS. 4 and 5. The plate 56 includes two apertures or ports 58 which are diametrically opposed and substantially the same size and shape as the ports 54 in the stationary plate 50. The plate 56 is mounted so that it is rotatable with respect to the stationary plate 50 between an "open" position, shown in FIG. 4, when the ports 58 in the plate 56 are aligned in a fully overlapping position with the ports 54 in the plate 50, and a "closed" position, shown in FIG. 5, when the ports 56 and 54 are completely out of alignment and there is no overlap between them. The configuration of the rotary valve results in exceptionally large inlet/exhaust ports with a very low pressure drop across the open ports. These large ports and low pressure drop facilitate highly efficient scavenging of exhaust gas through the open valve. This scavenging is further enhance by the smooth bowl shape of the combustion chamber 12.

In order to rotate the plate 56 between the open and closed position shown in FIGS. 4 and 5, the plate 56 includes a pinion gear 60 that is engaged by a gear rack 62. In one embodiment, the gear rack is actuated by a camming mechanism best seen in FIG. 1 and generally designated by 64. The camming mechanism comprises a camming surface 66 and a pushrod 68 including a return spring 70. The camming mechanism 64 is secured to the exterior of the tool housing by means of a guide 72, through which the pushrod 68 slides and which is engaged by the return spring. The pushrod 68 acts as a safety probe and is configured so that the pushrod 68 acts to provide a sensing of when the tool is pressed against the surface of the workpiece into which the fastener is to be driven. When the tool is pressed against the surface, the pushrod 68 is moved to the position shown in FIG. 1—the "standby" position—in which the rotary valve 48 is closed (FIG. 5). To attain this position, as the push rod moves upwardly when pressed against a work piece (e.g., wood), the camming surface 66 engages the gear rack 62 by acting on a rotatable steel ball 74. The gear rack 62 then is moved against the force of a return spring 76 to rotate the pinion gear 60, and consequently the plate 56, so that the rotary valve 48 is closed. When the tool is moved away from the surface of the workpiece, the return spring 70 moves the pushrod 68 to the position shown in FIG. 7, retracting the camming surface 66 and allowing the return spring 76 to move the gear rack 62, rotate the pinion gear 60, and rotate the second plate 56 so that its ports 58 are aligned with the ports 54 in the stationary plate 50 in the open position (FIG. 4). In this manner, the rotary valve is closed—closing the combustion chamber so that the tool can be fired—only when the tool is pressed against the workpiece into which the fastener is to be driven. As a further safety measure, the tool 10 may include an infrared emitter-detector 78 (FIGS. 1 and 8), positioned on the tool housing so that when the camming mechanism 64 has been actuated to close the rotary valve, the cam 66 breaks the beam of the infrared emitter-detector 78, sending a signal that permits the tool 10 to be fired. A mechanical switch also could be substituted for the infrared detector.

As an alternative to the mechanical cam 66, a commercially available rotary solenoid 79 (best seen in FIGS. 10–14) can be employed to move the rotary valve 48 between its open and closed positions. The rotary solenoid 79 includes a gear **79*a* whose teeth mesh with those on the rack gear 62. In this embodiment, the end of the pushrod 68 breaks the beam of the infrared emitter-detector 78 (rather than the camming surface 66 of the first embodiment) when the tool 10** is pressed against a workpiece to send a signal. That signal causes, through a control circuit, the solenoid to rotate and move the rack gear exhaust valve to a closed, sealed position. Release of the tool from the work piece allows the push rod to retract, opening the beam and causing a signal that results in turning of the solenoid to open the exhaust valve. Alternatively, instead of using a push rod, an infrared or other detector could be positioned at the nose of the tool to directly detect when the tool is pressed against a workpiece.

For reduced rotational friction between plates 50 and 56 of the rotary intake/exhaust valve, at least the facing surfaces of plates 56 and 50 have a reduced friction coating applied. This reduced friction coating may, for example, be a combination of anodizing and impregnating of low friction material such as polytetrafluoroethylene, more commonly known as Teflons material. Such a process is commercially known as Dura-Kote NF, and is available from Universal Metal Furnishing, Co. of Carol Stream, Ill.

When the rotary valve 48 is in its open position (FIG. 4), combusted fuel can be scavenged from the combustion chamber 12. To this end, the tool 10 preferably incorporates two fans **80*a* and 80*b*, one associated with each aperture 54 of the stationary plate 50 of the valve 48. Fan 80*a* is oriented so that it blows fresh ambient air into the combustion chamber, while the other fan 80*b* pulls gas out of the combustion chamber. In practice, the fans 80*a*, 80*b* may be Panasonic FBK-04F12U (for a 12-volt system) or FBK-0405H (for a 6-volt system) fans, or other suitable fans from other suppliers. While two fans may provide faster scavenging for fast repeat cycling, a single fan will also work because of the large size of the openings in the rotary valve. Use of a single fan may result in the need for more time between successive firings of the tool. However, the use of a single fan will extend the battery life. Because of the large diametrically opposed apertures or openings in the rotary valve and radiused transition portion 12*b*, even a single fan will provide a large and efficient flow of air through the combustion chamber, following a generally U-shaped path that passes across the top surface of piston 16**, to remove combustion products and introduce fresh ambient air.

Although not as efficient, a single fan in combination with single large port or aperture in the rotary exhaust/intake valve may also provide sufficient scavenging and fresh air introduction for certain applications. This could be, for example, (1) a single fan which causes both intake and exhaust through a single port or aperture in the rotary valve such as by blowing intake air through the center of a port or aperture, with exhaust gas flowing in an opposite direction through an annular portion of the port or aperture or (2) a single fan associated with a single port or aperture in the rotary valve for creating a flow of air between that port or aperture and another port or aperture located elsewhere in the tool. In addition, filter screens may be provided over each fan, particularly any fan blowing into the combustion chamber, to filter out ambient dust or contaminants.

In keeping with a further aspect of the invention, the tool 10 is provided with an ignition system that promotes reliable and complete combustion, particularly when used in conjunction with lean fuel-to-air mixtures. The ignition system includes a voltage source, such as an ignition coil, for generating the electrical pulse and a spark ring of conductive material disposed within the combustion chamber and having a plurality of spark gaps.

Turning to FIG. 1, there is seen a voltage source in the form of an ignition coil 82 which generates the electrical pulse needed for the ignition system. The combustion chamber 12 includes a spark ring 83 (FIG. 9) having a plurality of spark gaps, such as the illustrated series of four spark gaps 84 disposed within the combustion chamber 12. The spark gaps 84 are formed by spaced conductors connected in series to the ignition coil 82 by a conducting element 85, with the ignition coil 82 being actuated by a trigger switch 86. As best seen in FIG. 9, the spark gaps 84 are arranged in a co-planar fashion equidistantly about the cylindrical periphery of the combustion chamber 12. The resulting wide separation of the spark gaps within the combustion chamber enhances the likelihood of ignition of the fuel. In practice, the spark gaps 84 may be formed of copper or other conductive material such as steel wire molded into the high dielectric plastic or ceramic material used to form the combustion chamber 12, with the gaps being in the range of about 0.025 to 0.050 inches. Close proximity of the spark gaps 84 to the chamber wall is understood to inhibit ignition even when all other conditions are favorable. Consequently, each spark gap 84 preferably is spaced from the interior surface of the combustion chamber 12 to better ensure consistent ignition. Applicants have determined that a spacing of about ⅜ inch or more from the interior surface of the combustion chamber wall 12*a* provides for generally reliable ignition of propane, by even a single spark source. The minimum and optimum spacing have not been precisely determined at this time, and may vary depending on the spark source, type of fuel and operating conditions. A multiple spark source such as shown in FIG. 9 may, for example, provide reliable ignitions closer to the wall surface, such as from about ⅛ to ⅜ inches or more.

Because the spark gaps 84 are arranged in a series, each pulse of the ignition coil 82 causes four technically sequential but substantially simultaneous sparks to occur, resulting in four opportunities for ignition to occur. The ignition coil could also be pulsed several times in quick succession to create even further opportunities for ignition during each combustion cycle. While the preferred embodiment has been shown with four spark gaps, more could be utilized providing for even greater possibilities of ignition, or fewer could be utilized to reduce the voltage required to produce sparking while still enhancing ignition as compared to a single spark source.

Figure 10:
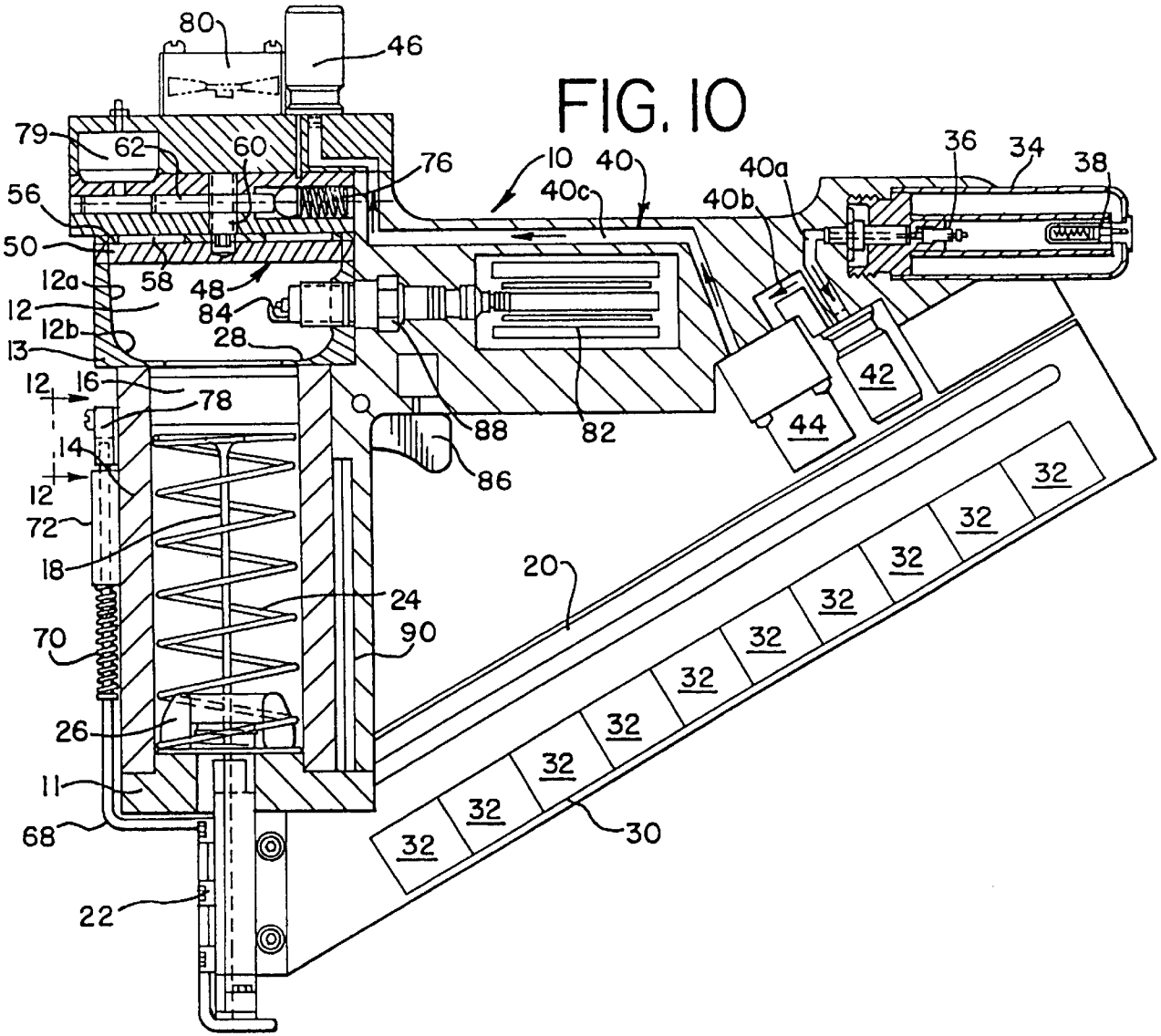
FIG. 10 is a side, elevational view in partial cross-section of a fastener driving tool that is an alternate embodiment of the present invention.
Figure 11:
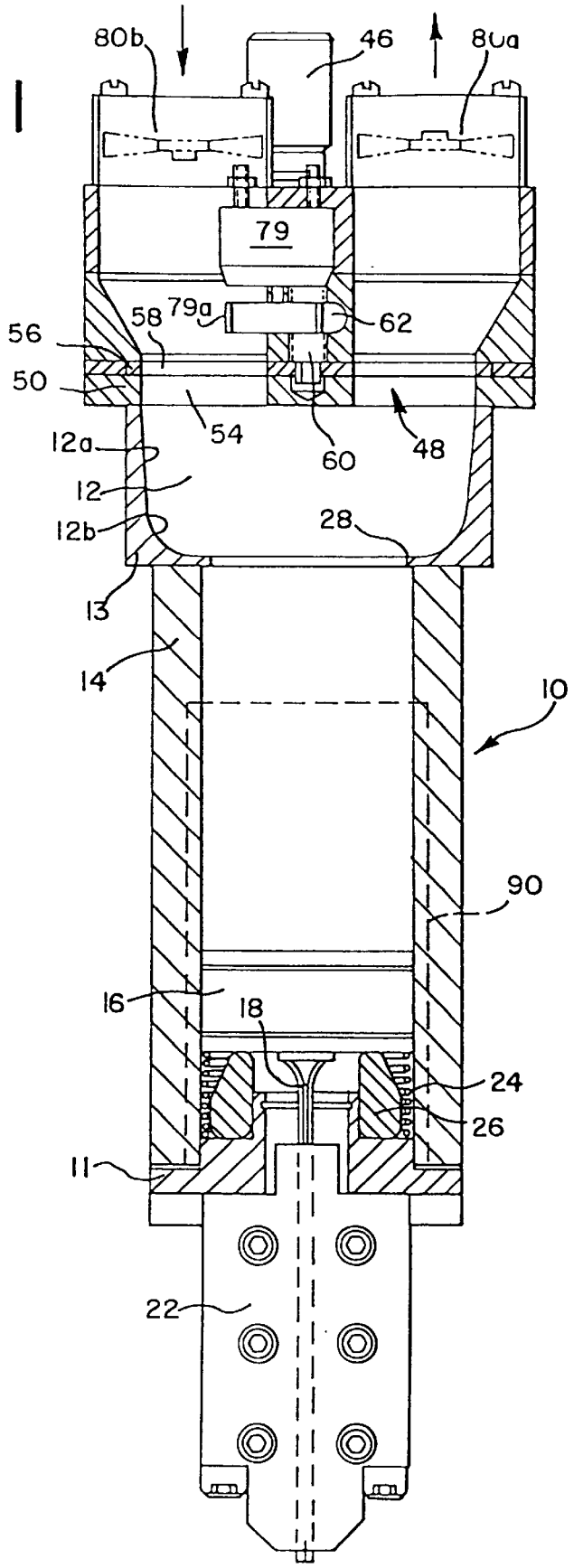
FIG. 11 is a front elevational view in partial cross-section of the fastener driving tool of FIG. 10.
Figure 12:
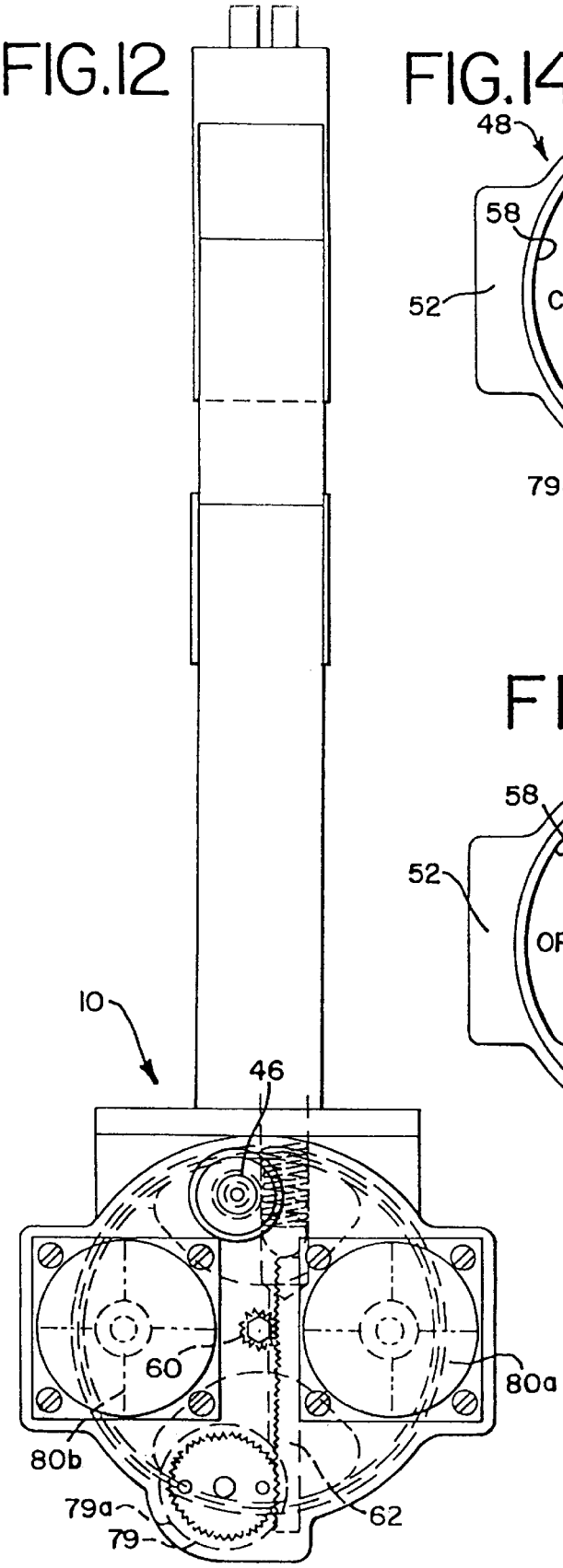
FIG. 12 is a top elevational view of the fastener driving tool of FIG. 10.
Figure 14:
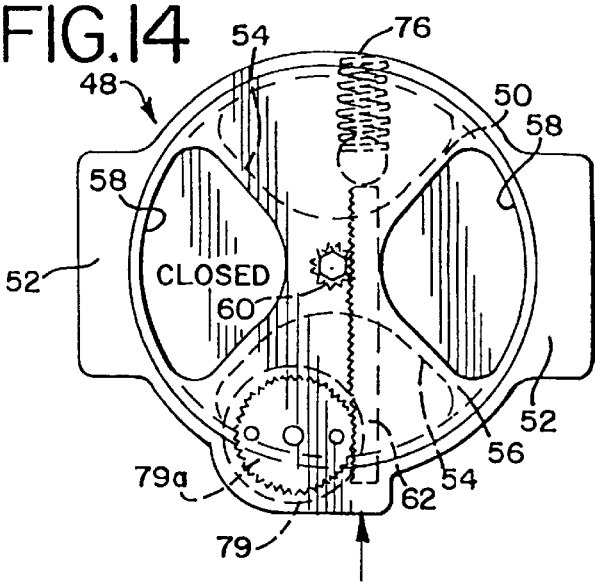
FIG. 14 is a top view of the rotary valve of FIG. 13 in which the valve is in its closed position.
Figure 13:
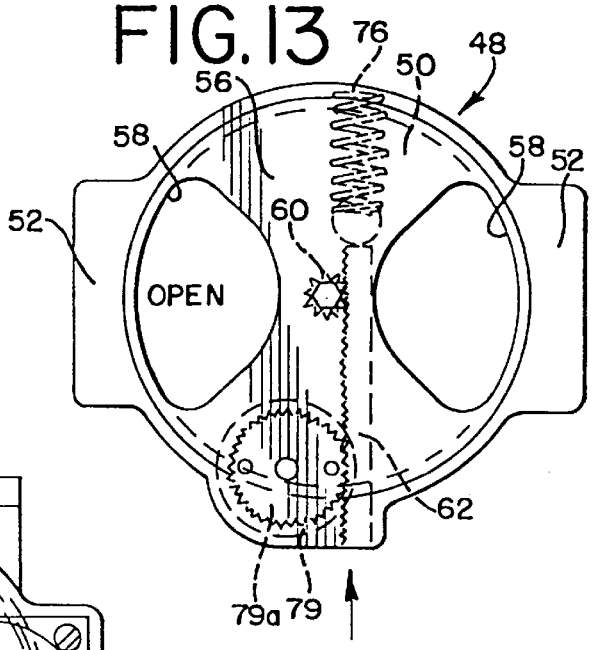
FIG. 13 is a top view of the rotary valve associated with the fastener driving tool of FIG. 10 wherein the valve is in its open position.

In an alternate embodiment, shown in FIG. 10, a conventional spark plug 88, such as an automotive spark plug, can be used in place of the spark ring 83. As illustrated, the tip of the spark plug 88 is connected directly to the ignition coil 82 and is positioned so that the gap of the spark plug 88 is spaced from the wall of the combustion chamber 12 as described above. If a conventional spark plug is used, multiple voltage pulses from the ignition coil 82 for each combustion cycle may be used to provide for multiple opportunities for ignition.

The following summarizes the operation of the tool 10 thus far described. Assuming the combustion chamber 12 has been scavenged of spent gases from the previous cycle and the magazine 20 has positioned a fastener under the driver blade 18, the operator presses the pushrod/safety probe 68 against the workpiece to cause the camming surface 66 to actuate the gear rack 62 and pinion gear 60 to close the rotary valve 48, thus trapping a volume of fresh air within the combustion chamber 12. When the beam of the infrared emitter-detector 78 is broken, the solenoid metering valve 46 is briefly opened to admit a predetermined quantity of fuel vapor into the combustion chamber 12. When the operator is ready to drive the fastener, the ignition coil 82 is actuated by squeezing the trigger switch 86 to initiate a series of rapidly sequenced high voltage sparks across the spark gaps 84 in the spark ring 83. The fuel ignites, forcing the piston 16 downward and driving the fastener. The force of expanding gases and inertia carries the piston 16 to the bottom of its stroke, where it collides with the rubber bumper 26. Then the return spring 24 moves the piston back to the top of its stroke, allowing the spring-loaded magazine 20 to position a new fastener under the driver blade 18. When the operator lifts the tool 10 away from the workpiece, the rotary valve 48 opens and the fans 80*a* and 80*b* start, allowing fresh ambient air to rapidly enter the chamber and the spent gases to be removed therefrom. If a new cycle is not initiated immediately, the fans 80*a*, 80*b* run for a few seconds and then stop. The rotary valve 48 remains open until the next cycle is initiated.

To provide correct sequencing and timing of the afore-described operation of the tool, e.g., the length of time the metering valve is left open, the generation of the spark for ignition, and the scavenging of combustion byproducts from the combustion chamber, a control circuit is provided that controls the operation of the tool, specifically the admission of fuel to the combustion chamber, generation of the ignition spark, rotation of the exhaust valve (in the solenoid-controlled version), and operation of the fans.

In one embodiment, the control circuit is comprised of a digital logic integrated circuit with spark, fuel and fan control phases, shown generally as part of the tool at 90. This circuit may be a separate hard-wired circuit, either conventional or integrated, or part of a programmable microprocessor that achieves the same function. Turning more specifically to FIGS. 19–22, there is shown a digital logic integrated circuit with ignition, fueling and fan control phases, which comprise the control system 90.

In the operation of the control circuit, a circuit cycle includes the process of injecting fuel into the combustion chamber 12 (fueling phase) and generating an electrical spark for ignition of the air-fuel mixture inside the combustion chamber 12 (ignition phase). Each cycle is initiated with the activation of a triggering device (not the trigger 86). The triggering device can be, for example, a mechanical switch, e.g., a single-pole double-throw (SPDT) limit switch, followed by a switch debouncing stage, or an opto-electronic switch, which may comprise an infrared emitter-detector pair 78 activated by an interrupter 66 and/or a reflective photo-switch, followed by an electronic signal conditioning stage. Regardless of the type of triggering device employed, the actual triggering is preferably initiated by, for example, a mechanical attachment to the actuating linkage for the rotary valve 48 or electronic input from the circuit controlling movement of rotary solenoid 79, so that a circuit cycle can only occur when the rotary valve 48 is fully closed.

Figure 15:
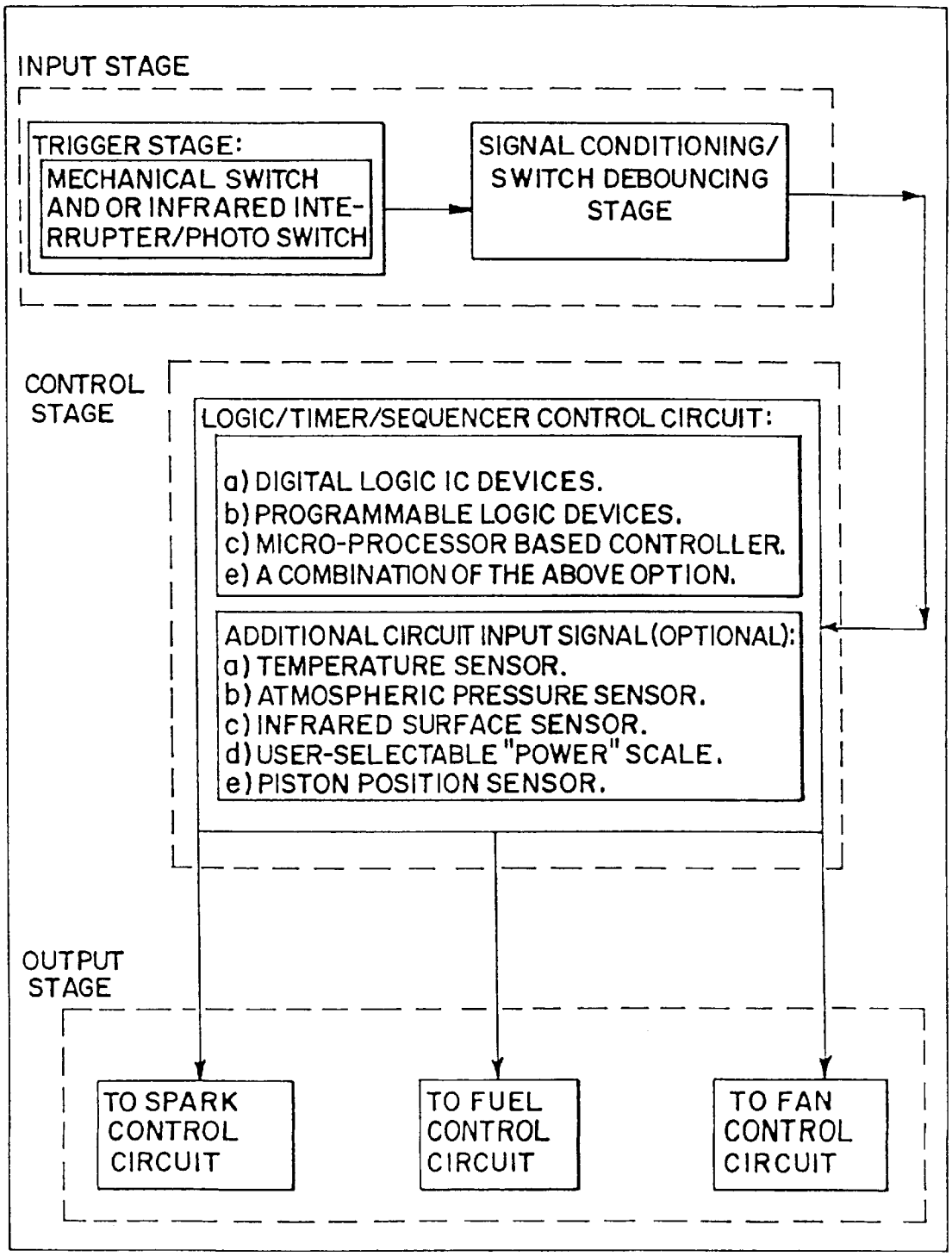
FIG. 15 is a block diagram of various stages of a control circuit for the tool of FIGS. 1 and 10.

The actual control stage of the circuit can be comprised of a digital logic integrated circuit (IC) design, programmable logic devices, a microprocessor based controller, or a combination of the previous options. As shown in FIG. 15, the same Input and Output Stages can be utilized with any design. The Input Stage may also contain fuel pressure as well as atmospheric temperature and pressure sensors to optimize the air-to-fuel ratio of the tool's combustion chamber at various ambient conditions. Additionally, the Input Stage may include a piston position sensor, a user selectable "power" scale and/or an infrared surface sensor. The infrared surface sensor being responsive to the temperature of the workpiece to prevent firing of the tool into a human body.

In one embodiment of the invention, the control circuit is comprised of a digital logic IC circuit. As shown in FIG. 19, the digital logic IC circuit is comprised of sequential fueling and ignition phases, as well as a parallel fan control phase. From FIG. 19, it can be seen that the first circuit branching occurs at junction A. Here, the logic-high signal, produced when the triggering device (mechanical or opto-electrical) is activated, is used in parallel by the fan control circuit (FIGS. 18 and 22) to turn on the fan motors and initiate their automatic time-out feature, and by the fuel control and spark control circuits (FIGS. 17 and 21, and 16 and 20) to initiate the fueling and ignition phase sequences, respectively.

The operation of the fueling and ignition phase sequences of the digital logic IC circuit will now be described with reference to FIG. 19. The logic-high signal at junction A passes through hex inverter buffers 100–107, which are used to generate time delays. These time delays depend on the "propagation delays" of the actual IC components used and are typically in the order of 25–35 nano-seconds per component. Hex inverter 100 turns off the "reset" signal to decade counters 110 and 112. Hex inverter 102 turns off the "set" signal to D flip-flops 114 and 116. Since the D and CLK inputs of flip-flops 114 and 116 remain at logic-zero, the respective outputs, Q1 and Q2, remain at a logic-high state. Q2 is applied as an input to AND gates 120 and 122, and Q2 is applied as an input to AND gate 126.

Hex inverters 103–07 create a time delay to allow decade counters 110 and 112 and flip-flops 114 and 116 to be properly initiated before activating the fueling stage. After this time delay, a logic-high signal is applied from hex inverter 107 simultaneously to AND gates 120 and 122. AND gate 120 is connected to the enable input of decade counter 110, which begins counting cycles from clock 132. The logic-high signal from AND gate 122 is fed to the fuel control circuit to begin injecting fuel into the tool's combustion chamber, the operation of which will be described later.

When decade counter 110 reaches the decimal number selected by count selector switch 136, a logic-high signal is fed to the "reset" input of D flip-flop 114, which changes the state of Q1 to logic-zero. When this occurs, AND gate 122 generates a logic-zero which is fed to the fuel control circuit to terminate the fueling phase. Decade counter 110 is also disabled at this time through AND gate 120. Thus, the amount of fuel to be injected can be varied by choosing a different decimal number at count selector switch 136.

In an alternate embodiment the amount of fuel to be injected is controlled by the fuel and atmospheric temperature and pressure sensors to optimize the air-to-fuel ratio to various ambient conditions. If the control stage of the circuit consists of a software-controlled microprocessor design, the signals from the various sensors are input to the microprocessor, which in turn may select a decimal number at the count selector switch 136 corresponding to the optimum air-to-fuel ratio for the given ambient conditions. Other approaches for achieving an optimum air-to-fuel ratio may also be used.

If a digital logic IC design is used for the control stage, the signals from the various sensors can be input to the count selector switch 136 through a sensor circuit (not shown). The sensor circuit being responsive to the signals from the various sensors and selecting a decimal number at the count selector switch 136 corresponding to the optimum air-to-fuel ratio for the given ambient conditions.

When the fueling phase is completed (logic-zero at AND gate 122), hex inverter buffers 140–48 create a time delay before starting the ignition phase. As previously noted, this time delay depends on the "propagation delays" of the actual IC components used and are typically in the order of 25–35 nano-seconds per component. Hex inverter 148 outputs a logic-high which is fed as an input along with the output of hex inverter 107 to AND gate 124. The logic-high signal generated by AND gate 124 is applied to AND gate 126, with the other input being signal Q2 from D flip-flop 116 (which is also at a logic-high). AND gate 126 enables decade counter 112 to start counting cycles from clock 134, and is also fed as an input to AND gate 128. The output of decade counter 112, specifically decimal numbers 1, 3, 5 and 7, are fed into OR gate 130, the output of which is the other input of AND gate 128. This configuration generates a square waveform at the output of AND gate 128 consisting of four periods. This square waveform is used by the spark control circuit to generate multiple sparks at the sparking device. At the fifth period, the logic-high generated at decimal number 9 of decade counter 112 is applied to the "reset" input of D flip-flop 116, which changes the output Q2 to a logic-zero. This disables decade counter 112 to prohibit further spark generation, thus completing the ignition phase.

It should be noted that if the triggering device is manually released during the execution of either the fueling or ignition phases, that phase is immediately terminated and the entire cycle is aborted. The only exception is the fan control circuit, which continues running until its internal time-out feature automatically turns off the motor.

Further, the above-described digital logic IC circuit can be replaced with a software-controlled microprocessor circuit, which can utilize the same Input and Output Stages of the digital logic circuit. The microprocessor circuit offers increased flexibility by virtue of being controlled by software. For example, in addition to executing the fueling, ignition and fan control phases, the software can also be used to implement ambient temperature and atmospheric and fuel pressure sensors to automatically fine-tune the air-to-fuel ratio to the given ambient conditions, thus improving combustion.

Although not depicted in the drawings, the control circuit may include means for controlling latching solenoid valve 42. As previously described, latching solenoid valve 42 is a normally closed valve and serves an important safety feature of preventing fuel from leaking into the tool when the tool has not been fired for several minutes or when the power has been interrupted (such as by exhaustion of the batteries).

If the control circuit is comprised of a digital logic IC circuit, a means for controlling latching solenoid valve 42 may include, but is not limited to, circuit means for generating and/or applying a voltage to open the normally closed valve and allow fuel to flow into the tool. The circuit means would be responsive to the closure of the rotary intake and/or exhaust valve or to the activation of the triggering device (mechanical or opto-electrical) to open latching solenoid valve 42 a predetermined amount of time before the fuel control circuit opens solenoid metering valve 46. As a safety feature, the circuit means would also include an automatic time-out feature designed to de-energize and close latching solenoid valve 42 after a specified period of nonuse of the tool or when power has been interrupted.

If the control circuit is comprised of a software-controlled microprocessor circuit, the software can be implemented to control latching solenoid valve 42 in accordance with the characteristics described above.

Figure 16:
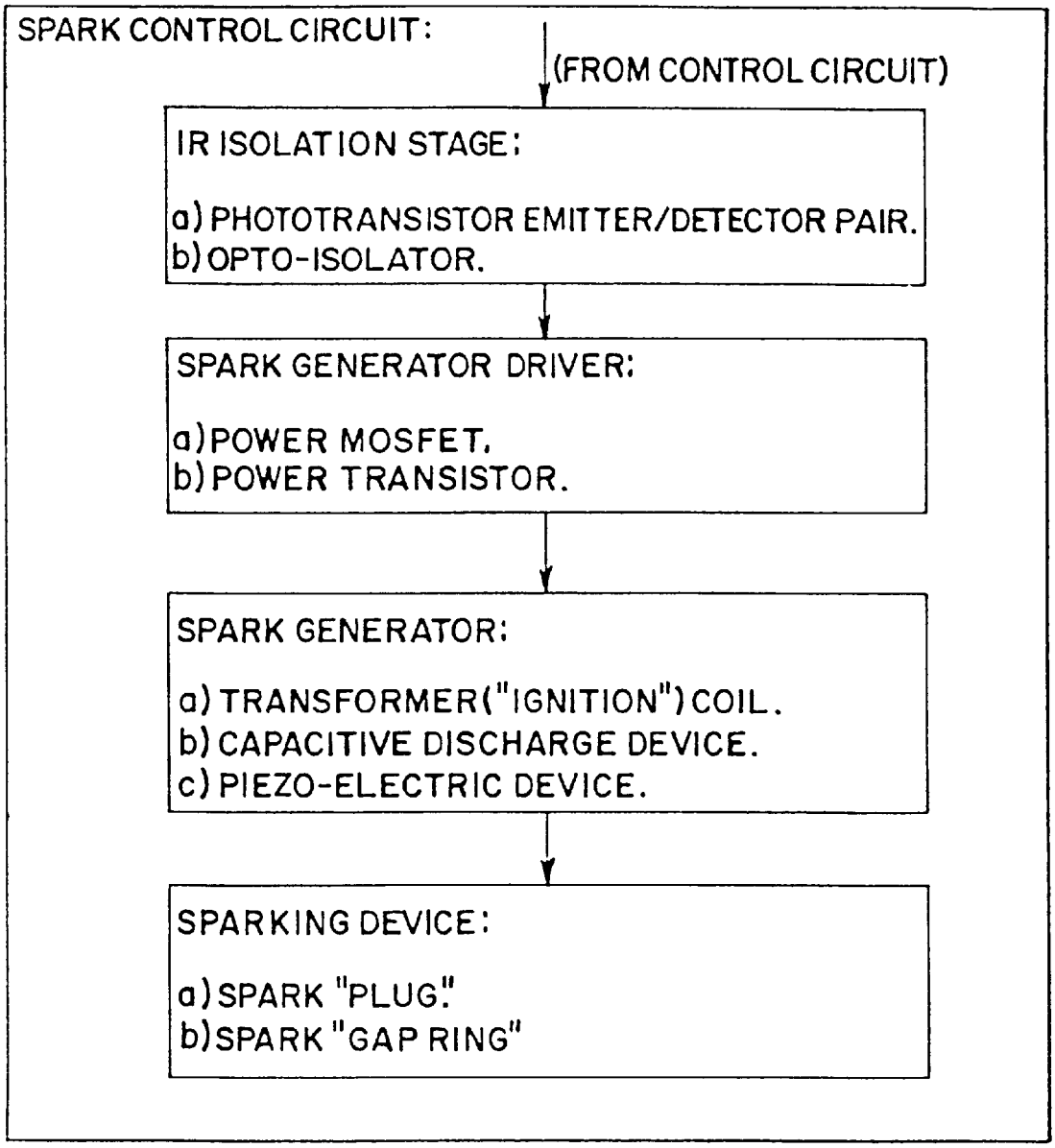
FIG. 16 is a block diagram of a spark control portion of the control circuit.

As can be seen from the block diagram in FIG. 16, the spark control circuit may comprise an IR isolation stage, a spark generator driver, a spark generator and a sparking device. Those skilled in the art will recognize the variations set forth in FIG. 16, which could be implemented to the spark control circuit.

Figure 20:
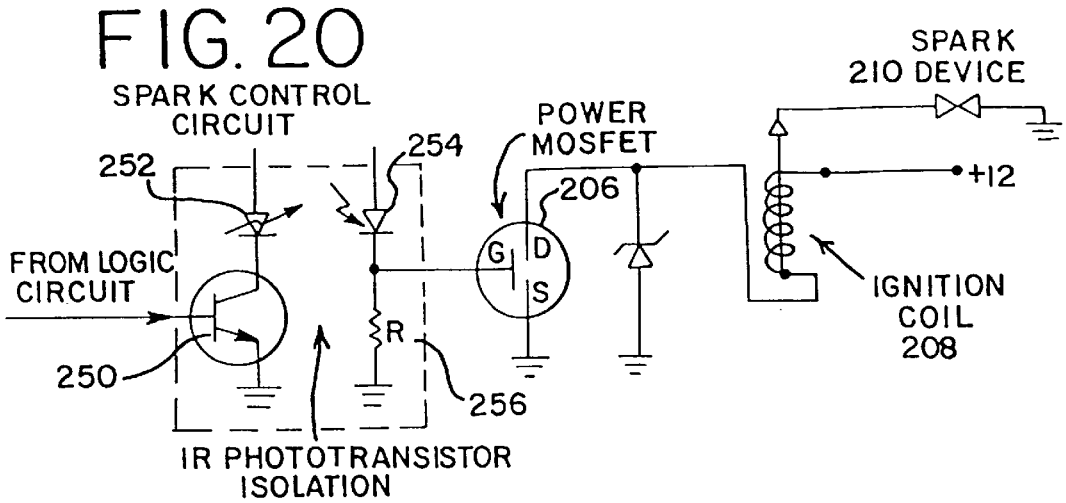
FIG. 20 is a circuit diagram of a spark control circuit for the control circuit of the present invention.

FIG. 20 depicts a circuit diagram of one variation of the spark control circuit. The basic operation of this variation of the spark control circuit is as follows. The output from the digital logic IC circuit is input to the gate of transistor 250. Thus, a logic-high from the digital logic IC circuit turns on transistor 250, which in turn allows a voltage source (not shown) to generate a voltage across emitter diode 252. The infrared light emitted from emitter diode 252 generates a voltage across detector diode 254. The cathode terminal of detector diode 254 is connected to the gate of power MOSFET 206 and also to a limiting resistor 256. The voltage generated across detector diode 254 turns on power MOSFET 206. When power MOSFET 206 is turned on, ignition coil 208 becomes charged and generates a spark at spark device 210.

Figure 17:
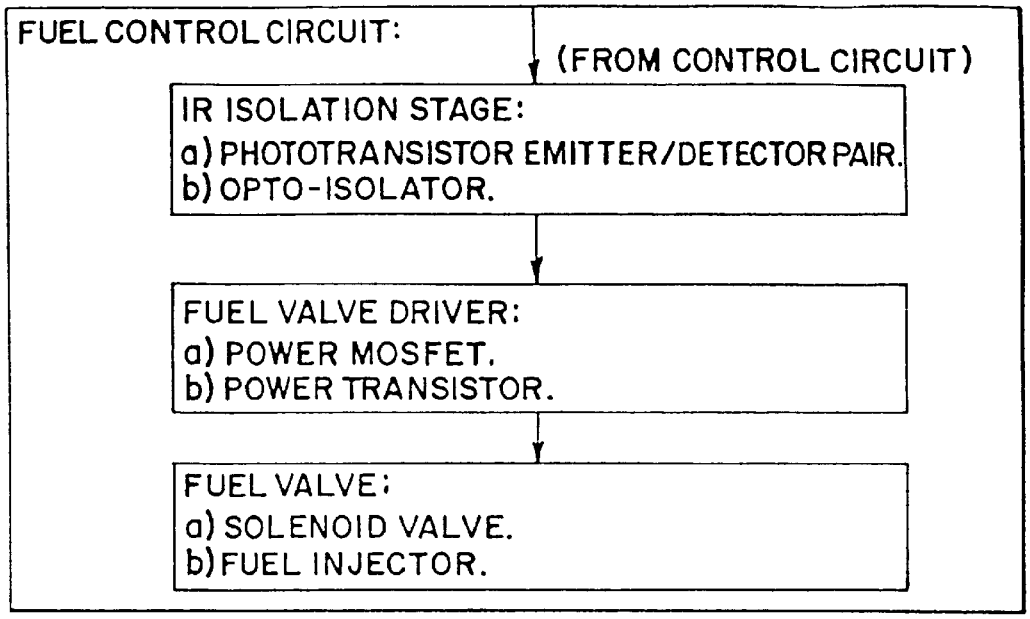
FIG. 17 is a block diagram of a fuel portion of the control circuit.

Referring now to the block diagram in FIG. 17, the fuel control circuit is essentially comprised of an IR isolation stage, a fuel valve driver and a fuel valve. Those skilled in the art will recognize the variations set forth in FIG. 17, which could be implemented to the fuel control circuit.

Figure 21:
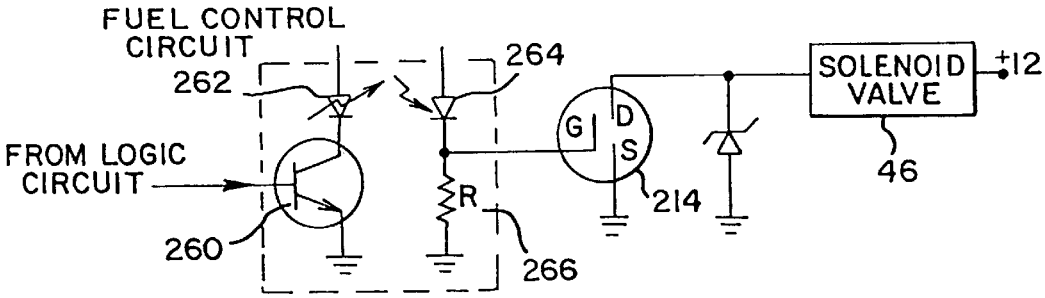
FIG. 21 is a circuit diagram of a fuel control circuit for the control circuit of the present invention.

FIG. 21 depicts a circuit diagram of one variation of the fuel control circuit. The basic operation of this variation of the fuel control circuit is similar to the spark control circuit described above. A logic-high from the digital logic IC circuit turns on transistor 260, which in turn allows a voltage source (not shown) to generate a voltage across emitter diode 262. The infrared light emitted from emitter diode 262 generates a voltage across detector diode 264. The cathode terminal of detector diode 264 is connected to the gate of power MOSFET 214 and also to a limiting resistor 266. The voltage generated across detector diode 264 turns on power MOSFET 214. When power MOSFET 214 is turned on, solenoid valve 46 opens and allows fuel to flow into the combustion chamber.

Figure 18:
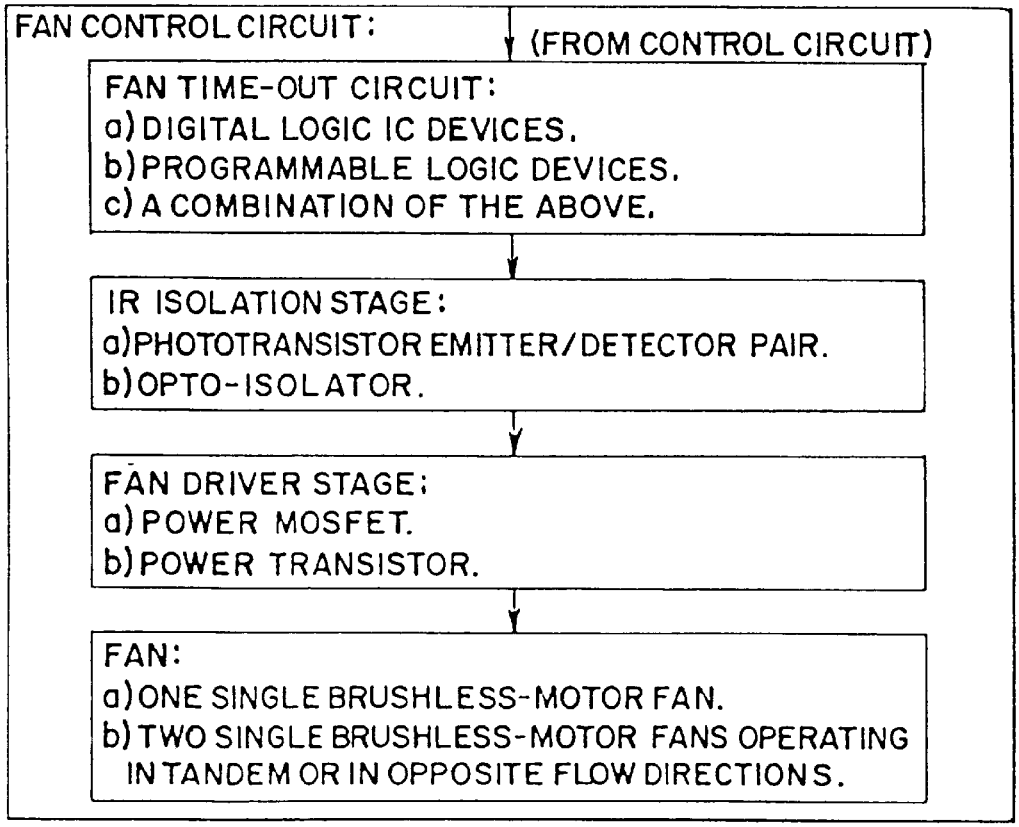
FIG. 18 is a block diagram of a fan control portion of the control circuit.
Figure 19:
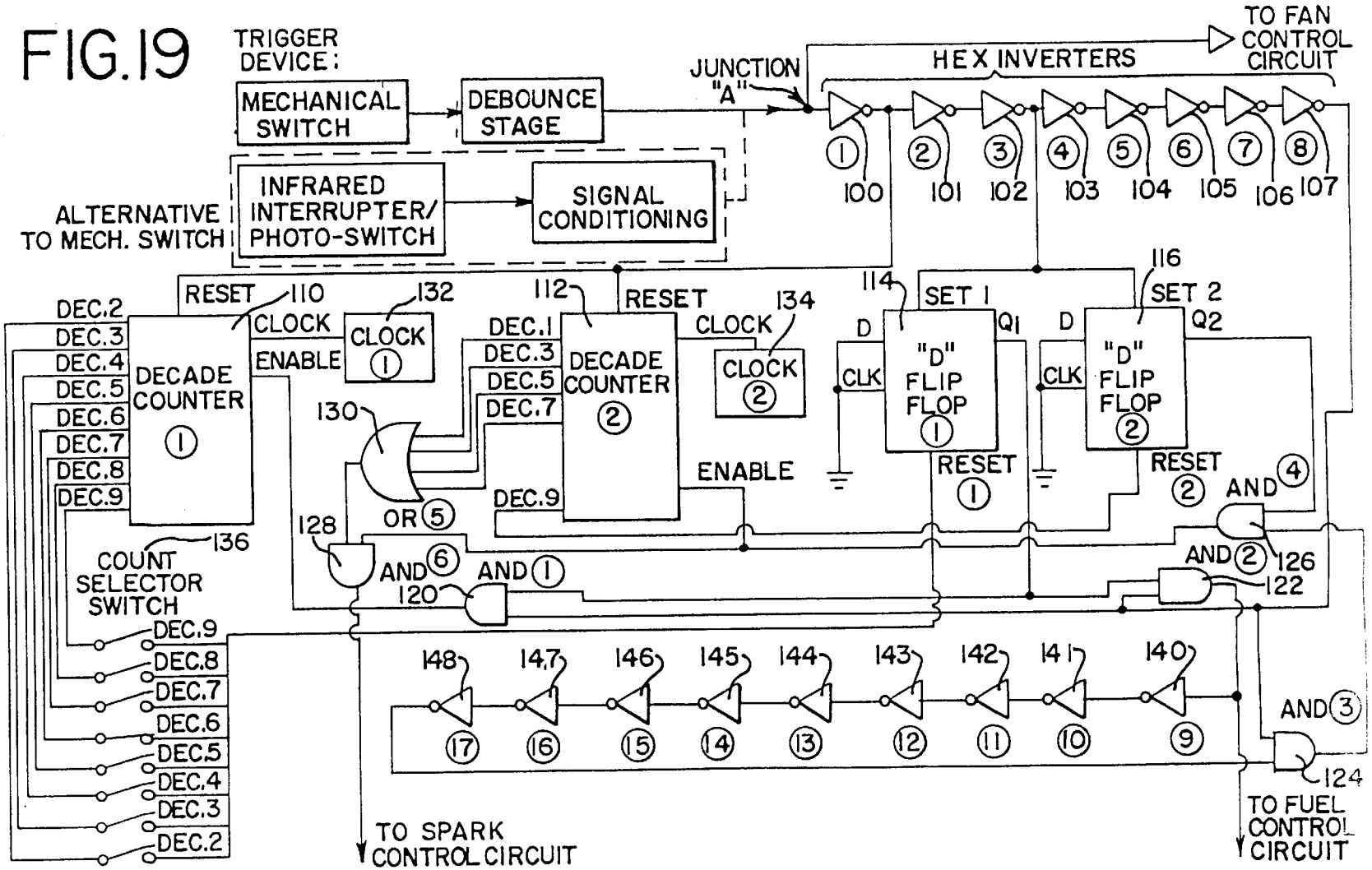
FIG. 19 is a circuit diagram of a digital logic IC circuit for the control circuit of the present invention.

FIG. 18 is a block diagram of the fan control circuit, which is essentially comprised of a fan time-out circuit, an IR isolation stage, a fan driver stage and a fan. Those skilled in the art will recognize the variations set forth in FIG. 18, which could be implemented to the fan control circuit.

Figure 22:
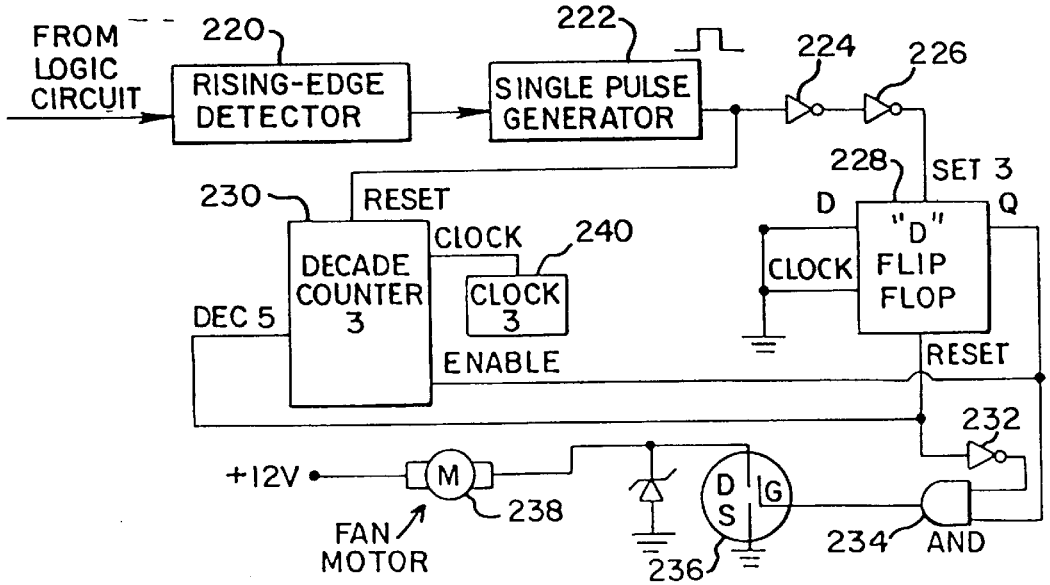
FIG. 22 is a circuit diagram of a fan control circuit for the control circuit of the present invention.

FIG. 22 depicts a circuit diagram of one variation of the fan control circuit. The operation of this variation of the fan control circuit is as follows. A logic-high from the digital logic IC circuit activates rising edge detector 220, which in turn activates single pulse generator 222. Single pulse generator 222 produces an output pulse of a specified width that is independent of the input frequency. This allows the fan control circuit to operate regardless of whether the triggering device is manually released. The logic-high signal output from single pulse generator 222 passes through hex inverters 224 and 226 and is applied to the "set" input of D flip-flop 228, which sets its output Q at logic-high. The logic-high from single pulse generator 222 is also applied to the "reset" input of decade counter 230, which causes its output at decimal number 5 to be logic-zero. Decimal number 5 passes through hex inverter 232 and is input to AND gate 234 along with signal Q from D flip-flop 228. A logic-high is then produced at the output of AND gate 234, which turns on power MOSFET 236. This turns on fan motor 238, which remains on until the automatic time-out feature of the fan control circuit is initiated. This feature is described below.

After a specified period of time, the output of single pulse generator 222 returns to its quiescent state (logic-zero). This turns off the "reset" signal of decade counter 230. Since its enable input has been previously set at logic-high from signal Q of D flip-flop 228, turning off its reset signal enables decade counter 230 to start counting cycles from clock 240. When decade counter 230 reaches decimal number 5, its respective logic-high signal both resets D flip-flop 228 and causes a logic-zero to be output from AND gate 234, thus turning off the fan motor 238. It should be noted that the running time of the fan motor 238 can be varied simply by using a different decimal count of decade counter 230. Once D flip-flop 228 is reset, a logic-zero is produced at its output Q, which disables decade counter 230 and also keeps the fan motor 238 turned off until another low-to-high transition is detected from the digital logic IC circuit.

Figure 23:
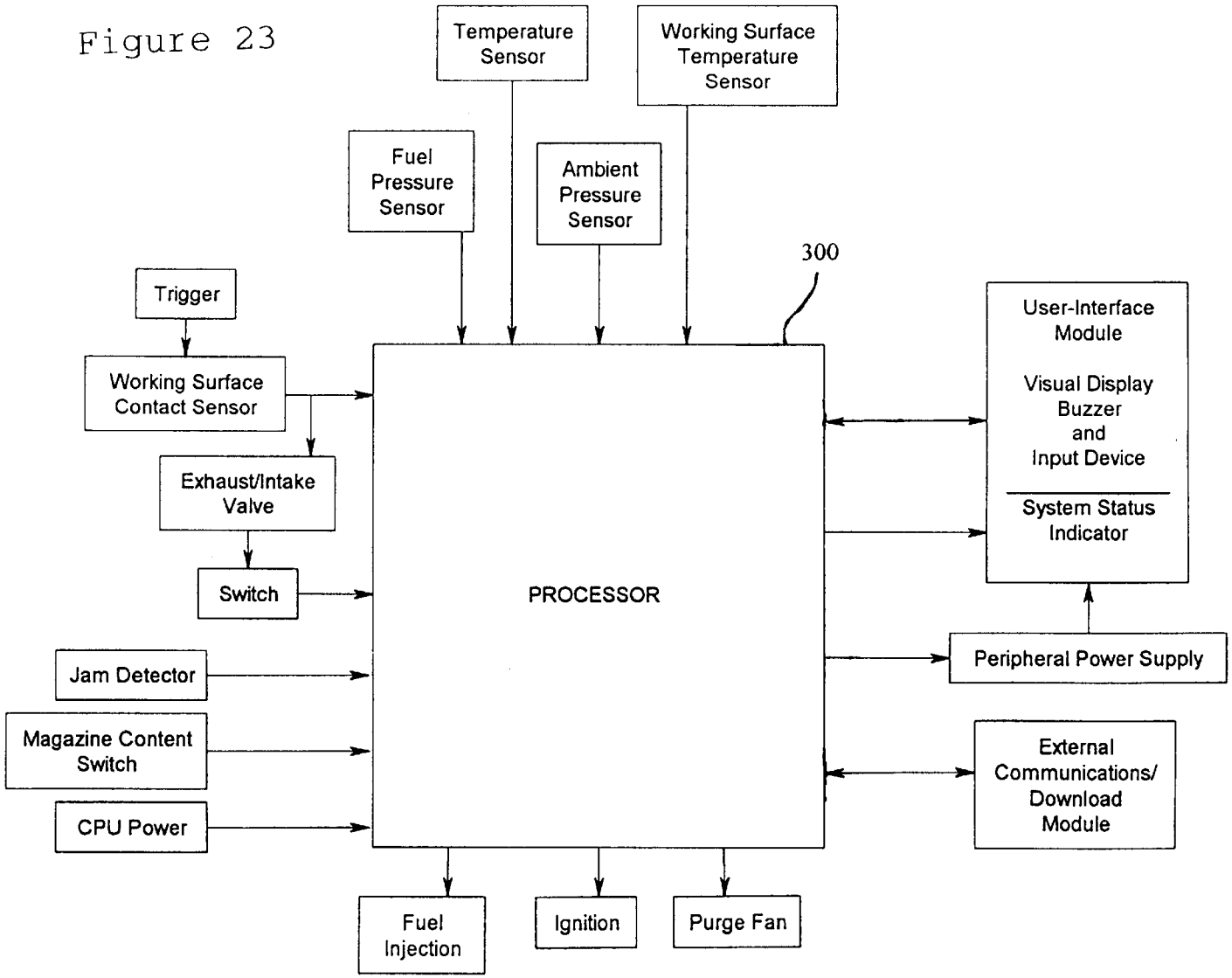
FIG. 23 is a block diagram illustration of several components of a microprocessor-controlled embodiment of the present invention.

Although the present invention may employ a control system as described above, an alternate embodiment for a control system, shown in general in FIG. 23, includes a microprocessor 300 for receiving input signals and providing output signals. The microprocessor controls all operations in response to signals received and predetermined operating parameters. The input signals are provided by a variety of condition, safety, and user related sensors or inputs. The output signals are provided by the microprocessor to control functions of the fastener driver tool such as ignition, fuel control, safety interlocks, user interface, and the like, as discussed in more detail below.

The microprocessor 300 of the present embodiment preferably includes programmable memory and is programmed to control several aspects of a fastener driving tool. Having a software-based control system provides several advantages. A software-based control system is smaller and lighter than a hardware-based control system, which is of particular significance in the field of hand-held tools. Another advantage of having a programmable microprocessor is the ability to easily change the operation of the control system. The functionality of the control system may be increased by simply adding programming code to microprocessor memory by programming the system directly or interfacing the system with an external processing device, such as a laptop computer, and without having to make other changes to or add components to the control system. Another advantage of a microprocessor-based control system is that operational parameters may be determined without (or with) the assistance of the operator to achieve optimal performance.

The microprocessor 300 also preferably includes an analog-to-digital (a/d) converter. An a/d converter may receive analog signals from sensors that detect conditions such as temperature or pressure. The a/d converter converts the analog signals to digital signals for use by the microprocessor. Incorporating a microprocessor that includes an a/d converter that communicates internally with the CPU simplifies construction of the control system and may reduce manufacturing cost.

The microprocessor also preferably includes an electrically erasable programmable read-only memory (EEPROM)

and ultraviolet light erasable programmable read-only memory (EPROM). The EPROM is more suitable for storage of invariable information, such as a computer program, while the EEPROM is more suitable for variable information, like performance variables and other parameters, discussed below. It is contemplated that one or both of the EEPROM and EPROM may be used for the particular application. However, a microprocessor that has only EEPROM or EEPROM and EPROM is particularly suitable for the preferred embodiment because variable information may be stored in a limited amount of EEPROM, and preserved even if power is turned off. In an embodiment that has only EPROM, variable information may be stored in random-access memory (RAM), for use by the microprocessor while power is on.

The control system memory device may retain operational data processed from input signals and may also be programmed with data from an external memory device or unit. For example, the microprocessor may temporarily and periodically record the status of the fastener driving tool. For example, after every combustion cycle the information obtained from the microprocessor input signals may be stored in the EEPROM for later use, such as for display or for use by the microprocessor, which may be programmed to review the information at periodic intervals. As an example, the microprocessor may execute a safety check after every combustion cycle, a magazine content and fuel availability check after every ten combustion cycles, and a battery voltage check after every twenty-five cycles. The data from checks may be stored in memory for later automatic retrieval by the microprocessor or manual retrieval by the user. One microprocessor that is believed suitable for such an application is commercially available from Motorola, having part number MC68HC711E9CFS2.

Consistent with the foregoing description, the control system memory device may include additional parameters that relate to a variety of features of the fastener driver tool, explained in more detail below. Such additional parameters may include an inactivity time limit, exhaust fan on-time, automatic fueling interval factors, minimum and maximum manual fueling intervals, ignition delay time, spark frequency, ignition coil duty cycle, switch or contact debounce time, and piezo-buzzer duration. In the preferred embodiment, automatic fueling interval calculation parameters are stored in EEPROM and include a base temperature, enrichment and leaning temperatures (the relationship between ambient air temperature and fuel mixture), an auto adjust factor, and a minimum and a maximum fueling interval, which will be described in more detail below. Such EEPROM parameters, and others, may be easily adjusted without having to reprogram the microprocessor. The threshold voltage levels for a dead or low battery may also be programmed in the EEPROM. Minimum and maximum operating temperatures and low (or empty) fuel pressure values may also be stored.

The microprocessor also records the occurrence of fastener driver tool faults, such as low battery voltage or fuel pressure values. When a fault occurs with the fastener driver tool, a fault code indicating the type of fault that occurred may be logged in the control memory device, along with the time of the fault and/or other information. In the preferred embodiment, this information is logged in EEPROM. This information may be displayed on a user interface or may be downloaded to a PC or other computing or memory device. The information may be used in a review of the fastener driver's performance to anticipate future problems, provide a maintenance schedule, or troubleshoot. The microprocessor may also determine whether fastener driver 10 is in need of a service check and communicate that information to the operator through a user interface circuit.

More specifically, a block diagram of a control system of the present embodiment is shown in FIG. 23 and includes a programmable microprocessor 300 for receiving sensor and data input and for providing control and data output, as described.

More particularly, microprocessor 300 of the control system includes a program for utilizing fastener tool sensor and input data to determine operational parameters and create a fastener driver tool log or database. A microprocessor-based control system also provides the framework for an interactive safety and security system.

The control system of the present embodiment may include a program for checking the status of the driving tool after every combustion cycle. A status check may review current or last recorded power supply levels, fuel pressure, magazine content, the occurrence of a nose jam, operating temperature, and logistics regarding frequency of use. After the status review, the control system may alert the operator that maintenance repairs are recommended or required.

In the microprocessor based control system, the operator may select, or limit, the information parameters that are reviewed by the microprocessor. The selected (or deselected) parameters may be stored for easy identification and utilization.

Figure 24:
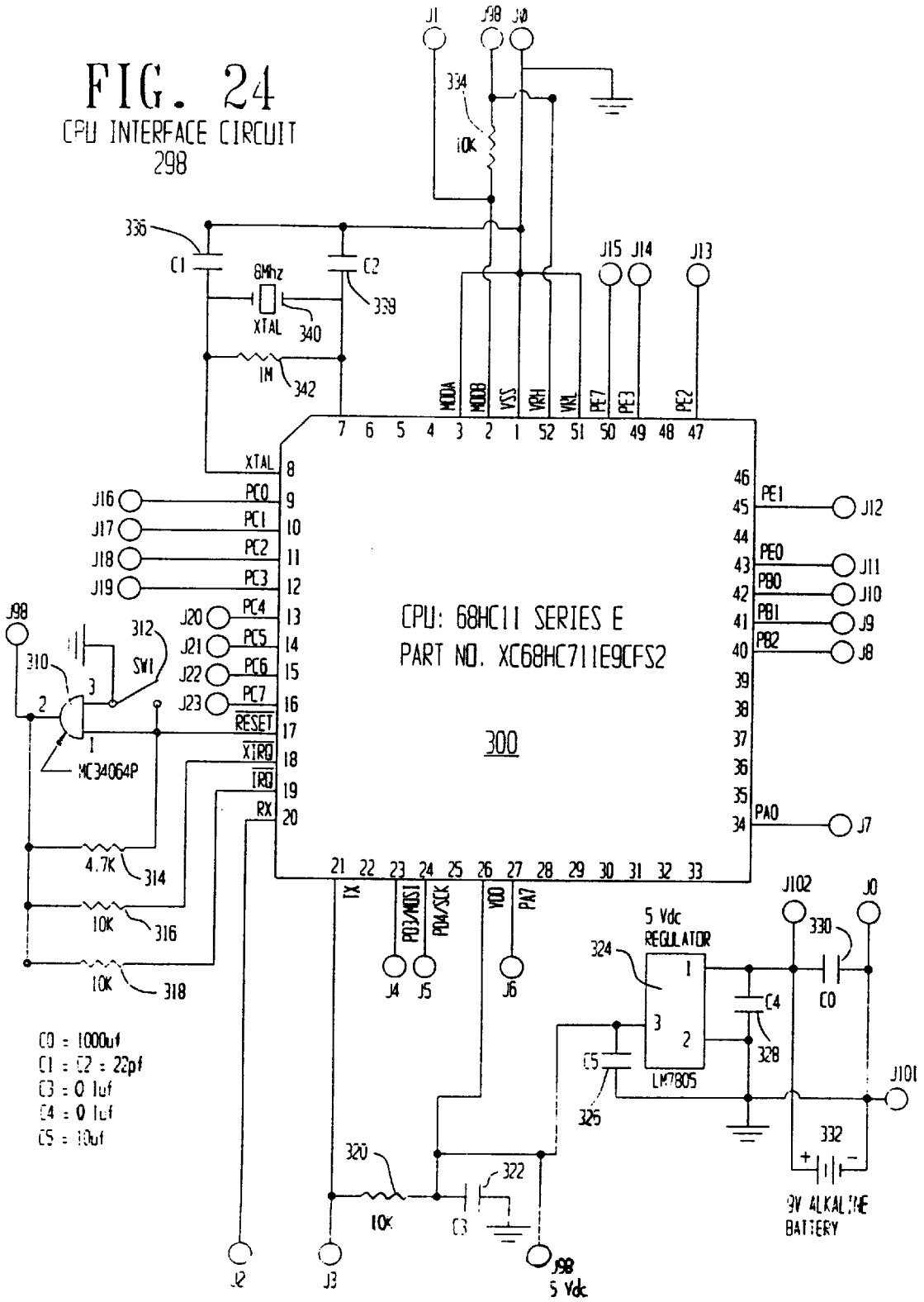
FIG. 24 is a circuit diagram of a CPU interface circuit for a microprocessor-controlled embodiment of the present invention.

The programmable microprocessor 300 of the present control system is shown in greater detail in FIG. 24. Microprocessor 300 manages the operation of fastener driving tool 10 through CPU interface circuit 298. The source code for the microprocessor of the present embodiment is attached hereto as an Appendix and forms part of this description. Also included in the Appendix is the source code for a program (Macro file generator) for creating a macro file of fastener tool system operation and performance parameters for input to microprocessor 300. Microprocessor 300 is pre-programmed in a manner consistent with the operation of the device as described below and shown in FIGS. 40A through 40I. Power for microprocessor 300 is supplied through 5 volt DC regulator 324.

Inputs provided to the microprocessor relate to various aspects of the fastener driver tool. Operational related inputs are utilized to maximize the operational efficiency of the tool. Fastener status related inputs provide signals indicative of various conditions of the fastener driver. User related inputs may be provided for overriding or supplementing the programmed operation of the control system or for accessing the microprocessor information database or control program. Safety related inputs may be provided for preventing accidental or intentional misuse and for safeguarding against accidents.

Referring back to FIG. 23, microprocessor 300 may receive input signals from a fuel pressure sensor, a temperature sensor, an ambient pressure sensor, a working surface temperature sensor, an ignition switch assembly, a jam detector, a magazine content switch or sensor, a CPU power supply, and/or a power relay. Data input signals may also be provided to microprocessor 300 by a user-interface module and/or from an external computer via communications/download module.

Outputs provided by the microprocessor may also relate to various aspects of the fastener driving tool. Functional related outputs may control operational and safety related components of the fastener driving tool. Data related outputs may provide operational or safety information to the operator or to another processing device.

As shown in FIG. 23, microprocessor 300 may control a fuel injection circuit, an ignition circuit, an exhaust fan, a power relay, and may provide tool condition and control data to an external source via a communications download module. The user-interface module may also include visual and audio devices for communicating control system information to an operator, including operating parameters, data, and other information.

Safety related inputs may include a working surface contact switch or sensor, a working surface characteristic sensor, an exhaust/intake valve switch, and a user-interface module.

A working surface contact switch or sensor provides a signal that indicates whether the fastener driving tool is in the proper position with respect to a work surface for discharging a fastener. For example, the work surface contact switch or sensor prevents the discharge of a fastener unless it is engaged against a work surface. The switch or sensor may be located at the distal end of the guide plate 22, where the fastener driving tool contacts the work surface when in position for discharging a fastener into the work surface. The switch or sensor may detect contact with a work surface through a mechanical, electromagnetic, infrared, or other type of contact or proximity detection device.

Microprocessor 300 may not initiate a fueling cycle until it detects that fastener tool 10 is forced flush against a working surface and trigger 86 is activated. Note that in the current embodiment exhaust valve position switch 406 is activated when the fastener driver is forced flush against a working surface, closing the rotary exhaust/intake valve. As shown in FIGS. 24 and 29, when trigger 86 is activated and the exhaust valve is closed, microprocessor 300 receives a "high" signal at PA0. In an alternate embodiment, if the fastener driver is in contact with a work surface, the microprocessor may be programmed to responsively close the exhaust valve and otherwise prepare the fastener driving tool for a combustion cycle.

Provided microprocessor 300 receives a continuous signal at PA0, (i.e., provided the user is activating the trigger 86 and the device remains forced flush against a working surface and, therefore, the combustion chamber valve is completely closed) microprocessor 300 may output signals for execution of a combustion cycle, explained below, if the microprocessor's data indicates that all other safety conditions are satisfied.

A working surface characteristic sensor may provide a signal that indicates whether the surface that the fastener driving tool is in contact with has a particular characteristic or characteristics. For example, a working surface characteristic sensor may provide a termination signal if the working surface has a characteristic that corresponds to human skin. The working surface characteristic(s) sensor may be located near the distal end of the guide plate 22, where a fastener first emerges, to detect work surface characteristics such as temperature, density, or moisture. The sensor preferably has a sufficiently quick response time so that the microprocessor may immediately halt fastener driver operation if the work surface characteristic corresponds to a predetermined characteristic or range of characteristics of human skin stored in the EEPROM or EPROM or employed in the software. For example, the microprocessor may not activate the ignition system if it senses that the work surface corresponds too closely with characteristics of human skin. Additionally, if a human skin characteristic is ascertained early enough, the microprocessor may not activate the fuel injection system.

An exhaust/intake valve switch or sensor provides a signal that indicates whether the exhaust/intake valve is open or closed. If the exhaust/intake valve is open, the switch or sensor provides a signal to the control system for preventing the injection of fuel into the open combustion chamber. The control system may also prevent ignition if the exhaust/intake valve is opened after fuel is injected into the combustion chamber. There are a number of other ways in which the control system of the present embodiment may disable the fastener driving tool. The control system may prevent activation of the fuel injection system, the trigger mechanism, or may enter a sleep mode, discussed below.

A user-interface module may also provide safety related inputs. An unauthorized user, such as a child, may be prevented from using the tool if a predetermined user-input code is not provided. This aspect of the user-interface is described more fully below.

As shown in FIG. 23, operational related inputs may include a temperature sensor, a pressure sensor, and other sensors for providing signals that correspond to conditions that may affect the performance of the fastener driving tool.

Optimum combustion efficiency requires adjusting the amount of fuel that is injected into the combustion chamber. Some factors that determine the amount of fuel to be injected for optimum combustion are temperature and pressure. A temperature sensor may provide a signal to the control system that corresponds to ambient, fuel canister, or combustion chamber temperature.

Referring to FIG. 30, temperature sensor circuit 412 provides microprocessor 300 with a voltage magnitude at J11 that corresponds to the relative ambient, fuel canister, or combustion chamber temperature. Temperature sensor circuit 412 preferably includes decoupling capacitor 426 to mitigate noise interference. In the preferred embodiment, temperature sensor 414 senses ambient air temperature. Referring to FIG. 24, microprocessor 300 receives the voltage signal from the temperature sensor at microprocessor input PE0. The microprocessor correspondingly adjusts the fueling interval. This aspect of the invention is described in greater detail below. In an alternate embodiment, a temperature sensor is positioned near or in the fuel canister and provides to microprocessor 300 a voltage signal corresponding to fuel canister or fuel temperature. The microprocessor correspondingly adjusts the fuel interval by increasing or decreasing it in response to temperature changes.

In addition, a pressure sensor may be provided for providing a voltage magnitude signal to the control system that corresponds to ambient or combustion chamber pressure. The control system may respond to both temperature and pressure changes by adjusting the amount of fuel injected into the combustion chamber.

Fastener status related inputs illustrated in FIG. 23 include a jam detector, a magazine content switch, a trigger, a fuel pressure sensor, and battery power level indicators.

A jam detector may provide a signal indicative of whether a fastener is properly aligned with the guide plate. The jam detector may detect whether a fastener is properly aligned through mechanical, electromagnetic radiation, electrical, or other means. For example, if the fastener is made out of a material that conducts electricity, an electrical jam detector may provide a very small electrical current to one end of the fastener that may be detected by an electrical signal receiver that is positioned where the opposite end of the fastener should be if the fastener is properly aligned with the guide plate. The jam detector provides a signal to microprocessor 300. As described below, microprocessor 300 may responsively provide (or halt) output signals for controlling the operation of the fastener driver and for communicating jam status to the operator.

Similarly, a magazine content switch may provide a signal if the content of the fastener magazine falls below a threshold amount. Like the jam detector, the magazine content switch may employ any suitable mechanical, electromagnetic radiation, electrical, light, or other sensor. For example, a simple mechanical contact or switch may be located within the magazine at a fixed distance from the magazine output. When the contact is closed, indicating no fastener is in contact with the switch, a magazine content signal is inputted to the microprocessor 300. The microprocessor 300 may then provide a signal to the user interface for display to the operator.

A conventional fastener driver has a trigger mechanism that activates the ignition system directly. In the present embodiment, a trigger may activate a trigger signal generator circuit that provides a trigger input signal to microprocessor 300. The microprocessor may generate an ignition or fuel injection signal, as explained below, only upon receipt of a trigger signal and other signals, such as a working surface contact signal, and an exhaust valve position signal.

A fuel pressure switch or sensor may provide a signal that corresponds to the pressure within the fuel canister. Referring to FIGS. 24 and 31, fuel pressure sensor 422 senses the pressure inside the fuel canister and sends a voltage signal indicative thereof to input PE1 of microprocessor 300. Microprocessor 300 may determine that the pressure in the fuel canister is below the vapor pressure of the fuel at the prevailing temperature, indicating that most or all of the liquid fuel has been consumed and only vapor remains in the canister. Microprocessor 300 may then send a signal to the user interface circuit for providing an audio or visual low fuel alarm. Alternatively, microprocessor 300 and user interface circuit 600 may provide a continuous indication of the quantity of fuel in the fuel canister.

Battery power level indicators may also provide input signals that correspond to the voltage supplied by fastener driver batteries. If there is more than one battery, then separate battery voltage level indicators may be used. For example, if one battery is dedicated to providing power to the microprocessor, then a microprocessor battery voltage level sensor may provide a microprocessor battery power voltage input signal. If a second battery provides power to the other battery-driven devices (hereinafter "peripheral devices"), then a peripheral battery voltage level sensor may provide a peripheral battery voltage level input signal. The signals provided by the battery power level indicators may be received by microprocessor 300. Microprocessor 300 may provide a low battery warning signal to the user interface for display before a battery is completely exhausted. A dead battery warning signal may also be provided if a battery voltage level drops below a usable threshold voltage.

Of course, the microprocessor based control system requires an energy source to function. A number of peripheral components of the present embodiment also require an energy source. Because it is desirable to minimize the frequency of replacing the energy sources and it is also desirable to minimize the effect on the digital system of power fluctuations due to switching of the solenoid valve, ignition coil, and fan, separate power sources may preferably be used for the microprocessor and the peripheral devices.

Figure 28:
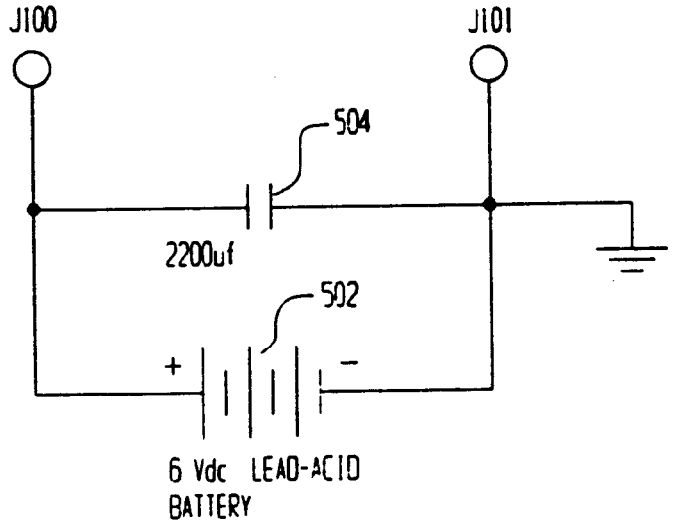
FIG. 28 illustrates the terminal connections for a main battery for the microprocessor-controlled embodiment of the present invention.
Figure 32:
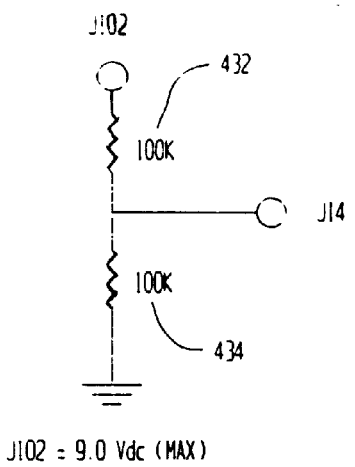
FIG. 32 is a circuit diagram of a CPU battery voltage divider for the microprocessor-controlled embodiment of the present invention.

Referring to FIG. 24, a standard 9 volt alkaline battery 332 supplies power to microprocessor 300 through 5 volt regulator 324. Additionally, a Gel-Cell™ lead acid 6 volt main battery 502, shown in FIG. 28, provides power to the peripheral devices. Thus, microprocessor 300 is largely isolated from the electrical noise generated by active components, such as those included in the ignition and fuel systems.

Because some of the peripheral systems, such as ignition system 232, are capable of operating at voltage levels below the minimum required by microprocessor 300, main battery 502 will not have to be recharged as often as a single voltage source used to supply all of the components, including the microprocessor. Also, microprocessor 300 does not draw power as heavily as the peripheral components. Consequently, main battery 502 will most likely encounter multiple recharging cycles before microprocessor battery 332 has to be replaced.

A single battery source may also be used to provide a voltage potential to voltage regulators. The voltage regulators may then provide precise voltage potentials to the microprocessor and peripheral components.

Figure 25:
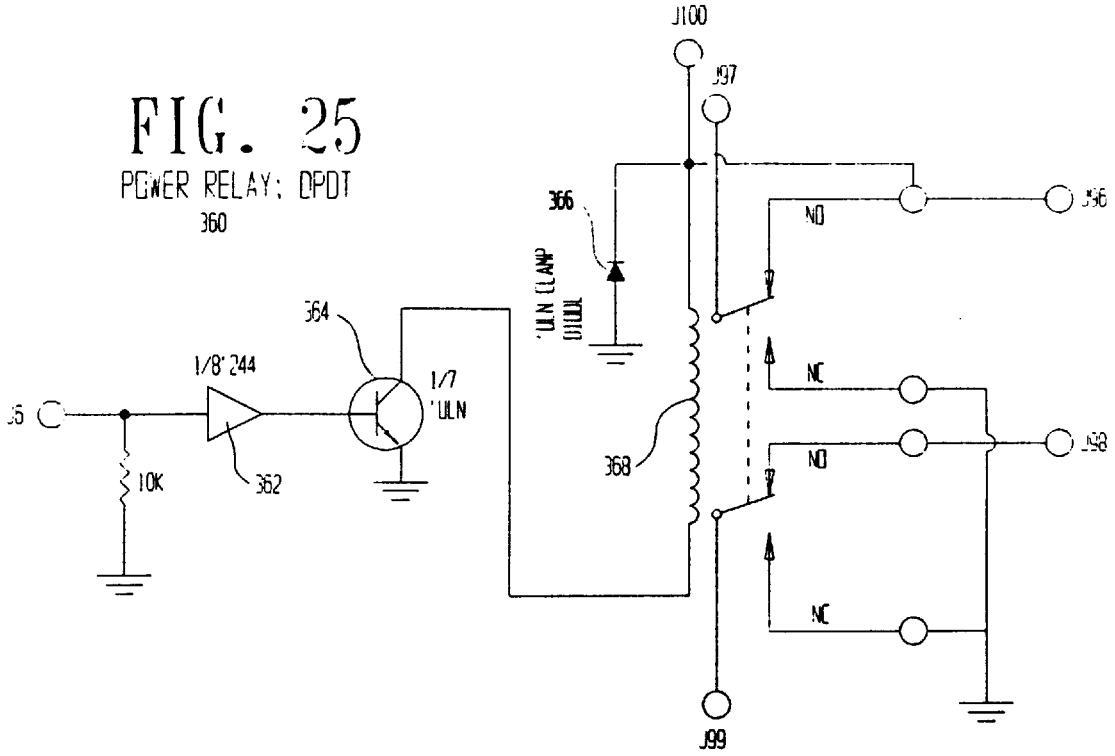
FIG. 25 is a circuit diagram of a power relay circuit for the microprocessor-controlled embodiment of the present invention.
Figure 26:
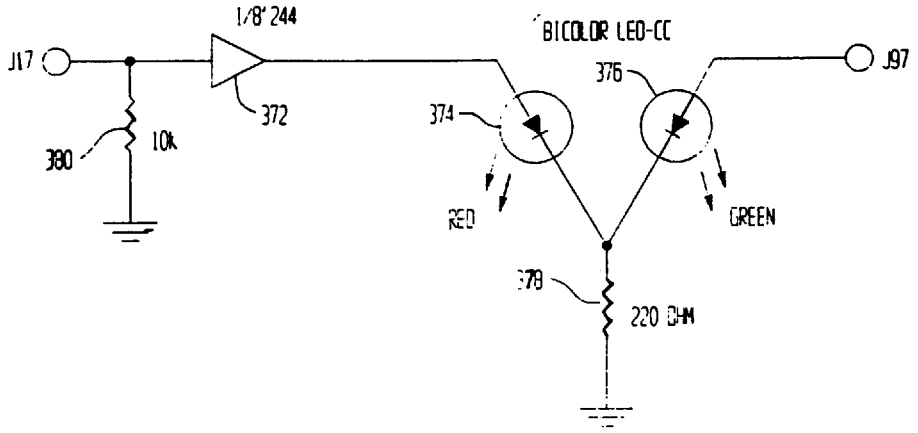
FIG. 26 is a circuit diagram of a hardware status LED circuit for the microprocessor-controlled embodiment of the present invention.
Figure 33:
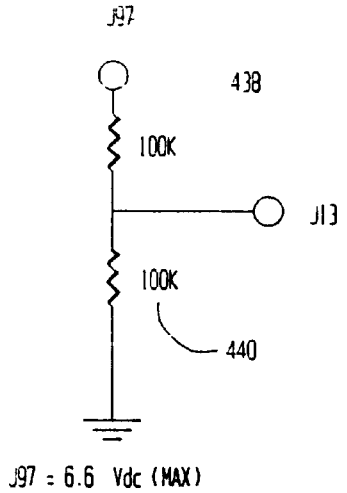
FIG. 33 is a circuit diagram of a main battery voltage divider for the microprocessor-controlled embodiment of the present invention.

In the present embodiment, the control system alerts the operator when the power supply for the peripheral devices begins to diminish. Referring to FIGS. 24, 25 and 26, LED 376 indicates the status of relay 360 and, therefore, whether power is being applied to the peripheral devices. Referring to FIG. 33, microprocessor 300 also monitors the power supplied by relay circuit 360 via voltage divider 436 and activates LED 374 when the power supply becomes diminished, thereby alerting the operator.

User related inputs include a user interface module that preferably includes an input device. The input device may include a keyboard for inputting alphanumeric data or may include another instrument for inputting graphic, audio, magnetic, or radio-frequency communication signals. An input device may also include a display with browse and select buttons for selecting options off a menu, a voice recognition device or other apparatus for generating input signals selected by an operator.

In contrast to the type of information supplied by a simple trigger signal, information or data input into the fastener driver may include parameters such as fuel interval offset values or override values. The input signals may relate to control of the fastener driver, such as providing a fuel offset value for increasing or decreasing the amount of fuel injected into the combustion chamber as determined by the control system.

The input signals may also relate to the operator, such as a user-id code. The microprocessor may receive input from an authorized-user signal generator for generating an authorized-user signal when a user input signal corresponds to a unique code. For example, an authorized-user signal generator may include a keypad for receiving a user password and providing a corresponding signal to the microprocessor for comparison with a predetermined password or set of passwords. Alternatively, the authorized-user signal generator may include a radio-frequency signal receiver, magnetic code reader, voice pattern decoder, or a fingerprint scanner and provide corresponding signals for comparison to a predetermined signal or set of signals.

The control system of the driving tool may include both a user interface and a microprocessor. As discussed above, there are a number of possible devices that may embody the user interface. In the present embodiment, microprocessor 300 detects the user interface type before initializing its outputs.

Figure 39A:
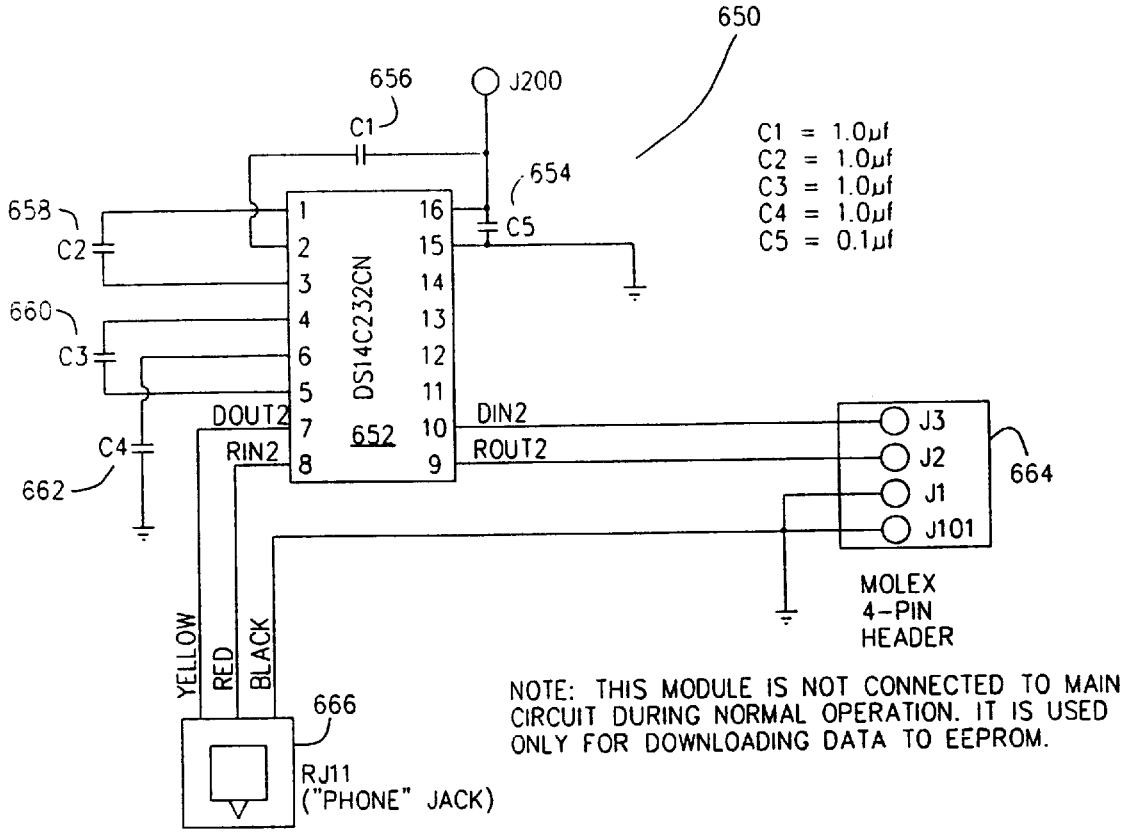
FIGS. 39A and 39B comprise a circuit diagram of a communications/download module circuit for the present invention.
Figure 39B:
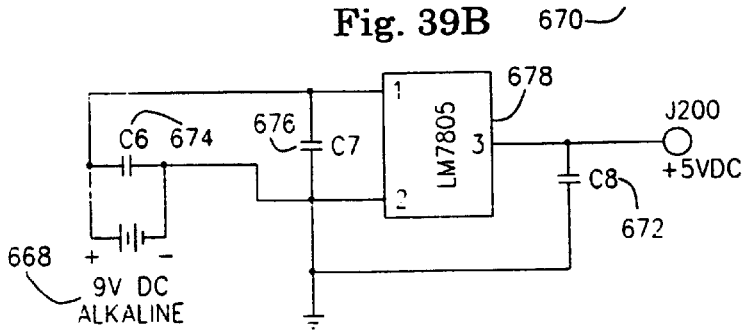
Figure 40A:
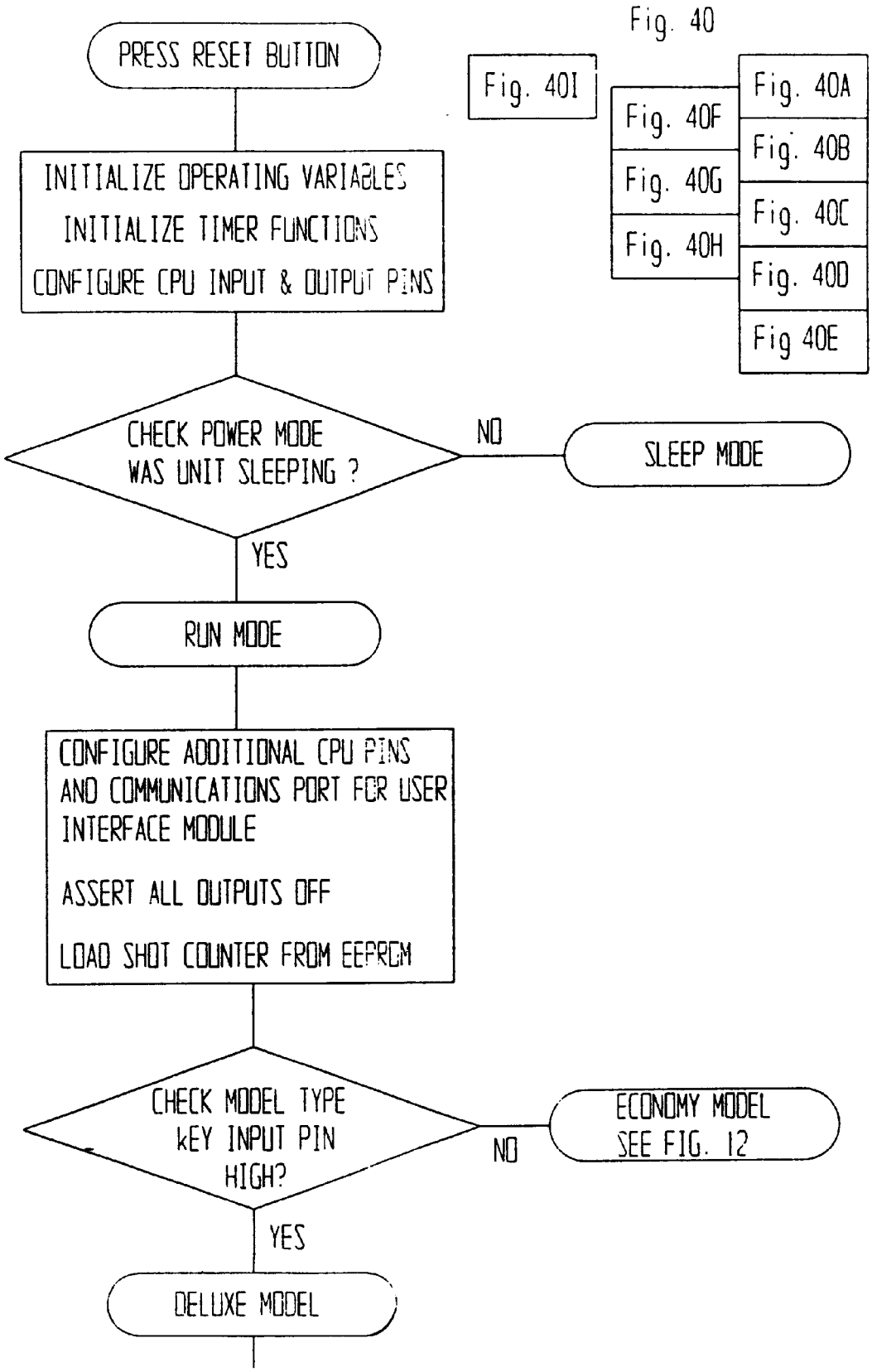
Figure 40B:
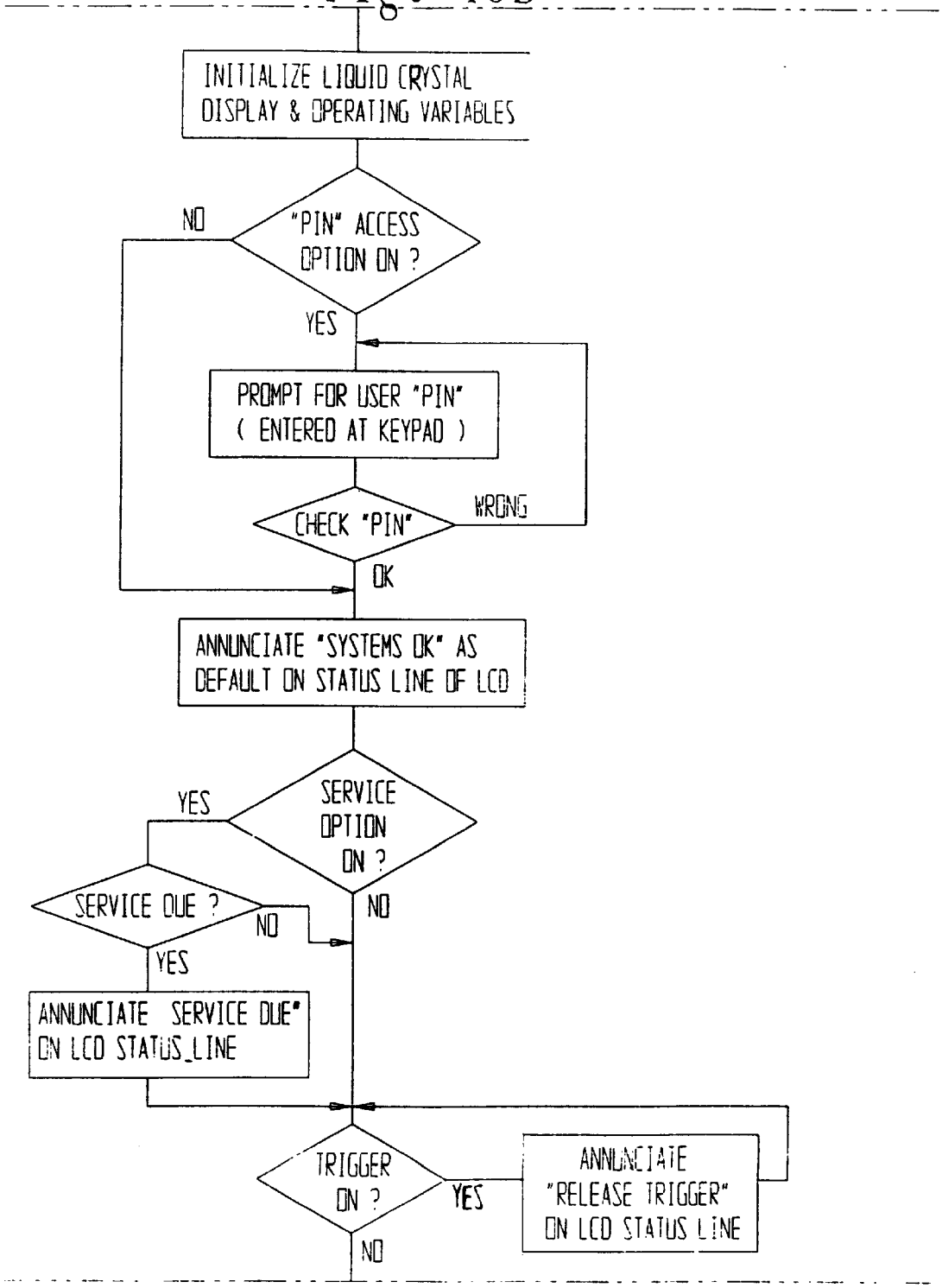
Figure 40C:
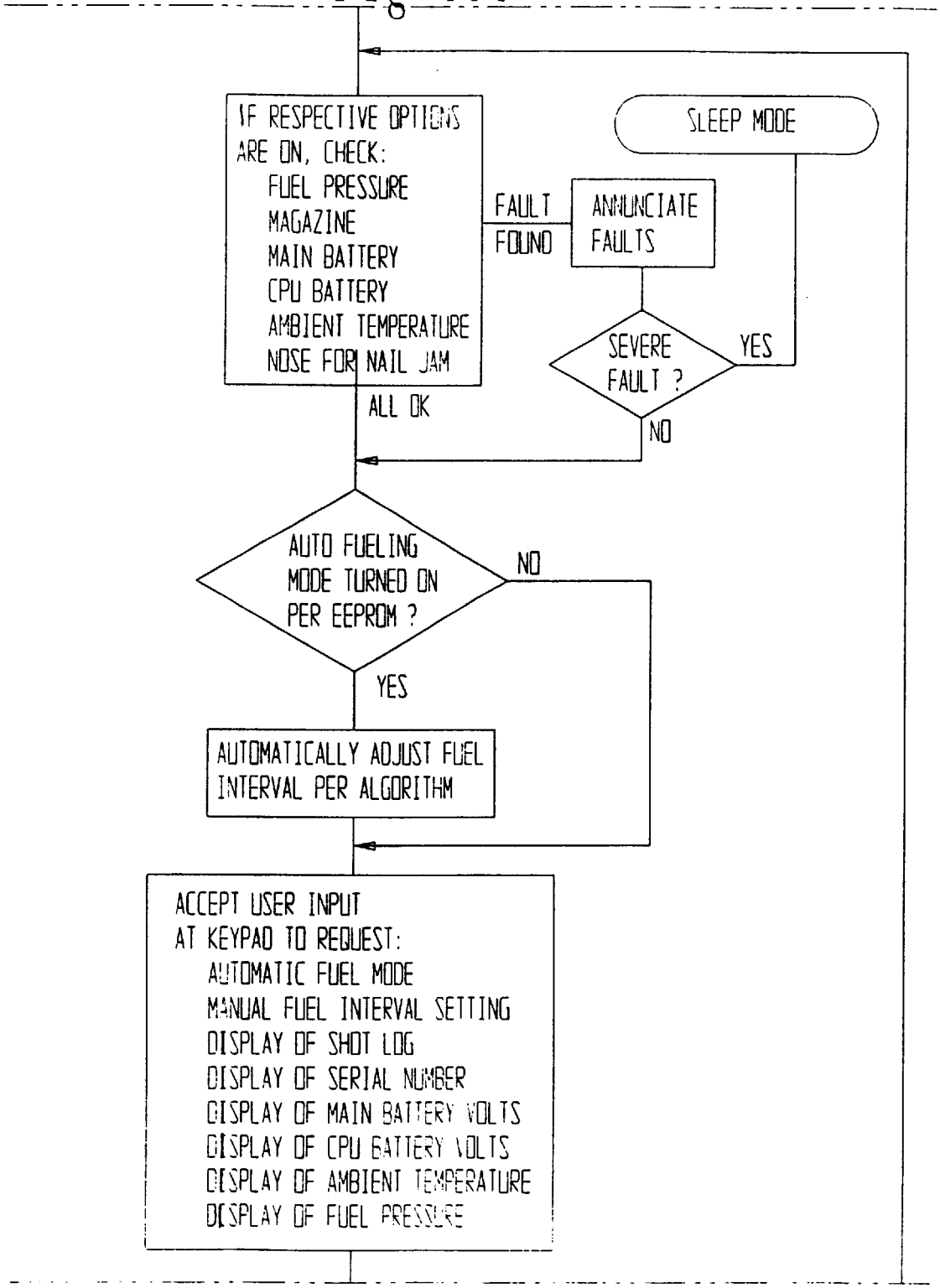
Figure 40D:
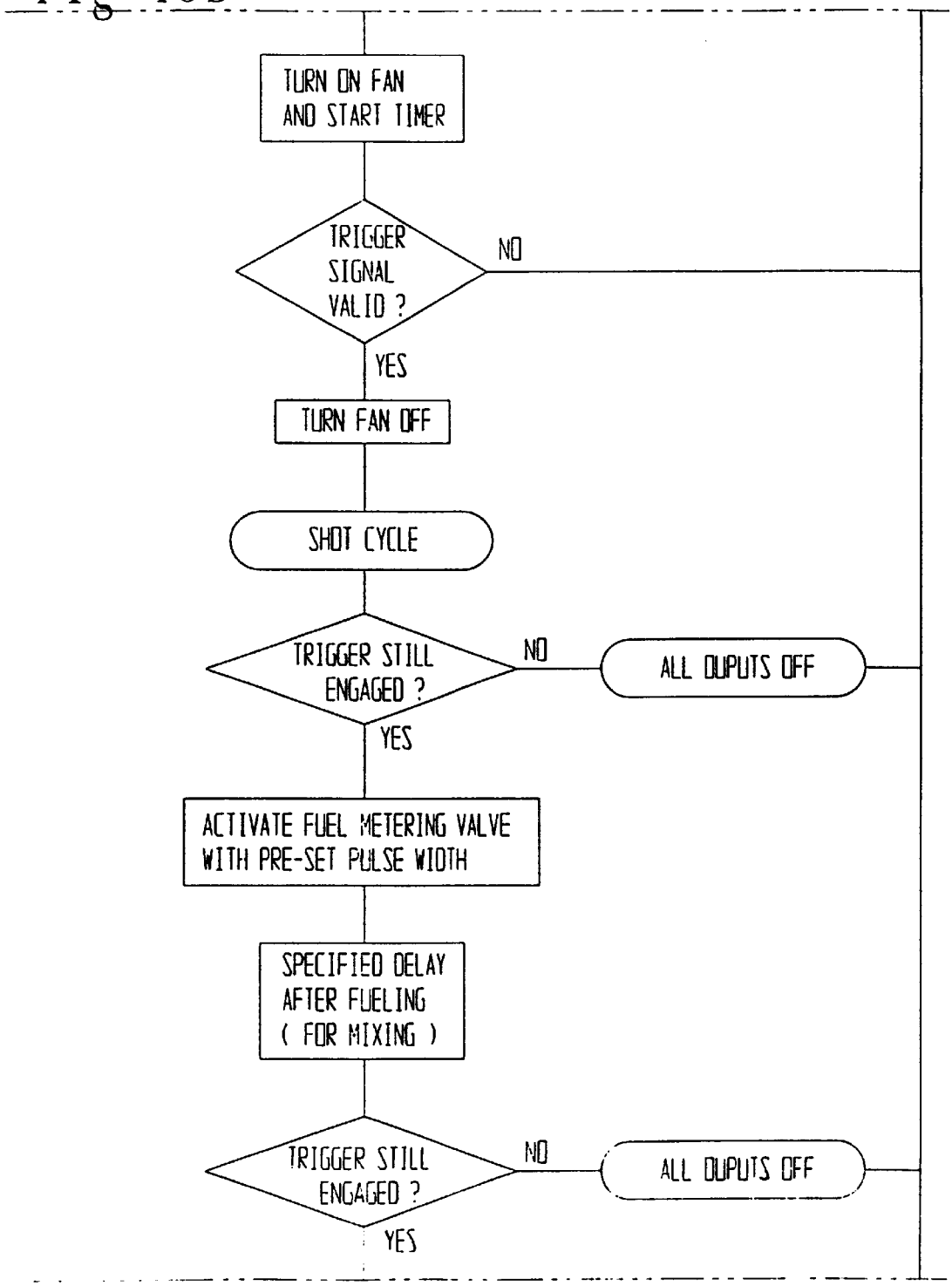
Figure 40E:
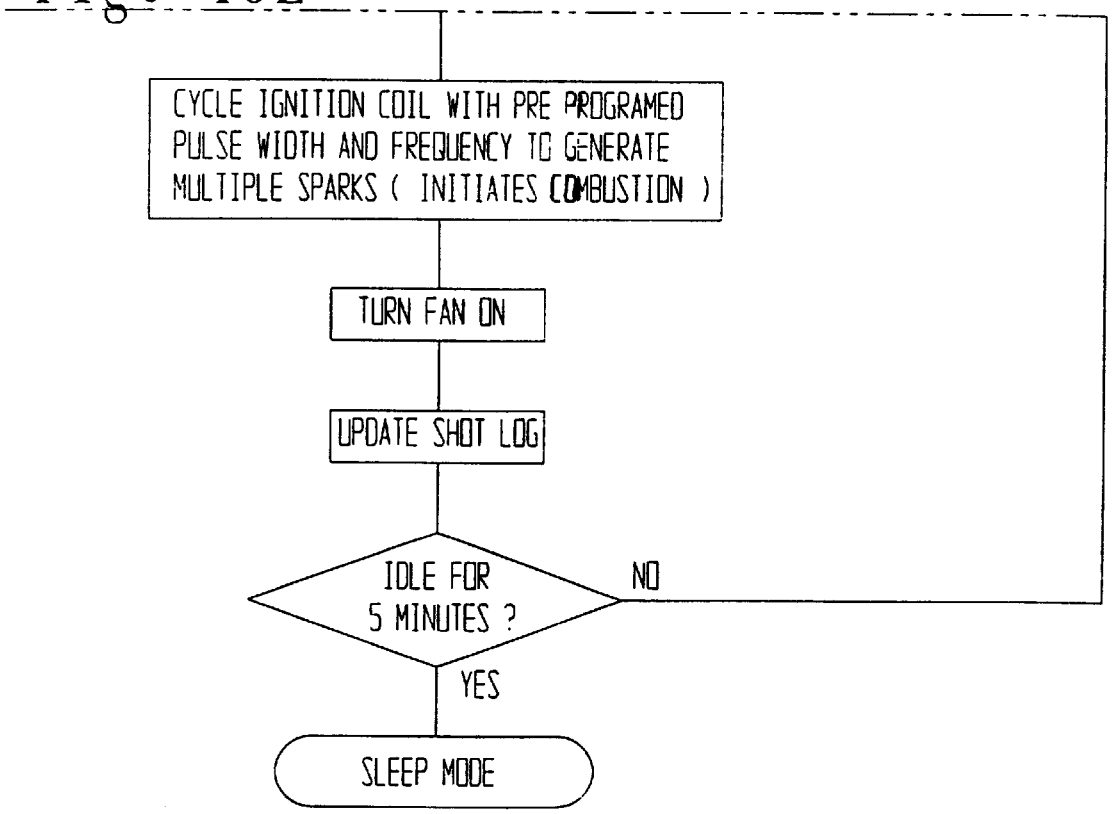
Figure 40F:
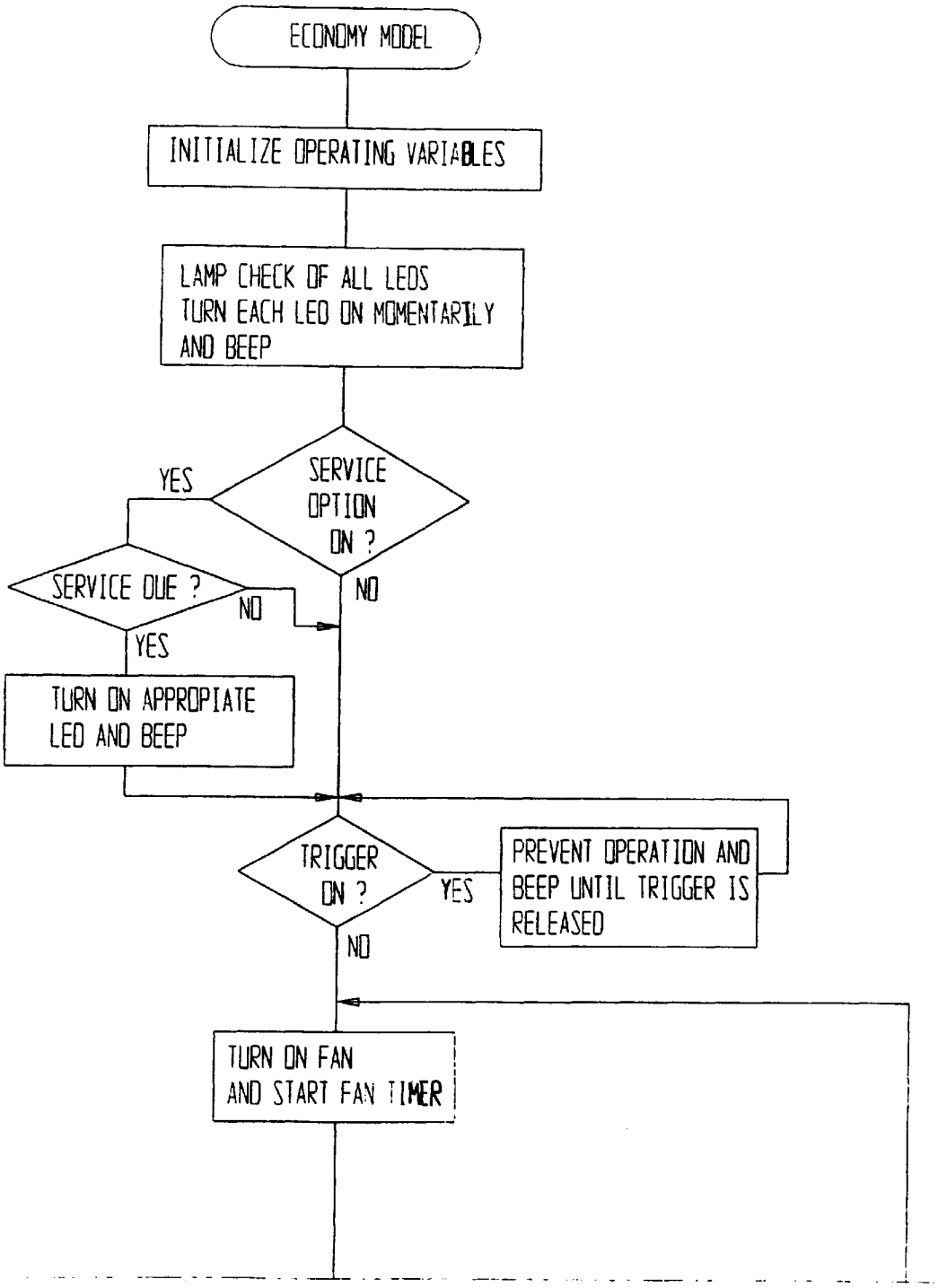
Figure 40G:
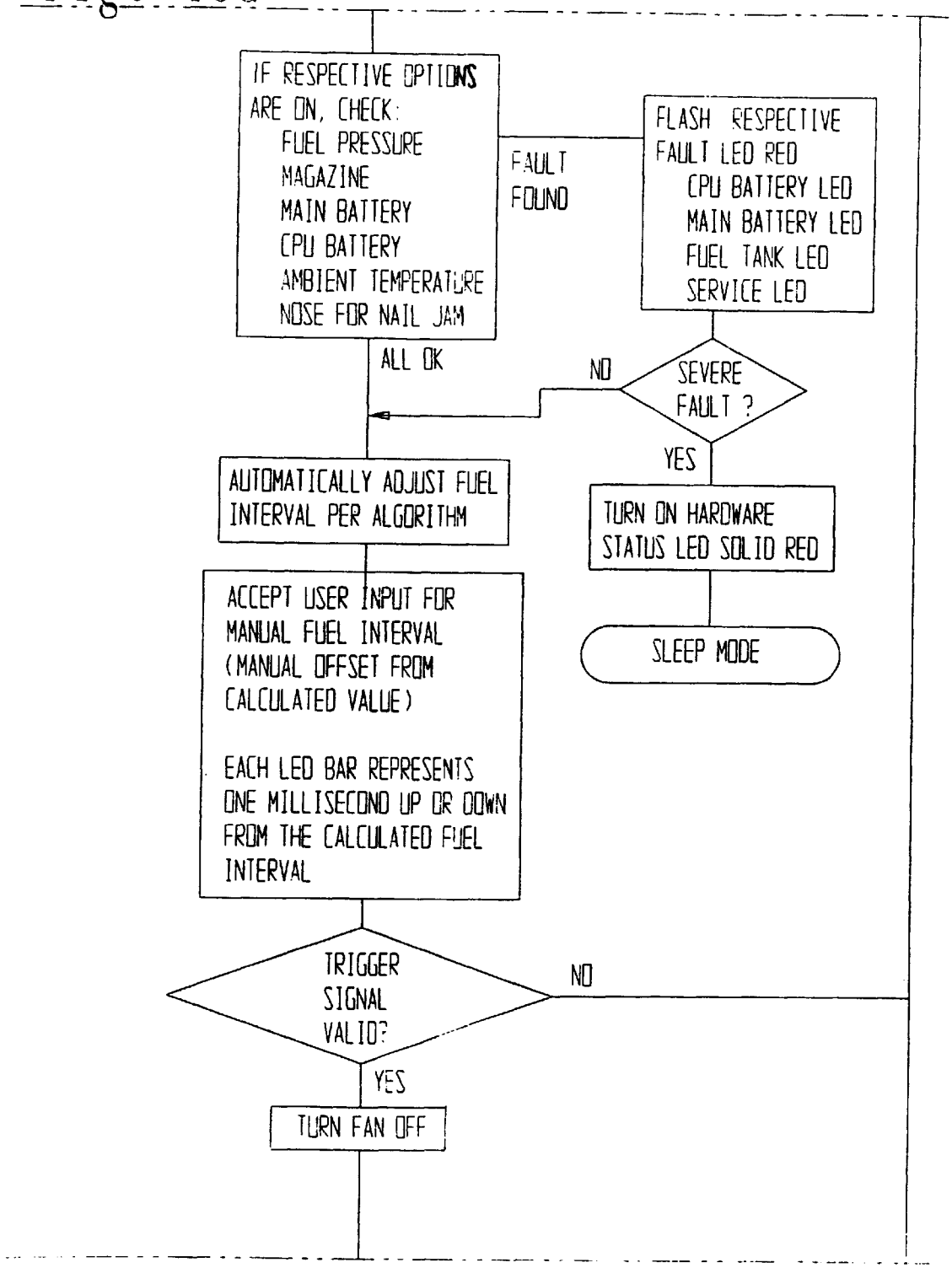
Figure 40H:
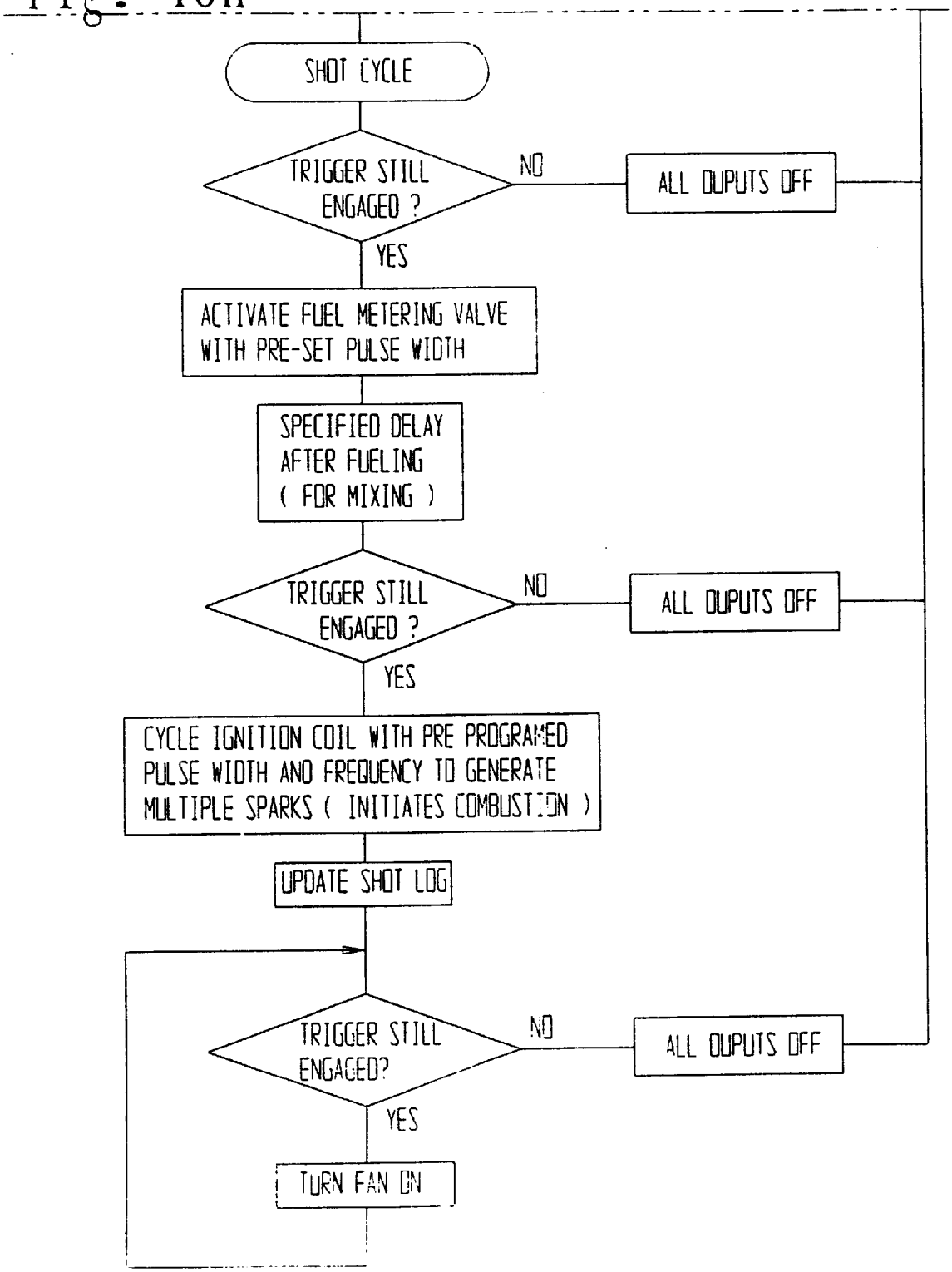

Referring to FIGS. 38 and 39, in the present embodiment microprocessor 300 determines whether the model key terminal J15 is "low" (for the "economy", or up/down button model) or "high" (for the "deluxe", or keypad model). Microprocessor 300 detects the status of J15 at PE7. As indicated in FIGS. 40A through 40I, the microprocessor will execute different program commands, dependent upon model type.

The input signal may also relate to information about the fastener driver tool, such as events like replacement of a fuel canister or battery.

The microprocessor may also be programmed to enter special modes of operation in response to exceptional circumstances or user input signals. Referring to FIG. 24, the microprocessor of the present embodiment includes interrupt inputs at pins 18 and 19. Pins 18 and 19 may be interconnected to a signal generator. For example, an emergency stop switch may be interconnected to one of the interrupt inputs. A user may respond to an emergency situation by activating the stop switch. The microprocessor may then immediately stop executing all other functions and enter an emergency shutdown routine.

Output signals are comprised of both functional output signals and data output signals. Functional output signals may be provided to control components within the fastener driver tool, such as the fuel injection system, the ignition system, and an exhaust/intake valve and/or fan. Data output signals comprise information and may be provided to a user interface or to an external data processing device.

A fuel injection output signal may be provided for controlling the fuel injection system. A fuel injection circuit may include a circuit for controlling a valve that regulates the flow of fuel into the combustion chamber. The duration of the fuel injection output signal corresponds to the time that the fuel flow valve is to remain open for delivering a predetermined amount of fuel into the combustion chamber.

More specifically, microprocessor 300 may be programmed to determine the amount of fuel to be injected into the combustion chamber as a function of ambient, fuel, or combustion chamber temperature, as ascertained from the temperature sensor input signal, described above.

Various approaches or formulas may be used in calculating fuel flow. Microprocessor 300 may be programmed to adjust the fueling interval in response to one or several parameters, including ambient, fuel, or combustion chamber temperature, ambient pressure and/or fuel tank pressure. Other conditions may also warrant an adjustment of the fuel interval. For example, as the voltage of the battery that controls the fuel valve decreases, the fuel valve may become less responsive. Microprocessor 300 may be programmed to compensate for decreases in fuel valve response time by increasing the fuel interval.

Microprocessor 300 may be programmed to determine the fuel interval by way of a formula, table, or other method. Generally, if microprocessor response time is a significant factor, the table method may be preferred. A formula for fuel interval calculations has the advantage of easily accommodating additional or a large number of variables.

One formula for adjusting the fuel interval may be based upon deviation in temperature from a predetermined temperature. For example, microprocessor 300 may be programmed to set the fuel interval to a predetermined period at room temperature and increase (or decrease) the fuel interval in increments as the temperature deviates from room temperature. For example, for every 2° F. above room temperature, the fuel interval may be decreased by 1 ms and for every 2° F. below room temperature, increased by 1 ms, within a fuel interval range defined by minimum and maximum fuel interval limits. Such a formula accounts for the improved dispersion of fuel in the fuel chamber at higher temperatures, and the increase in fuel canister pressure as temperature increases. Other factors may be implemented to account for other offsets. As explained below, a user of the device can also enter a fueling interval offset value through the user interface.

As discussed above, in a further embodiment microprocessor 300 receives condition signals representing other conditions, such as atmospheric pressure, humidity, and/or fuel tank pressure and adjusts the fueling interval in response thereto for optimum combustion. For example, the fuel interval may be decreased as atmospheric pressure decreases and/or increased as fuel canister pressure decreases. It should be clear that the fuel interval may be derived from a table or a formula and may depend upon one or more variables.

Figure 34:
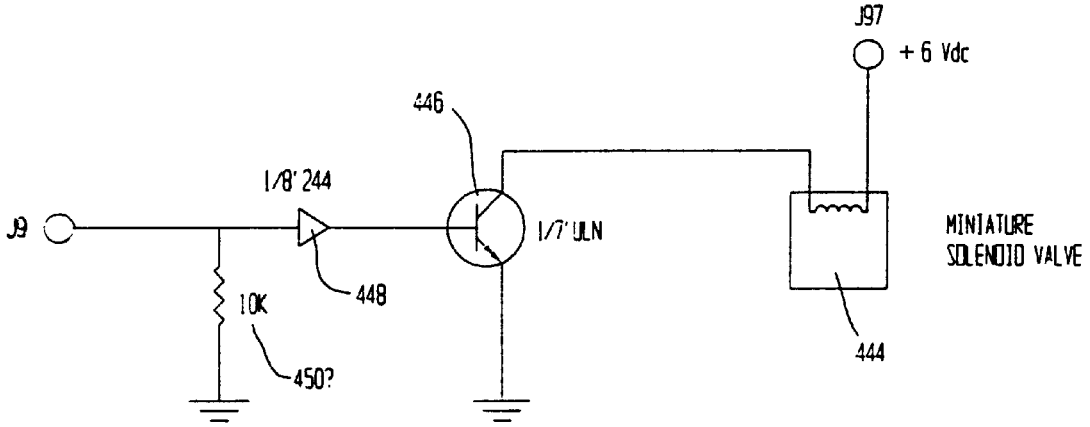
FIG. 34 is a circuit diagram of the hardware components for controlling the fuel system for the microprocessor-controlled embodiment of the present invention.

Microprocessor 300 controls the fuel flow control valve by providing a fuel interval signal at microprocessor output terminal PB1. Thus, delivery of fuel to the combustion chamber is metered by the microprocessor at PB1 by energizing solenoid valve 444 for a specific amount of time. Referring to FIGS. 1 and 34, microprocessor 300 injects a controlled amount of fuel into combustion chamber 12 by activating miniature solenoid valve 444 through transistor 446. Solenoid valve 444 works similar to metering solenoid valve 46, described earlier, to deliver a precise amount of fuel to combustion chamber 12.

An ignition output signal may be provided for activating the ignition system. As discussed above, the ignition output signal may be responsive to several input signals, such as a trigger input signal, a working surface contact input signal, an exhaust/intake valve input signal, and other safety related signals. The ignition output signal may also be characterized by the duration or frequency of the spark(s) to be generated by the ignition system.

As discussed above, driver condition signal generators may provide microprocessor 300 with signals corresponding to the condition of the tool, the work surface, and whether the operator is authorized. The microprocessor may then activate ignition based upon a plurality of data parameters, including a signal from a triggering mechanism.

Figure 35:
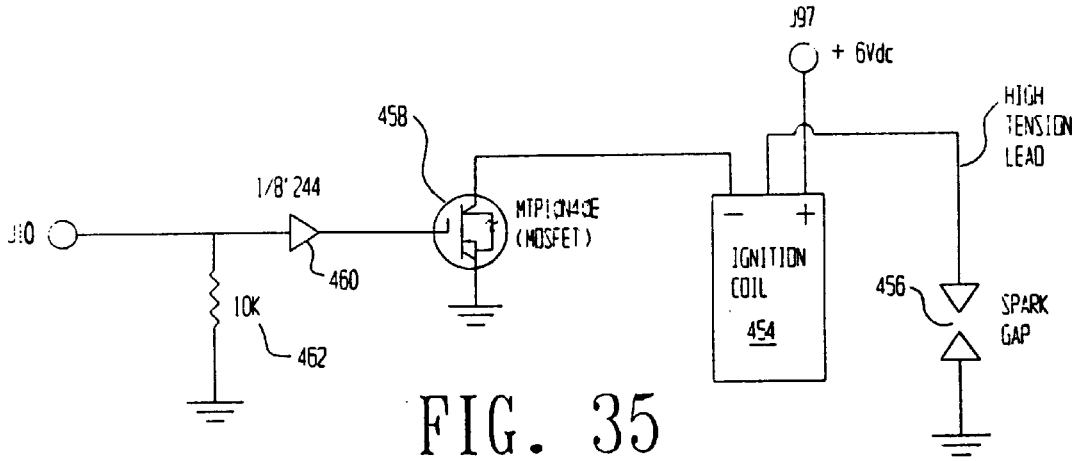
FIG. 35 is a circuit diagram of the hardware components of the ignition system for the microprocessor-controlled embodiment of the present invention.

Microprocessor 300 may control the ignition system to generate multiple sparks inside combustion chamber 12. Multiple sparks increase the probability of obtaining complete combustion and/or achieving ignition, thereby obtaining maximum power. FIGS. 24 and 35 illustrate the interconnection of microprocessor 300 to MOSFET driven ignition system 452. To activate ignition coil 454, microprocessor 300 continually switches the signal at PB0 between low and high states in rapid succession for a short period of time. Consequently, MOSFET 458 turns off and on in rapid succession, driving ignition coil 454 and causing a rapid succession of sparks across the gap in spark plug 456. The duration of the sparking period and the frequency of the signal at PB0 are controllable by microprocessor 300, as explained.

Other peripheral devices may also receive output signals. If the exhaust/intake valve is not mechanically controlled by linkage to the nose piece, an exhaust/intake valve output signal may be provided for activating a mechanism, such as a small motor or solenoid, for controlling the position of the exhaust/intake valve. Under control of the microprocessor 300, the exhaust/intake valve may be closed just prior to fuel injection and remain closed until after ignition.

Figure 36:
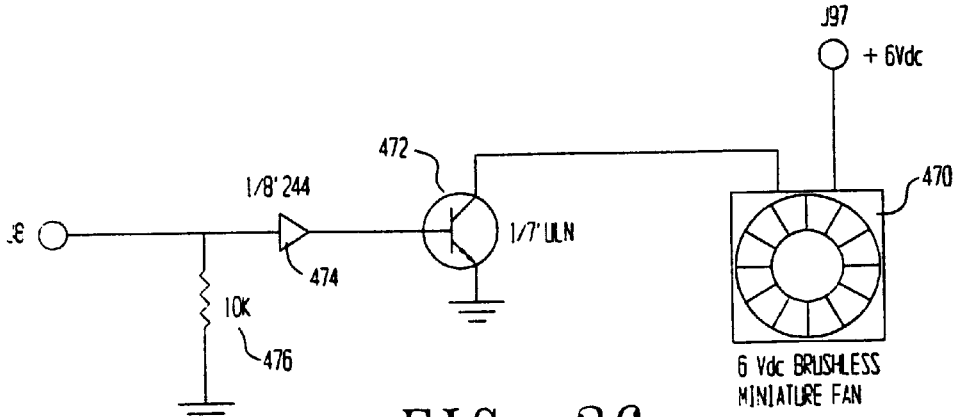
FIG. 36 is a circuit diagram for controlling the fan of the scavenging system for the microprocessor-controlled embodiment of the present invention.

An exhaust fan output signal may be provided for controlling activation (on/off) of an exhaust fan. After combustion but before the next trigger cycle, gas byproducts must be scavenged from the combustion chamber. Referring to FIGS. 24 and 36, microprocessor 300 initiates a scavenge cycle by activating fan 470. When the fastener driver is removed from a working surface, rotary valve 48 opens. Microprocessor 300 switches fan 470 on by activating pin PB2. Transistor 472 conducts and fan 470 is activated to draw air through the combustion chamber to clear it. In the present embodiment, fan 470 is a low-power brushless DC motor fan and transistor 472 is a Darlington bipolar junction transistor.

As discussed above, the preferred embodiment includes a first power supply for the microprocessor and a second power supply for other components, i.e., the peripheral components. A peripheral power output signal may be provided by the microprocessor to control the application of power to the peripheral components. The status of a peripheral power output signal may also define different modes of operation of the fastener driver tool.

In general, the fastener driving tool of the present embodiment has two modes of operation, run and sleep. Run mode is the active or firing mode. Sleep mode is the mode for conserving the driver's resources. Microprocessor 300 directs the driver into the run mode and the sleep mode by activating and deactivating the power relay.

Microprocessor 300 may direct the fastener driver between modes of operation in response to periods of inactivity, activity, and safety and security input signals. If the fastener driver is in run mode, microprocessor 300 may call a mode reset routine when the fastener driver has been inactive for a predetermined period of time, a system failure is detected, a hazardous condition is detected, such as a jam in the nose of the device, or an invalid user password is entered.

To conserve battery power and increase the safety of the fastener driver, the control system of the present embodiment includes an idle-detect feature for turning the peripheral components off if the tool has not been used for a predetermined period of time. A manual switch is also provided so that the operator may direct the fastener driver between modes of operation.

The idle-detect feature of the present invention is incorporated in the microprocessor program. When the driver is in run mode, microprocessor 300 increments a counter at each CPU timer overflow event (i.e., every 32.77 ms). The counter is reset when fastener driver activity is detected. If, however, the fastener driver is not used for a predetermined time interval, the driver, specifically microprocessor 300, enters the sleep mode. The time interval may be any duration. In the present embodiment the time interval may be within the range of 1 minute to 255 minutes. Different time intervals may also be used for different applications. For example, the time interval for entering a user-password may be a fraction, one-half for example, of the user-activity time interval. Microprocessor 300 may equate keypad activity and fastener discharge with fastener driver tool use.

The operator directs the fastener drive into (or out of) sleep mode by closing a switch. Referring to FIG. 24, manual switch 312 is shown in the open position. When the switch is closed a signal is received at reset* pin 16 and microprocessor 300 executes a mode-change routine.

In the mode-change routine, microprocessor 300 initializes operating variables and timer functions and checks its memory to determine whether the fastener driver is presently in the run mode or the sleep mode.

As shown in FIGS. 40A through 40I, upon entering the sleep mode microprocessor 300 sets a status indicator to sleep mode. Microprocessor 300 then turns the outputs off and updates the fastener status database, records fault codes, if any, waits for a preset shut-down delay, turns off the displays, provides an audible alarm, and turns the power relay off to deactivate the peripheral components.

The fastener driver may also enter sleep mode if the microprocessor's power supply drops below a threshold level. This aspect of the invention prevents the microprocessor from operating with a depleted power supply, which may cause erratic operation. Microprocessor power supply detection circuitry includes relay under-voltage sensing circuit 310 as shown in FIG. 24.

Microprocessor 300 remains in the sleep mode until switch 312 is closed or the microprocessor battery is reconnected. As shown in FIGS. 40A through 40I, upon entering the run mode the microprocessor 300 updates its status to reflect that it is in run mode, turns all outputs off, and activates power relay 360. After a short delay, microprocessor 300 configures its pins and communication ports. All outputs are then turned off and the shot counter is loaded. The control system then proceeds in accordance with the type of user interface. Microprocessor 300 is also programmed to enter the run mode when the microprocessor is first connected to the power supply.

Microprocessor 300 controls power to the peripheral devices through microprocessor pin PA7. Referring to FIGS. 25 and 28, main battery 502 functions as a continuous 6 volt DC supply for relay 368. Referring to FIGS. 24 and 25, when microprocessor 300 outputs a positive threshold voltage at pin J6, transistor 364 conducts and provides a path for current to flow from main battery 502 through the relay windings to ground, thus activating the relay. Output power relay terminal J97 is then provided with voltage from main battery 502 and output power relay terminal J99 is interconnected to input relay terminal J98. As a result, trigger signal circuit 400 (FIG. 29), temperature sensor circuit 412 (FIG. 30), and fuel pressure sensor circuit 420 (FIG. 31), are supplied with a 5V DC power source from 5V DC regulator 324. Hardware status LED circuit 370 (FIG. 26), fuel system circuit 442 (FIG. 34), ignition system circuit 232 (FIG. 35), scavenging system circuit 468 (FIG. 36), and main battery circuit 436 (FIG. 33) are supplied with 6V DC power source. Fastener tool user interface circuits 510 and 600, shown in FIGS. 37 and 38, respectively, are also supplied with 5V DC power.

Of course, batteries supplying voltages different than those indicated above may be used for achieving certain operating standards. For example, the fuel system circuit may be supplied by a 12V battery rather than a 6V battery. Because the main battery voltage may affect the fuel control valve response time, as discussed above, a 12V battery will provide additional capacity from which to operate the control valve. The 12V battery may be regulated to 6V, or to some other voltage, ensuring sufficient and consistent voltage from which to drive the fuel system circuit. Other systems may similarly be driven by batteries having voltage or current supplying characteristics suitable for the particular application.

An output signal may also be provided to a user-interface for communicating to an operator. The user-interface may include a visual display for displaying operational or other data to the operator and/or may include a sound generator. The user-interface may also include an audio signal generator, such as a buzzer, for alerting the operator to special conditions, such as the detection of a safety problem.

An output device may include a visual display, such as one or more LEDs or an LCD, or a sound generator. The output of the control system may be categorized into constant and intermittent outputs. The constantly active output device may provide an indication of whether the driving tool is deactivated or is unsafe to operate. The intermittently active device may provide detailed information about the current control parameters.

In the present embodiment, the control system also provides a constant display of the status of the peripheral devices and other selective driving tool parameters.

Hardware status LED circuit 370, shown in FIG. 26, indicates whether power relay circuit 360 is open or closed. Green LED 376 is powered directly by main battery 502 when relay 368 has been activated. Hardware status LED circuit 370 also includes red LED 374 that is driven by microprocessor 300 at PC1. Microprocessor 300 indicates a system warning by flashing red LED 374 and indicates a system failure by steadily activating the LED 374.

Examples of conditions warranting a system warning are low fuel or low battery. Examples of system failures are empty fuel container, an empty magazine, a jammed nose, excessive temperature, a dead main battery, or a substantially exhausted microprocessor battery.

Figure 27:
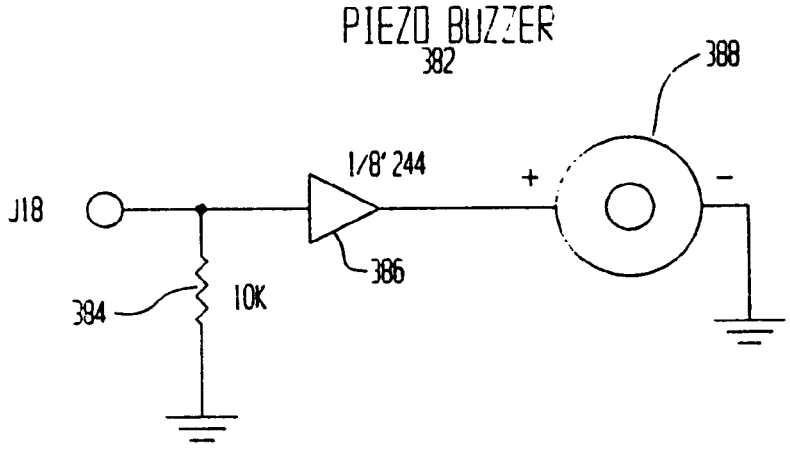
FIG. 27 is a circuit diagram showing a piezo buzzer and related circuitry for the microprocessor-controlled embodiment of the present invention.

In addition to LED 374 and 376, piezo buzzer circuit 382 (FIG. 27) provides an audible system alert for the operator. In the preferred embodiment, the audible alert is activated to alert the operator of an immediate hazard or condition that requires immediate attention, as detected by the control system. Microprocessor 300 activates piezo buzzer 388 via output PC2.

Figure 37:
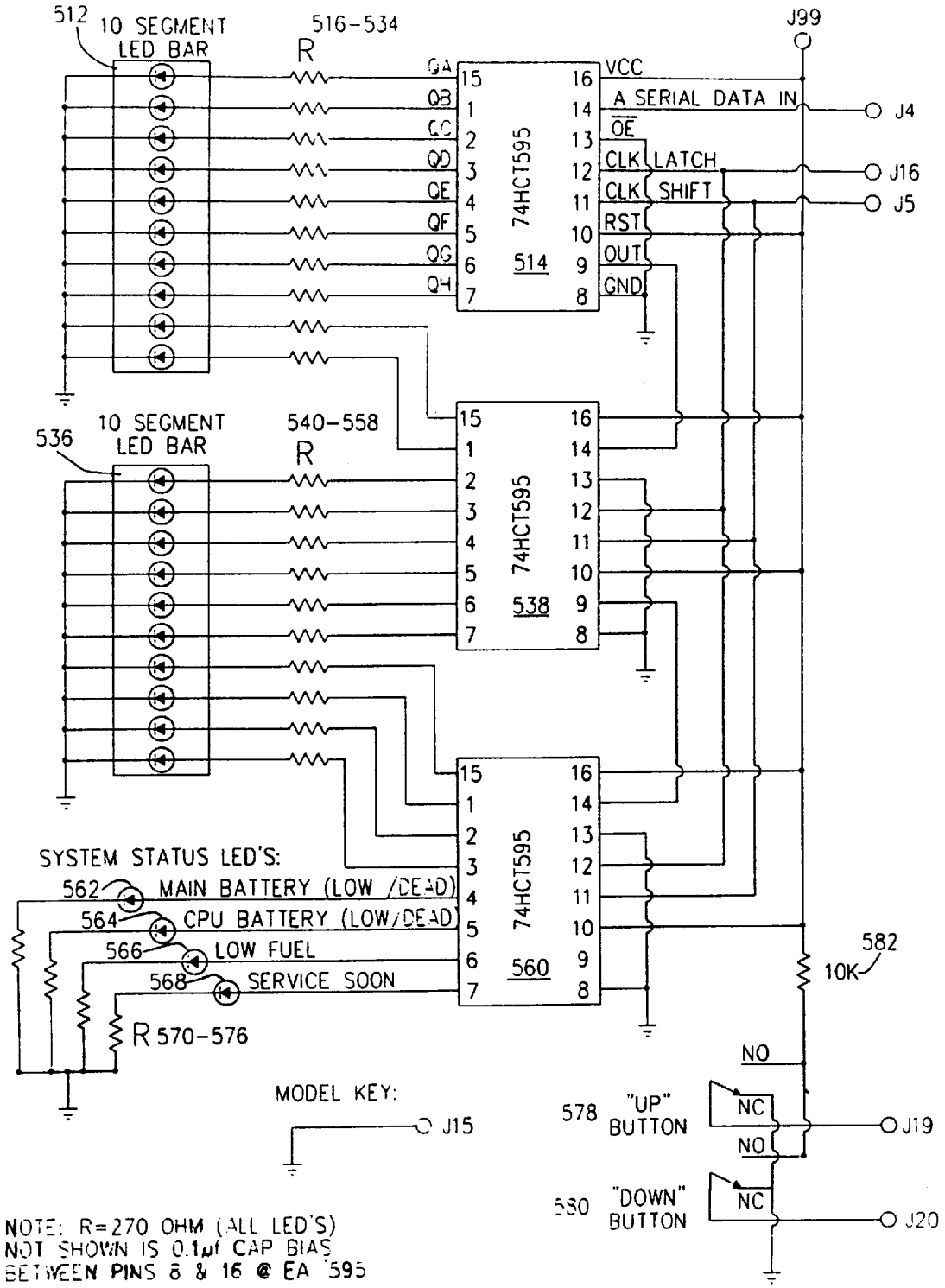
FIG. 37 is a circuit diagram of a user interface circuit for the microprocessor-controlled embodiment of the present invention.

In the present embodiment, the user interface communicates with the microprocessor through an SPI-based serial link. The economy model user interface unit 510 is shown in FIG. 37. Data is transferred from micro-processor 300 terminals PD3, PD4, and PC0 to the 10 segment LED bars, 512 and 536. Shift registers 514, 538, and 560 provide a parallel data format to LED bars 512 and 536. Fuel interval offset "up" and "down" buttons 578 and 580, respectively, provide signals to microprocessor 300 at terminals J19 and J20, respectively. In the present embodiment, economy model user interface 510 includes system status LEDs 562–568, which indicate the status of main battery 502, CPU battery 332, the fuel level, and service needs, respectively. Additional system status LEDs may be provided for communicating other information to the operator.

Deluxe model user interface circuit 600 is shown in FIG. 38 and includes an LCD for displaying control system information to the operator or technician. Data is transferred from microprocessor 300 terminals PD3, PD4, and PC0 to LCD 606. Shift registers 602 and 604 provide a parallel data format to LCD display 606. LCD display 606 also may provide system warning and fault messages.

The deluxe model user interface may also include a sixteen-key keypad 610 for inputting numerical and alphanumerical data signals to microprocessor 300 at terminals PC3–PC6.

An output signal may include data to be communicated to an external data processing device. The data may relate to an operation or condition of the fastener driver and may be combined with data from other fastener drivers for analysis.

A communication module 650 is illustrated in FIG. 39. Communication module 650 consists of a low power RS232 dual driver/receiver 652 coupled to a phone jack 666 and a molex 4-pin header 664. The communication module allows operational data stored in microprocessor 300 to be downloaded to a PC through the serial port. The communications module 650 translates microprocessor transmit and receive signals to RS232 levels. Communications port 650 also provides a means to program microprocessor memory.

Having thus described individual components and features of a fastener driver tool having the control system of the present embodiment, a summary of the function of the tool in accordance with its use follows.

Assuming that the fastener driver is off, activation of the tool starts with the control system. Upon activation of the tool by an operator, the control system may prompt the operator for a user-identification code through the display on the user interface. The operator may then enter a user-identification code via the keyboard or other input device such as a microphone or magnetic reader. The control system will continue to prompt the operator for a valid user-identification code until a valid code is entered. If a valid code is entered, the control system may read switch or sensor inputs and update data base parameters such as ambient temperature and pressure, magazine content, fuel pressure, and battery power level indicators. Other data base parameters may also be updated in accordance with additional switch or sensor input.

The control system may also determine whether fastener tool 10 may be in need of a service check and communicate that information to the operator through the user interface circuit.

The microprocessor may check all operational parameters and fastener status inputs against acceptable ranges. If any parameter is outside of the acceptable range, the control system may halt operation of the fastener driver until that parameter is within range or the control system may alert the operator via the user interface such as a display or audio signal. For example, if fuel pressure is below a certain threshold, then operation may be halted. If, however, the magazine content is below a certain number, the user interface may display a corresponding message to the operator. The control system may halt operation until the operator at least acknowledges the alert.

Microprocessor 300 can be programmed to check for a variety of other conditions. After the condition of fastener tool 10 is determined, microprocessor 300 may provide an appropriate display signal, such as instructing the operator to proceed. If, however, a severe fault has been detected, microprocessor 300 may enter the sleep mode.

Assuming that the operational parameters are within acceptable ranges, the microprocessor monitors the fastener trigger input. When the microprocessor receives a valid trigger input, it checks the status of inputs from the work surface contact switch or sensor, the work surface characteristic sensor, and the exhaust valve switch or sensor. If the inputs indicate that the fastener driver is not engaged against an appropriate work surface, the microprocessor may provide a corresponding message to the operator on the user-interface display, accompanied by an audio signal. The microprocessor will again await for the next trigger signal.

If the microprocessor receives a trigger input and the input signals indicate that it is engaged against an appropriate work surface, the microprocessor reads the operational data parameters for ambient pressure and temperature and determines the amount of fuel to be injected into the combustion chamber. The microprocessor also factors in a fuel interval offset value that may have been input by the operator through the user interface. The microprocessor outputs a signal to activate the fuel valve to allow fuel into the combustion chamber, closes the valve and then activates the ignition circuit. The microprocessor may repetitively activate the ignition circuit to burn more of the fuel in the chamber.

After a combustion cycle is complete, the microprocessor may check the fastener status related inputs such as the jam detector, magazine content switch, and others. If a jam is detected, the microprocessor may alert the operator through the user interface and halt operation of the fastener driver until the jam is cleared. The user interface may provide instructions to the operator as to the safe procedure for clearing a jam.

The microprocessor may update all of its databases and again wait for a trigger signal. If a significant amount of time passes and the microprocessor does not receive a trigger or keypad signal, the microprocessor may turn off all power supplies except for the microprocessor power supply. The microprocessor may then stop processing until a signal is received from the reset or wake-up switch 312. When a manual switch signal is received, the microprocessor may prompt the user to enter a user-identification code.

Figure 41:
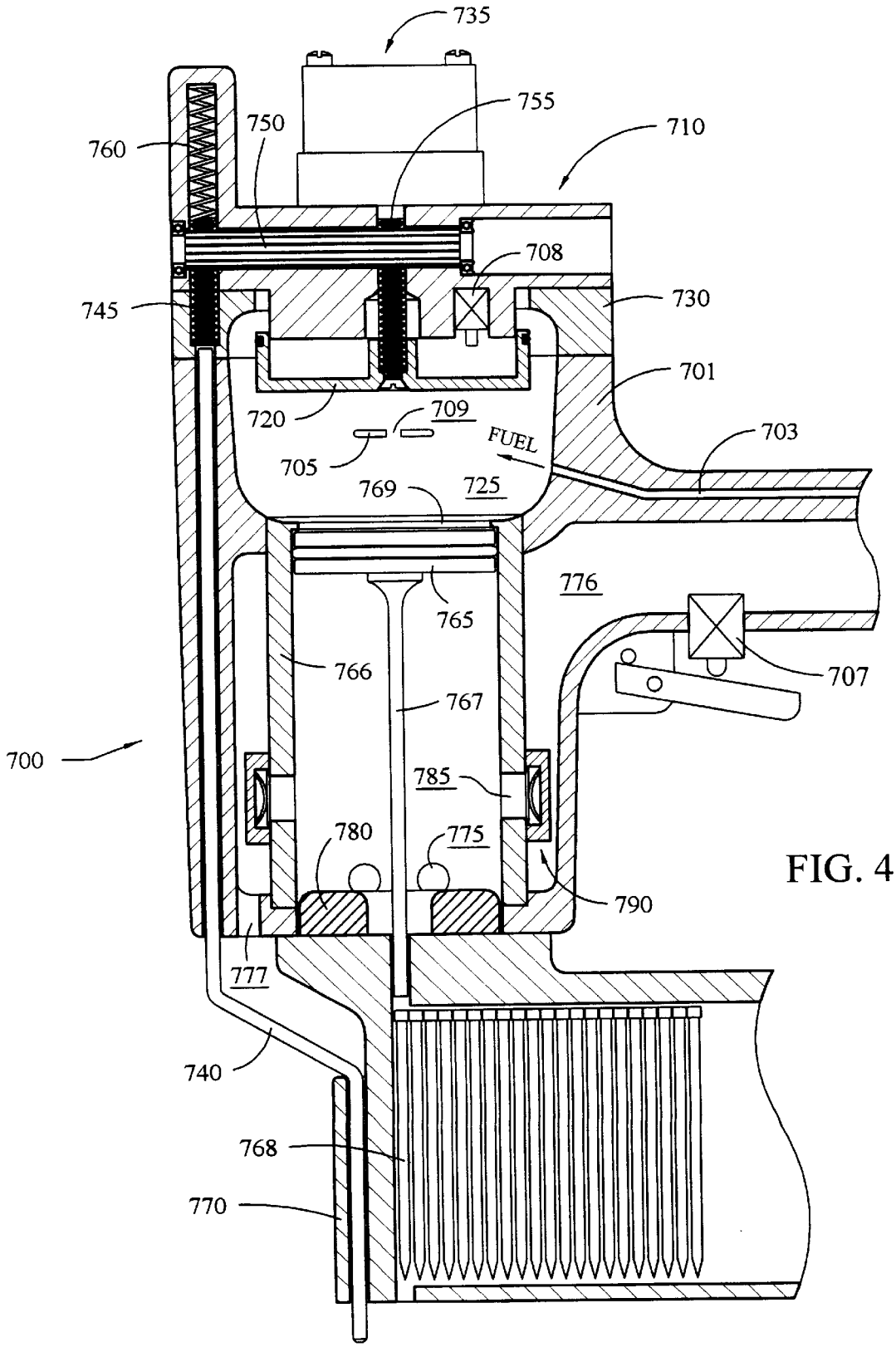
FIG. 41 is a partial longitudinal front cross section of a fastener driving tool showing an alternate embodiment of the cylinder head valve assembly.

Turning to FIGS. 41–46, there is seen a fastener driving tool according to the present invention having an alternate embodiment for the cylinder head valve assembly. With reference to FIG. 41, the fastener driving tool 700 includes a housing 701, similar to the above-described tool, with a fuel passage 703 defined by the housing. The tool 700 may include a series of electrodes 705, which are activated by a trigger switch 707. A safety switch 708 permits firing of the tool only when the tool is engaging a workpiece, as described in greater detail below. As with the previously-described tool, the electrodes 705 define an ignition source, such as a spark gap 709.

Figure 47:
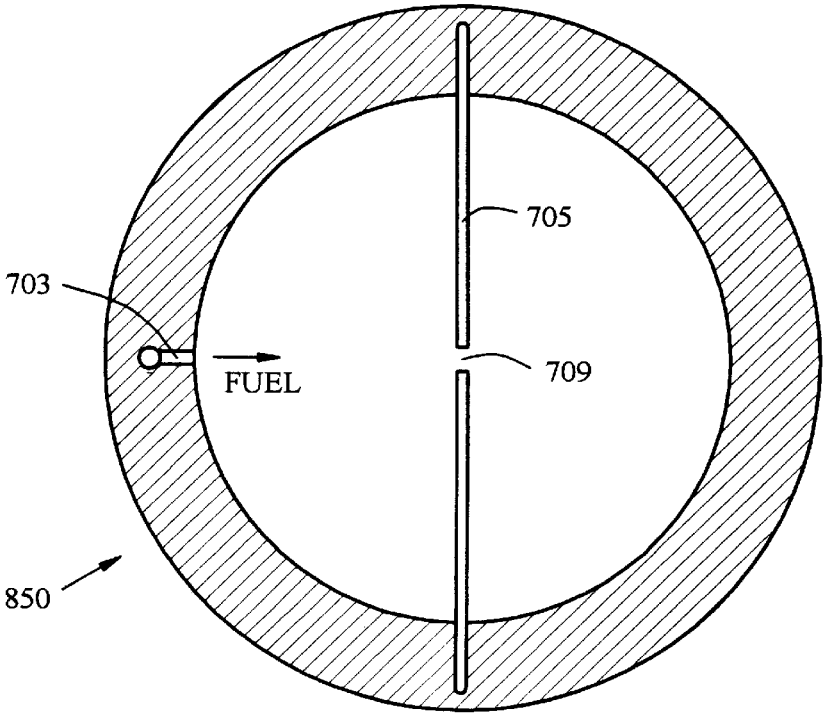
FIG. 47 is a cross sectional view of the combustion chamber and housing showing the fuel flow passageway directing fuel toward the ignition source.

Fuel passage 703 may be positioned and oriented so as to direct fuel to desired locations within the combustion chamber. For example, to increase the probability of achieving ignition, it may be preferable to direct fuel toward the ignition source to create a richer air/fuel mixture in the vicinity of the ignition source. As shown in FIGS. 41 and 47, the fuel passage 703 preferably directs the fuel towards one or more spark gaps 709, located at the approximate center of the combustion chamber.

Figure 48:
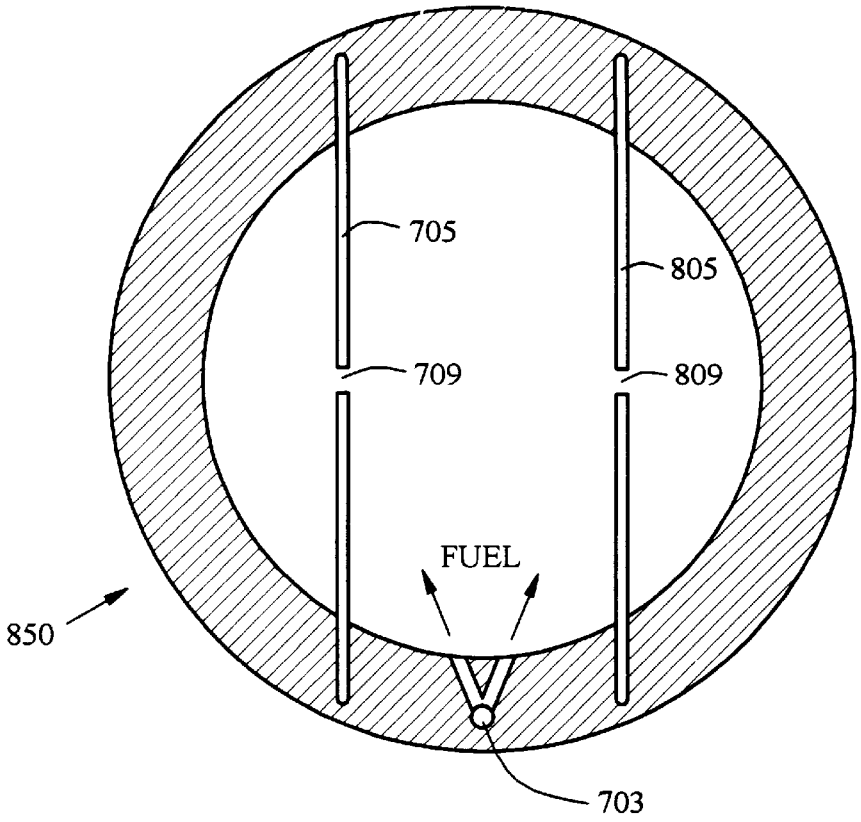
FIG. 48 is a cross sectional view of the combustion chamber and housing showing the fuel flow passageway directing fuel in two directions, toward each of two ignition sources.
Figure 49:
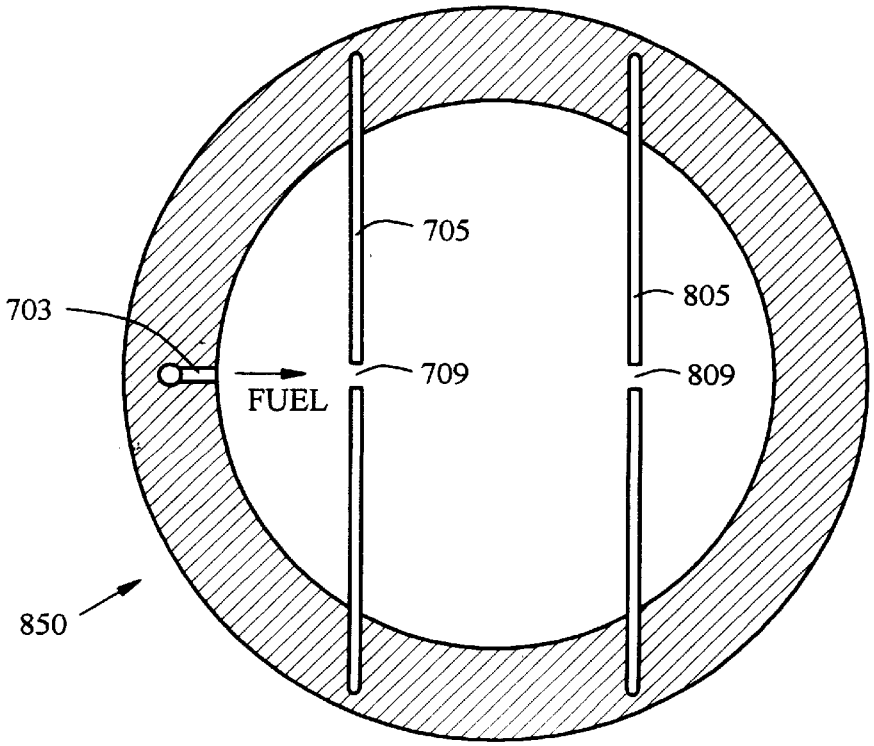
FIG. 49 is a cross sectional view of the combustion chamber and housing showing the fuel flow passageway directing fuel in a single direction, across each of two ignition sources.

Other electrode and fuel passage configurations may also be used. For example, as shown in FIGS. 48 and 49, two electrode sets 705 and 805 define two spark gaps 709 and 809, respectively. As shown in FIG. 48, fuel passage 703 is located between the spark gaps and directs the fuel in two directions, with a separate stream toward each spark gap. In still another embodiment, illustrated in FIG. 49, the fuel is directed by fuel passage 703 that is in-line with the spark gaps and directs the fuel flow in a single direction, across both spark gaps.

Figure 44:
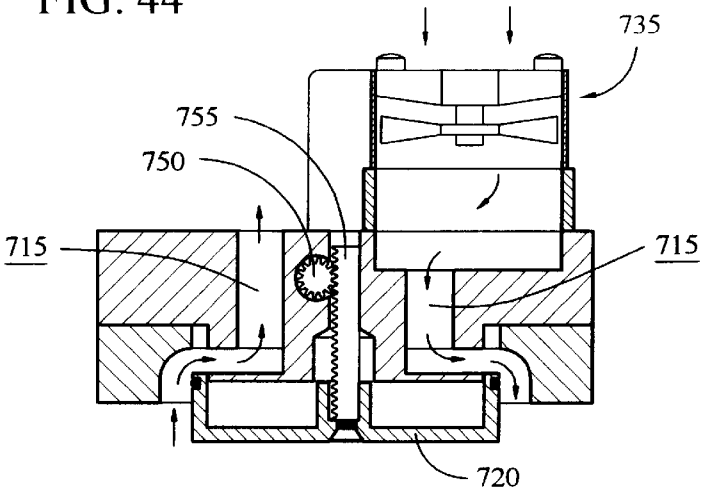
FIG. 44 is a partial longitudinal side cross section of the fastener driving tool of FIG. 41 with the cylinder head valve assembly in the "open" position showing the flow of air through the ducted openings as induced by a fan.
Figure 45:
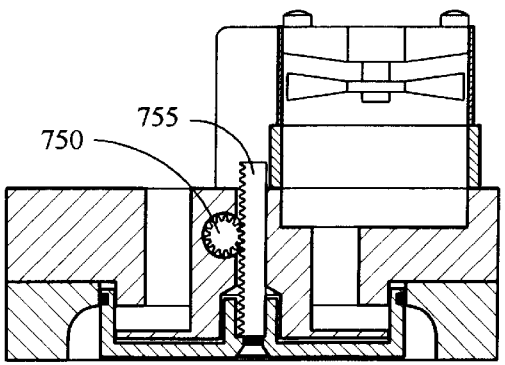
FIG. 45 is a partial longitudinal side cross section of the fastener driving tool of FIG. 41 with the cylinder head valve assembly in the "closed" position.
Figure 42:
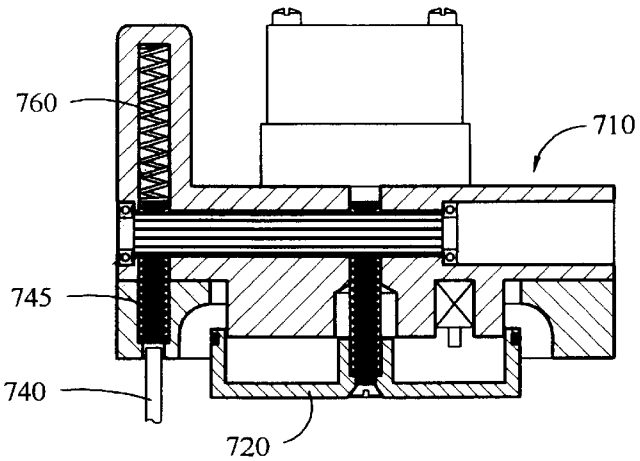
FIG. 42 is a partial longitudinal front cross section of the fastener driving tool of FIG. 41 with the cylinder head valve assembly in the "open" position showing the positions of the push rod, racks and the valve piston.

As best seen in FIG. 44, the tool 701 includes an improved valve assembly 710 comprised of two diametrically opposed ducted openings or exhaust ports 715 and a movable valve element such as a reciprocally movable valve piston 720, which operates to allow or prohibit air from passing into or out of the combustion chamber 725. The illustrated piston is generally circular and in the form of a shallow cylinder, closed at one end and open at the other end. In the closed position (FIG. 45), the side wall of the cylindrically shaped piston is received into a mating recess in the outer cylinder 730. An o-ring is preferably provided in the side wall of the piston so that the piston seals more completely against an outer cylinder 730 to prevent passage of air in or out of the combustion chamber. Although illustrated in the form of a shallow cylinder, other shapes or forms may be used for the reciprocal valve element without departing from the present invention.

In the open position (FIG. 44), the piston moves to expose the ducted openings 715 to allow movement of air in through one duct and out the other. The flow of air in and out of the combustion chamber may be induced by one or two fans 735 mounted at either or both of the opposite openings of the ducts. Air is forced through one opening into the combustion chamber and drawn out through the other.

Figure 46:
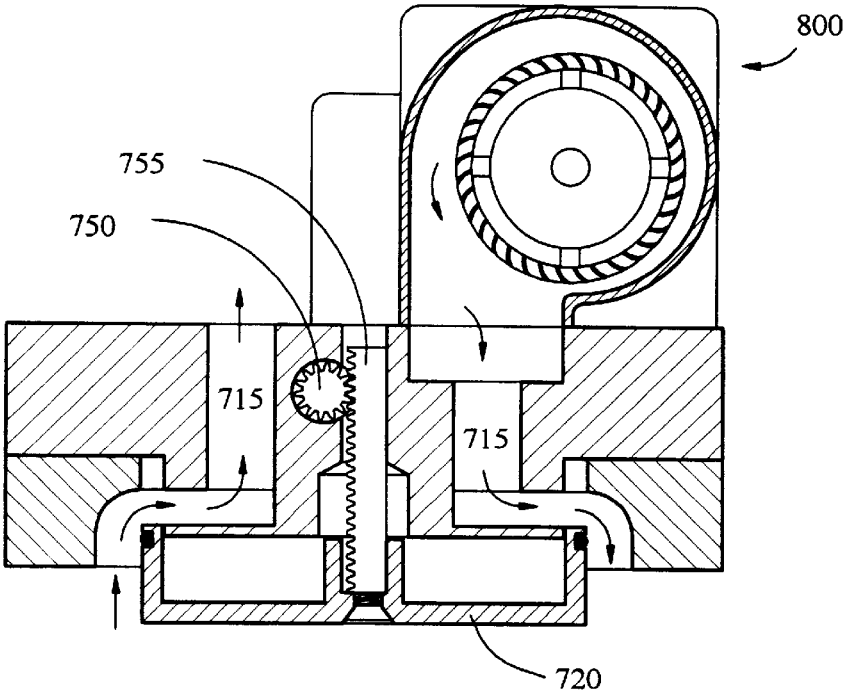
FIG. 46 is a partial longitudinal side cross section of the fastener driving tool of FIG. 41 with the cylinder head valve assembly in the "open" position showing the flow of air through the ducted openings as induced by a blower.

Air flow may be induced by mechanisms other than, or in addition to, a fan. For example, as shown in FIG. 46, a squirrel cage blower 800 may be mounted in association with the ducted openings and/or exhaust ports to provide a greater air flow rate. Because the air flow in the illustrated embodiment is around the valve element, there is greater resistance to the flow than in the earlier embodiment, and a blower such as shown in FIG. 46 may provide a greater air flow rate than a simple fan if against such resistance.

Referring back to FIG. 41, when the valve is in the open position, push rod 740 protrudes past the nose of the tool. When the tool is pressed against a workpiece, the push rod 740 engages a first gear rack 745, which, in turn, engages a gear 750. The gear 750 engages a second gear rack 755 attached to the valve piston 720 to move it into the closed position. A compression spring 760, which is engaged against the first gear rack and is opposite of the push rod (FIG. 42), returns the valve to the open position when the tool is retracted from the workpiece.

Figure 43:
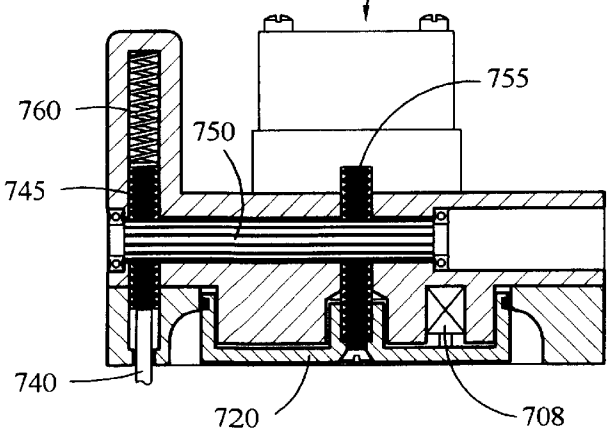
FIG. 43 is a partial longitudinal front cross section of the fastener driving tool of FIG. 41 with the cylinder head valve assembly in the "closed" position showing the positions of the push rod, racks and the valve piston.

Prior to driving a nail, nosepiece 770 is brought into contact with the workpiece. Push rod 740 moves upward, thus closing the valve. This also closes safety switch 708 (FIG. 43).

To drive a nail, the operator closes trigger switch 707. When both the trigger switch 707 and safety switch 708 are closed, the control system for the tool causes a metered quantity of gaseous fuel to enter combustion chamber 725 through fuel passage 703. The fuel mixes with fresh air already in the chamber.

After the fuel charge enters the combustion chamber, a high voltage is applied across electrodes 705, causing a spark to jump across spark gap 709. This ignites the fuel, causing a rapid rise in pressure that drives a lower piston 765 downward within its sleeve 766. A driver blade 767 attached to the piston 765 contacts the head of nail 768 and drives the nail into the work piece.

As the piston 765 moves downward, air below piston 765 escapes through sleeve vent ports 775, into the space 776 between the housing 701 and the sleeve 766, and then to the atmosphere through housing vent ports 777. When the piston 765 approaches the end of its stroke, exhaust ports 785 are uncovered, allowing exhaust gas to escape into space 776 through check valve assembly 790, and then to the atmosphere through housing vents 777. At the end of its stroke, piston 765 collides with bumper 780 and comes to rest.

When pressure within the chamber approaches atmospheric pressure, exhaust check valves 790 close so that the atmospheric air cannot enter the cylinder through exhaust ports 785. The exhaust gas within the cylinder rapidly cools, causing a partial vacuum within the closed cylinder. Atmospheric pressure acting on the lower surface of piston 765 pushes the piston upward in sleeve 766 until it strikes shoulder 769, and comes to rest at the top of its stroke. Sleeve vents 775 and housing vents 777 allow the portion of the cylinder below piston 765 to communicate with the atmosphere so that a constant force is maintained against the lower surface of the piston as it moves upward.

When lower piston 765 reaches the top of its stroke and comes to rest, the pressure within combustion chamber 725 is still slightly below atmospheric pressure. Thus, a force due to atmospheric pressure acts on the top side of upper piston 720 through ducts 715. When the operator lifts the tool away from the work piece after driving a nail, this atmospheric force assists spring 760 in overcoming seal drag to open the valve.

Thus, it is seen from the foregoing description that the present invention provides an improved internal combustion gas-powered tool. As used herein, tool is intended to be broadly defined, including but not limited to hand tools such as the described fastener driving tool. While the invention has been described in conjunction with certain specific embodiments, it is evident that many alternatives, modifications, and variations will be apparent to those skilled in the art. Consequently, the following claims are intended to cover all such alternatives, modifications, and variations within the words of the claims.

What is claimed is:

1. A control system for a fastener driver for driving a fastener into a work surface, said control system comprising at least one driver condition signal generator for generating a condition signal responsive to selected condition of said driver and a programmable microprocessor adapted to receive at least one said driver condition signal and to generate at least one responsive fastener driver control signal.

2. An internal combustion powered fastener driver comprising:

a cylinder and a piston reciprocally movable within said cylinder;

a combustion chamber defined at one end of said cylinder;

an ignition source associated with said combustion chamber;

a fuel flow passageway opening into said combustion chamber;

a control valve for controlling flow of fuel through said passageway;

at least one driver condition signal generator for generating a condition signal responsive to a selected condition of said driver; and a control system for controlling said ignition source and said control valve, said control system comprising a programmable microprocessor adapted to receive said at least one driver condition signal and to generate at least one responsive control signal for controlling selected of said ignition source and control valve.

3. The internal combustion powered fastener driver of claim 2 wherein said programmable microprocessor controls said control valve such that the flow of fuel through said passageway is at least in part responsive to said driver condition signal.

4. The internal combustion powered fastener driver of claim 2 wherein said at least one driver condition signal generator is selected from the group consisting of:

(i) a work surface contact signal generator;

(ii) an exhaust valve position signal generator;

(iii) a jam detector signal generator;

(iv) a magazine content signal generator;

(v) a work surface characteristic signal generator; and (vi) an authorized-user signal generator;

and wherein said control system enables operation of the fastener driver only upon receipt of a condition signal from said selected at least one signal generator.

5. The internal combustion powered fastener driver of claim 2 further comprising a communications port communicating with said microprocessor for external data communication.

6. The internal combustion powered fastener driver of claim 2 wherein said control system further includes a user interface.

7. The internal combustion powered fastener driver of claim 6 wherein said user interface further comprises a user display for displaying information regarding the condition of said driver and a user input device for inputting information into said control system.

* * * * *

UNITED STATES PATENT AND TRADEMARK OFFICE

CERTIFICATE OF CORRECTION

PATENT NO : 6,123,241

DATED : September 26, 2000

INVENTOR(S) : Tony J. Walter and J. Oscar Aparicio,

It is certified that error appears in the above-identified patent and that said Letters Patent are hereby corrected as shown below:

Front page, delete "Tony J. Walter" as an inventor.

Signed and Sealed this

First Day of May, 2001

*Attest:*

Nicholas P. Godici

NICHOLAS P. GODICI

*Attesting Officer*

*Acting Director of the United States Patent and Trademark Office*